US005110104A

United States Patent [19]

Wakao et al.

[11] Patent Number: 5,110,104

[45] Date of Patent: May 5, 1992

[54] SHEET TRANSPORTING DEVICE WITH CARRIAGE UNIT

[75] Inventors: Naho Wakao, Machida; Masakazu Hiroi, Yokohama; Makoto Kitahara; Yuji Takahashi, both of Tokyo, all of Japan

[73] Assignee: Canon Kabushiki Kaisha, Tokyo, Japan

[21] Appl. No.: 524,928

[22] Filed: May 18, 1990

[30] Foreign Application Priority Data

| | | | |
|---|---|---|---|
| May 19, 1989 | [JP] | Japan | 1-126507 |
| May 19, 1989 | [JP] | Japan | 1-126508 |
| May 19, 1989 | [JP] | Japan | 1-126510 |
| May 19, 1989 | [JP] | Japan | 1-126511 |

[51] Int. Cl.[5] ..... B65H 5/22

[52] U.S. Cl. ..... 271/3.1; 271/258; 271/265; 271/268; 271/274; 271/300; 271/302; 271/176; 271/184; 271/188; 271/84

[58] Field of Search ..... 271/3.1, 267, 268, 300, 271/302, 81, 84, 76, 184, 199, 200, 258, 265, 272, 274, 188, 189, 65

[56] References Cited

U.S. PATENT DOCUMENTS

| | | | |
|---|---|---|---|
| 4,542,896 | 9/1985 | Takahashi | 271/111 |
| 4,580,774 | 4/1986 | Yamaguchi et al. | 271/84 X |
| 4,678,180 | 7/1987 | Tamura et al. | 271/200 X |
| 4,769,674 | 9/1988 | Kitajima et al. | 355/14 SH |
| 4,890,826 | 1/1990 | Rutishauser | 271/302 X |
| 4,900,009 | 2/1990 | Kitahara et al. | 271/296 |
| 4,913,426 | 4/1990 | Kaneko | 271/300 X |
| 4,958,827 | 9/1990 | Kaneko | 271/81 X |

FOREIGN PATENT DOCUMENTS

| | | | |
|---|---|---|---|
| 22253 | 2/1983 | Japan | 271/302 |
| 75768 | 4/1986 | Japan | 271/176 |
| 43160 | 2/1990 | Japan | 271/84 |

*Primary Examiner*—Robert P. Olszewski
*Assistant Examiner*—Boris Milef
*Attorney, Agent, or Firm*—Fitzpatrick, Cella, Harper & Scinto

[57] ABSTRACT

This invention relates to the sheet transporting apparatus having a sheet storage device capable of storing sheets and provided in the middle of a sheet transport path; and a carriage unit with a sheet discharge mechanism for transporting a sheet to the sheet storage device and capable of reciprocating motion substantially above said sheet storage device.

16 Claims, 55 Drawing Sheets

(HALF SIZE INTERMEDIATE TRAY MOUNTED)

| |
|---|
| FIG. 22A |
| FIG. 22B |

(THROUGH PATH)

| |
|---|
| FIG. 23A |
| FIG. 23B |

| SENSOR | | CARRIAGE SHIFT POSITION | ROLLER PRESSURE |
|---|---|---|---|
| 51 | 46 | | |
| ON | OFF | b | NOT RELEASE |
| ON | ON | b | RELEASE |
| OFF | ON | a | RELEASE |

HALF SIZE (INTERMEDIATE TRAY)

| SENSOR NO / PATTERN | 14 | 43 | 60 | CARRIAGE 1 | CARRIAGE 2 |
|---|---|---|---|---|---|
| 1 | ON | OFF | OFF | B | C |
| 2 | ON | ON | OFF | A | D |
| 3 | ON | ON | ON | A | D |
| 4 | OFF | ON | ON | A | D |
| 5 | OFF | OFF | ON | A | C |

FULL SIZE (INTERMEDIATE TRAY)

| SENSOR NO / PATTERN | 79 | 80 | CARRIAGE 1 | CARRIAGE 2 |
|---|---|---|---|---|
| ① | ON | OFF | B | D |
| ② | ON | ON | B | D |
| ③ | OFF | ON | A | D |

FIG. 87

FULL SIZE (THROUGH PATH))

| SENSOR NO / PATTERN | 79 | 80 | 81 | 82 | CARRIAGE 1 | CARRIAGE 2 |
|---|---|---|---|---|---|---|
| ① | ON | OFF | OFF | OFF | B | D |
| ② | ON | ON | OFF | OFF | B | D |
| ③ | ON | ON | ON | OFF | A | D |
| ④ | OFF | ON | ON | OFF | A | D |
| ⑤ | OFF | OFF | ON | ON | A | C |
| ⑥ | OFF | OFF | OFF | ON | A | C |

FIG. 88

HALF SIZE (THROUGH PATH))

| SENSOR NO / PATTERN | 4 | 43 | 60 | 82 | CARRIAGE 1 | CARRIAGE 2 |
|---|---|---|---|---|---|---|
| ① | ON | OFF | OFF | OFF | B | C |
| ② | ON | ON | OFF | OFF | B | C |
| ③ | ON | ON | ON | OFF | A | D |
| ④ | OFF | ON | ON | OFF | A | D |
| ⑤ | OFF | OFF | ON | OFF | A | D |
| ⑥ | OFF | OFF | ON | ON | A | C |
| ⑦ | OFF | OFF | FF | ON | A | C |

SHEET TRANSPORTING DEVICE WITH CARRIAGE UNIT

BACKGROUND OF THE INVENTION

1. Field of the Invention

The present invention relates to a sheet transporting or conveying apparatus, and more particularly to a transport path of a both-side unit adapted for use on an image forming apparatus such as a copying machine.

2. Related Background Art

This is already known an automatic two-side recording apparatus utilizing for example the electrostatic recording method, for use as a copying machine or a printer. The automatic two-side recording in such apparatus is generally achieved in one of following two structures.

The first is based on a S-shaped path provided in the copying machine P2 as shown in FIG. 1. Refering to FIG. 1, an original document is placed on a platen 152 provided on top of a main body 151 of the copying machine P2, and is scanned by an optical system 156 in said main body 151 to form a latent image on a photosensitive drum in an image forming unit 157. Said latent image is developed into a toner image therein. In said main body 151 there are provided plural cassettes 159, 160 and a manual insertion cassette 161, all containing sheets S. Also plural sheets S are stored in a stacker 163 of a cabinet 162, supporting the main body 151 of the copying machine. These sheets S are fed by a sheet feeder 165, consisting of rollers and separating rollers provided on each cassette.

The sheet S thus fed is subjected to the transfer of the toner image in a transfer station 166 of the image forming unit 157, then transported to a fixing unit 169 by a conveyor belt 167 for image fixation by heat and pressure, and is discharged onto a tray 172 a discharge unit 171 consisting of discharge rollers 170.

In case of two-side copying for forming images on both sides of a sheet S, or overlay copying for forming two or more images on a face of the sheet S, the sheet S bearing a toner image on a face thereof is not discharged from the apparatus but is guided, through a flapper 173, to a branch path 175. In case of two-side copying, the sheet S is guided through the S-shaped path 176, and is discharged onto an intermediate tray 179 by the rollers 177. In case of overlay copying, the sheet S is guided by deflection members 180, 181 provided in said S-shaped path 176, and discharged onto the intermediate tray 179 from the middle part of said S-shaped path 176. The sheets S stacked on the intermediate tray 179 are separated from the bottom and fed again through a re-feed path 182 to the image transfer station 166 for image transfer again, thereby forming a two-side copy or an overlay copy.

The second is based on a C-shaped path shown in FIG. 2. In case of two-side or overlay copying, the sheet S bearing the image on a first face thereof is guided through a flapper 173 to a branch path 175, in a similar manner as in the above-explained structure with S-shaped path.

In case of two-side copying, the sheets have to be stacked on an intermediate tray 183, with the face bearing the first image upwards. Consequently the sheet S is transported through a flapper 185 to a switchback path 186, then to a transport unit 187 above the intermediate tray 183, and is discharged thereon through a deflection member 189 or 190, or through discharge rollers 191 at the end of the transport unit 187. In case of overlay copying, the sheet S is guided through the flapper 185, not to the switchback path 186 but to the transport unit 187, and is discharged, from a predetermined position thereof, onto the intermediate tray 183.

For defining an appropriate discharge position depending on the length of the sheet S in the two-side or overlay copying, deflecting members 189, 190 are provided above the intermediate tray 183 thereby enabling to select plural discharge positions.

However, in the copying machine P2 with the S-shaped path explained above, the sheet transport path from the fixing station 169 to the re-feed path 182 inevitably becomes very long, thereby significantly increasing the dimension, particularly the height, of the copying machine. Also such long transport path increases the points of sheet removal in case of sheet jamming, thus increasing the trouble in jammed sheet removal.

Also in case of two-side copying, the sheets S discharged onto the intermediate tray 179 are aligned in the feeding direction, utilizing the inclination of the intermediate tray 179 and the movement of said sheets S by the weight thereof, so that a certain loss time is inevitable from the sheet discharge onto the intermediate tray 179 to the start of sheet re-feeding. Such loss time becomes more marked as the number of sheets S used for two-side copying decreases, and deteriorates the efficiency of the copying machine particularly in case of producing a single two-side copy.

On the other hand, in the copying machine P3 utilizing the C-shaped path explained above, the sheet S tends to be separated from the front-end stopper position at the re-feeding, particularly when a sheet of large size (such as A3 or B4 size) is discharged onto the intermediate tray 179. For this reason the stacking of the sheets S on the intermediate tray 183 is very unstable, as the sheets may be bent or curled at the front end in the course of sheet discharge, depending on the rigidity or curling tendency of the sheets.

Also because the deflecting members 189, 190 for small-sized sheets (such as A4 or B5 size) are protrudingly present above the intermediate tray 183, the distance between said tray 183 and the discharge path becomes inevitably small, rendering the removal of jammed sheet extremely difficult in case of transport failure in the discharge path or in the intermediate tray 183.

SUMMARY OF THE INVENTION

In consideration of the foregoing, the object of the present invention is to provide a sheet transporting apparatus capable of eliminating the drawbacks mentioned above, by providing a carriage unit capable o reciprocating motion substantially above the intermediate tray for temporarily storing the sheets.

More specifically, as shown in FIGS. 3 to 9, the apparatus of the present invention is featured by sheet storage means capable of holding the sheets and provided in the middle of the sheet transport path, and a carriage unit capable of reciprocating substantially above said sheet storage means and provided with sheet discharge means for transporting sheets to said sheet storage means.

Thus the sheets can be stably stacked on the sheet storage means regardless of the size, by the carriage unit which reciprocates above said storage means and brings the sheet to and discharges it at a predetermined position.

Also the removal of jammed sheet from said sheet storage means can be easily achieved by moving the carriage unit from above the sheet storage means.

Also in case only one sheet is to be transported, said sheet is not placed on the sheet storage means but is directly transported by said carriage unit, whereby the loss in efficiency of the sheet transporting apparatus can be avoided.

Thus the present invention enables smooth sheet storage in the sheet storage means.

Also the absence of guide members, employed for transporting small-sized sheets in the conventional structures, provided a wider work space above the sheet storage means (intermediate tray), thereby facilitating the removal of jammed sheet.

Furthermore, in case only one sheet is to be transported, said sheet can be transported in direct manner to improve the efficiency of sheet transportation.

Furthermore, the sheet discharge position of said carriage unit is variable according to the size of the sheet transported by said carriage. A large-sized sheet is transported by a first carriage unit and discharged at an intermediate position above the sheet storage means. A small-sized sheet is transferred from the first carriage unit to a second carriage unit, and is discharged therefrom at a position close to a stopper of the sheet storage means. Consequently, the curled sheets can be stacked better since the sheets need not be in contact with a shutter defining the front end position of said sheets, in comparison with the conventional structures only capable of rough switching of discharge positions, in which for example the A3- and B4-sized sheets have to be discharged at a same position, as in the C-shaped path.

Furthermore, the absence of the discharge paths corresponding to the small-sized sheets in the conventional C-shaped path structure facilitates the removal of jammed sheets.

Furthermore, the removal of jammed sheets is facilitated by providing a carriage unit capable of reciprocating motion on sheet transport/discharge paths for the sheet storage means (intermediate tray) and moving said carriage unit, in case of sheet jamming, to an appropriate position, depending on the position of such sheet jamming.

BRIEF DESCRIPTION OF THE DRAWINGS

FIGS. 82 to 85 are views showing the functions at sheet jamming;

FIGS. 86 to 88 are charts showing the relation between the location of sheet jamming and the position of carriage movement.

DESCRIPTION OF THE PREFERRED EMBODIMENTS

Figure 1:
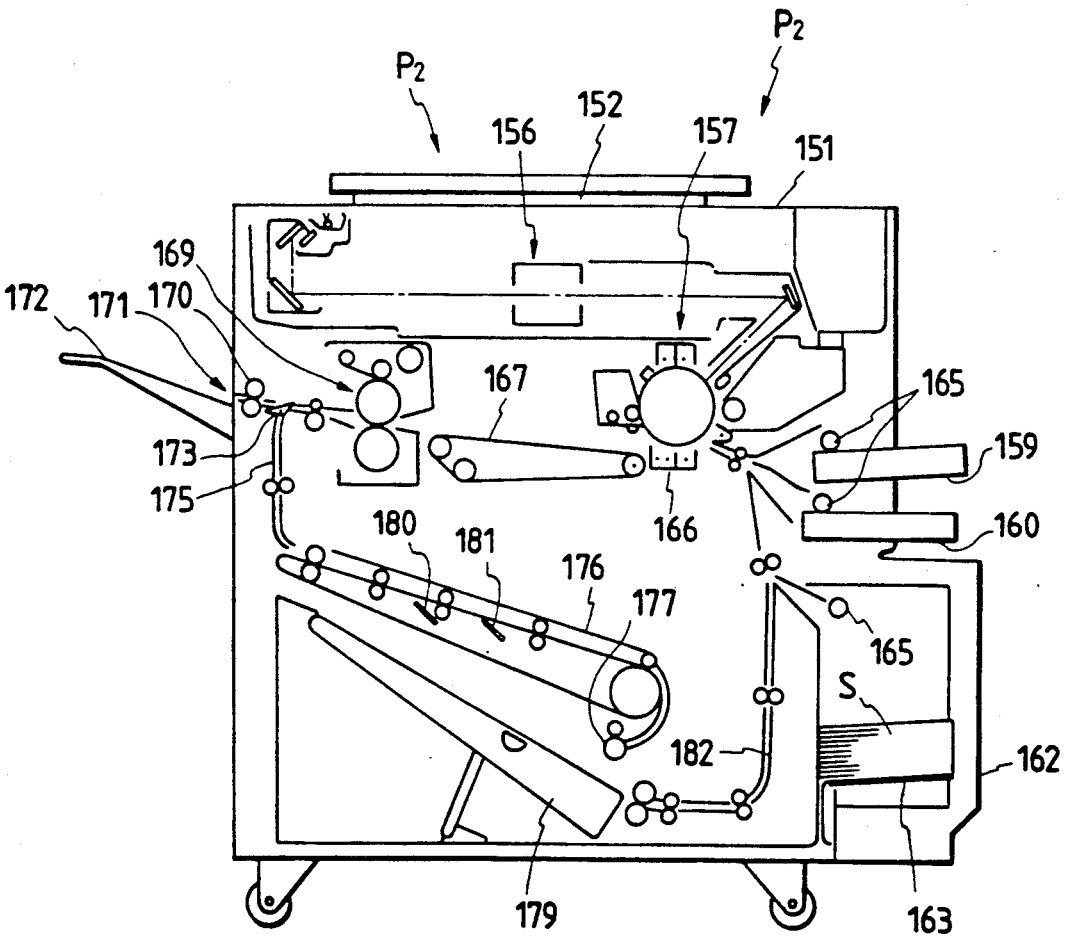
FIG. 1 PRIOR ART
FIG. 1 is a longitudinal cross-sectional view of a conventional image forming apparatus equipped with an S-shaped transport path.
Figure 2:
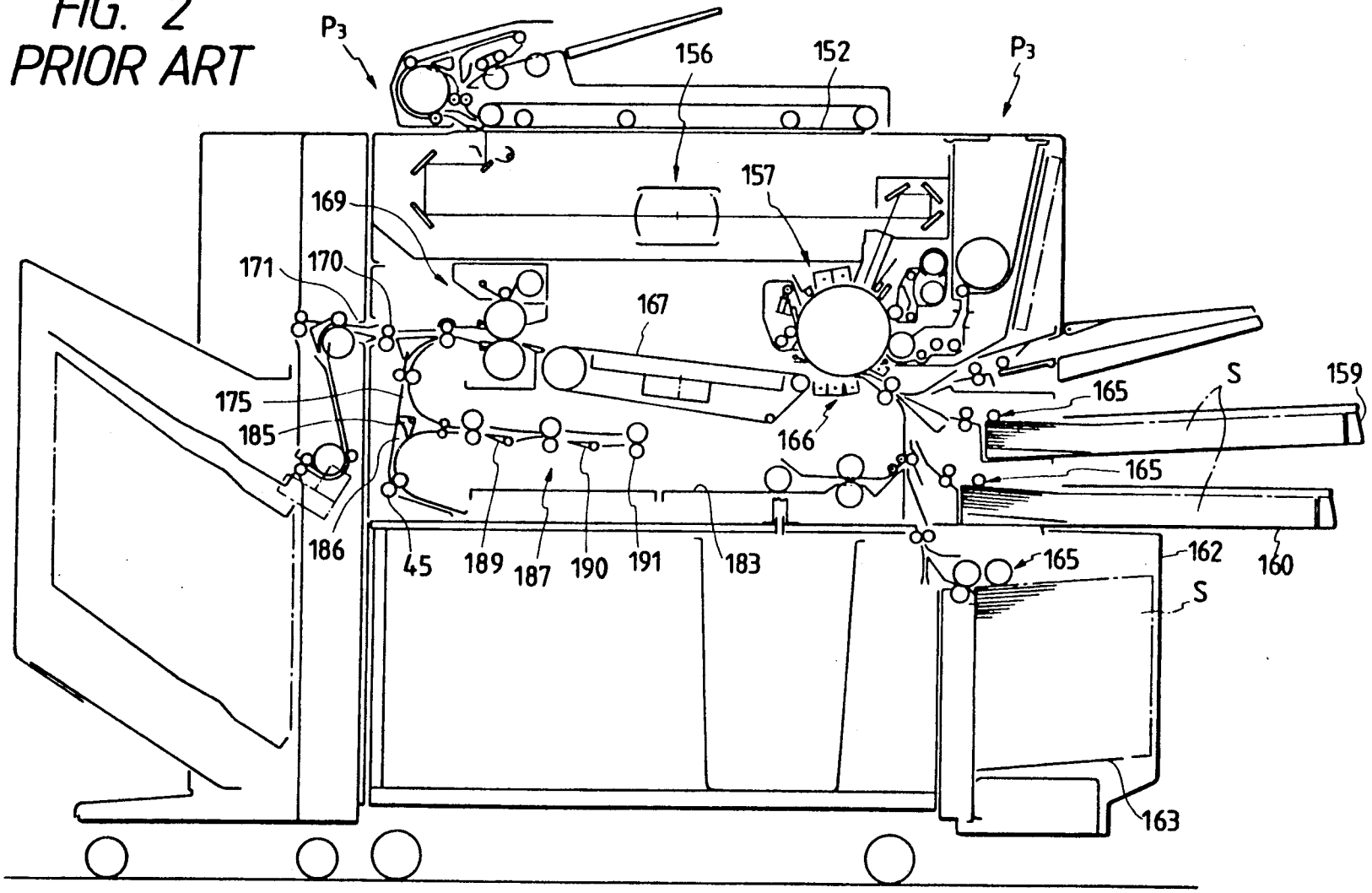
FIG. 2 PRIOR ART
FIG. 2 is a longitudinal cross-sectional view of a conventional image forming apparatus equipped with a C-shaped transport path.

In the following there will be explained a first embodiment of the present invention, with reference to FIGS. 3 to 24, in which same components as those in FIGS. 1 and 2 are represented by same numbers and will not be explained further.

Figure 3:
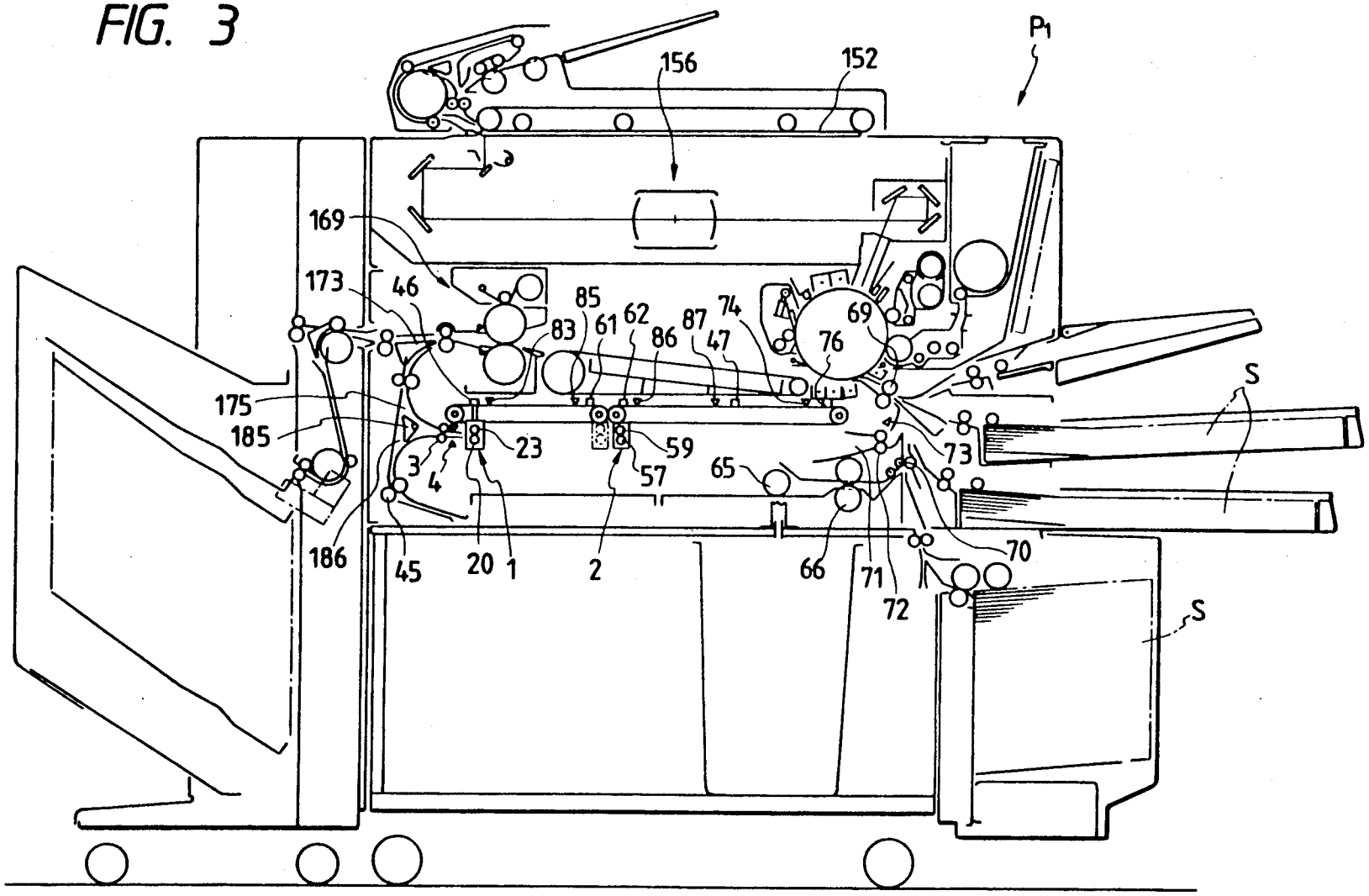
FIG. 3 is a longitudinal cross-sectional view of an image forming apparatus employing a sheet transporting apparatus constituting a first embodiment of the present invention.

FIG. 3 is a longitudinal cross-sectional view of a copying machine P1 in which applied is the first embodiment of the present invention. Referring to FIGS. 3 to 7, at the downstream side of the flapper 185, there are provided an intermediate tray discharge sensor 4 for sheet detection and paired discharge rollers 3. At the downstream side of and close to said discharge rollers 3, there is provided a first carriage unit 1 for transporting the sheet S by holding the front end thereof as will be explained later, and there is also provided a second carriage unit at the downstream side thereof. Each of said carriage units 1, 2 is provided with a frame 5 composed of an upper plate 5*a* and lateral plates 5*b*, 5*c* integrally provided on both sides thereof, and rotatable rollers 6 are provided in the upper part outside said lateral plates 5*b*, 5*c*.

Said rollers 6 are fitted on a pair of guide rails 7, 8 fixed on lateral plates of a main body 151 of the copying machine, whereby the carriage units 1, 2 are rendered movable longitudinally in the copying machine P1 (laterally in FIG. 3). A pair of belts 9, of which both ends are connected to said lateral plates 5*b*, 5*c* of the first carriage unit 1, run over pulleys 13, 15 respectively fixed on shafts 11, 12. At an end of said shaft 11 there is connected a reversible motor 16, whereby said carriage unit 1 can be moved in a direction 17 or in an opposite direction 19. Similarly another pair of belts 9*a*, of which both ends are connected to the lateral plates 5*b*, 5*c* of the second carriage unit 2, run over similar pulleys 13*a*, 15*a* and are reversibly driven by another motor 16.

A shaft 21 of the first carriage unit 1, on which plural carriage rollers 20 are fixed, is rotatably supported at both ends by the lateral plates 5*b*, 5*c* of said frame 5, and a pair of support levers 22 are rotatably mounted on both ends of said shaft 21 extending from the lateral plates 5*b*, 5*c*. Plural carriage rollers 23 respectively paired with said carriage rollers 20 are fixed on a shaft 26 rotatably supported by the lateral plates 5*b*, 5*c*. Said shaft 26 passes, at both ends thereof, extended holes 27 formed in the lateral plates 5*b*, 5*c* and is fitted in elongated holes 22*a* formed on free ends of said support levers 22. Said shaft 26 is biased by springs 22*b* toward the shaft 21, namely in a direction for pressing the carriage rollers 23 toward the carriage rollers 20.

Figure 5:
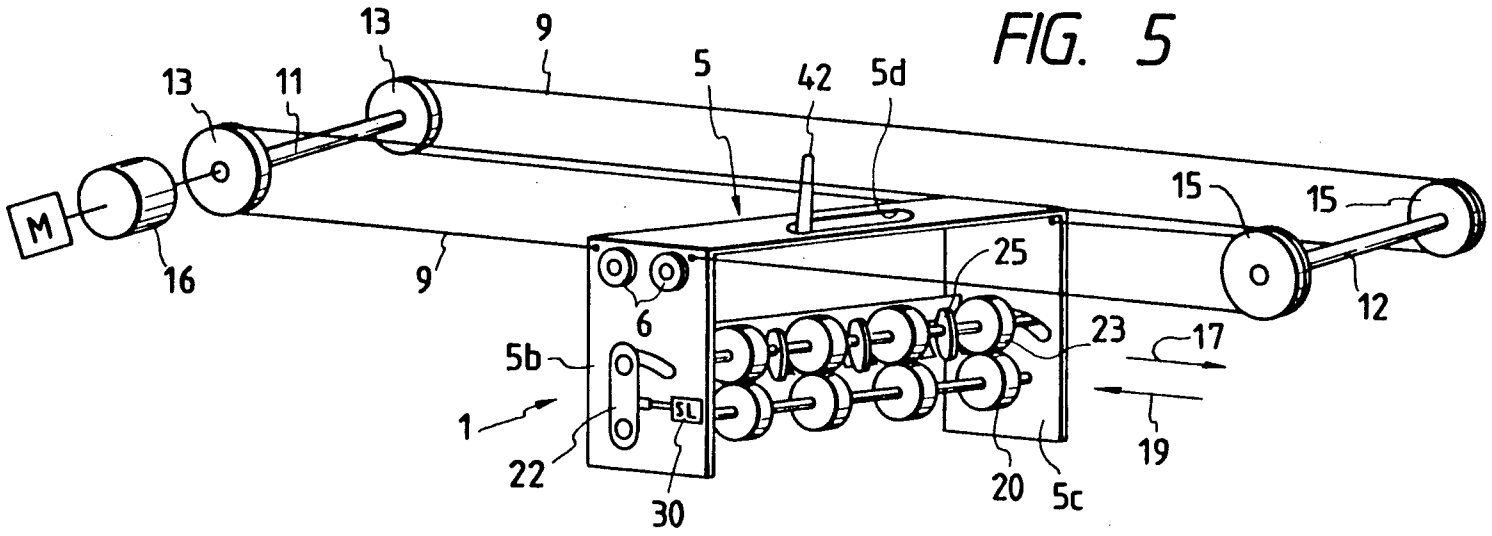
FIG. 5 is a perspective view of a driving unit for the first or second carriage.
Figure 6:
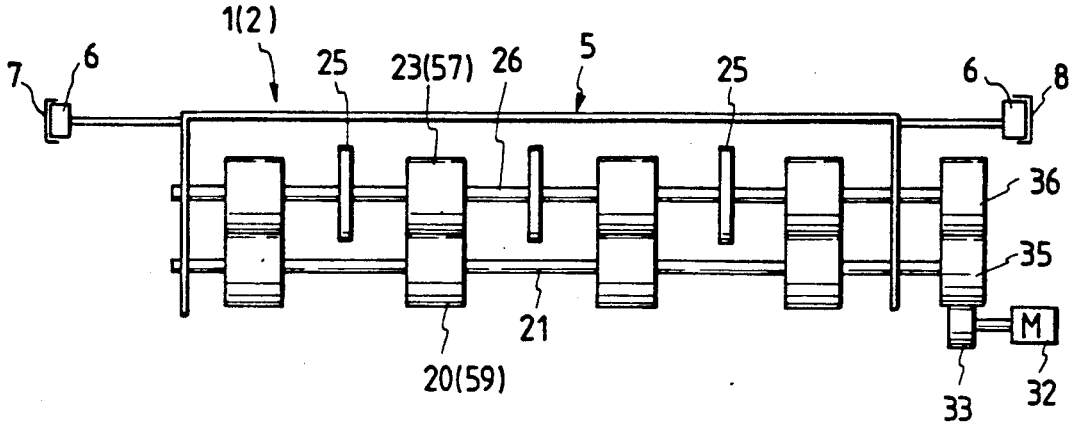
FIG. 6 is a front view of a carriage.
Figure 7:
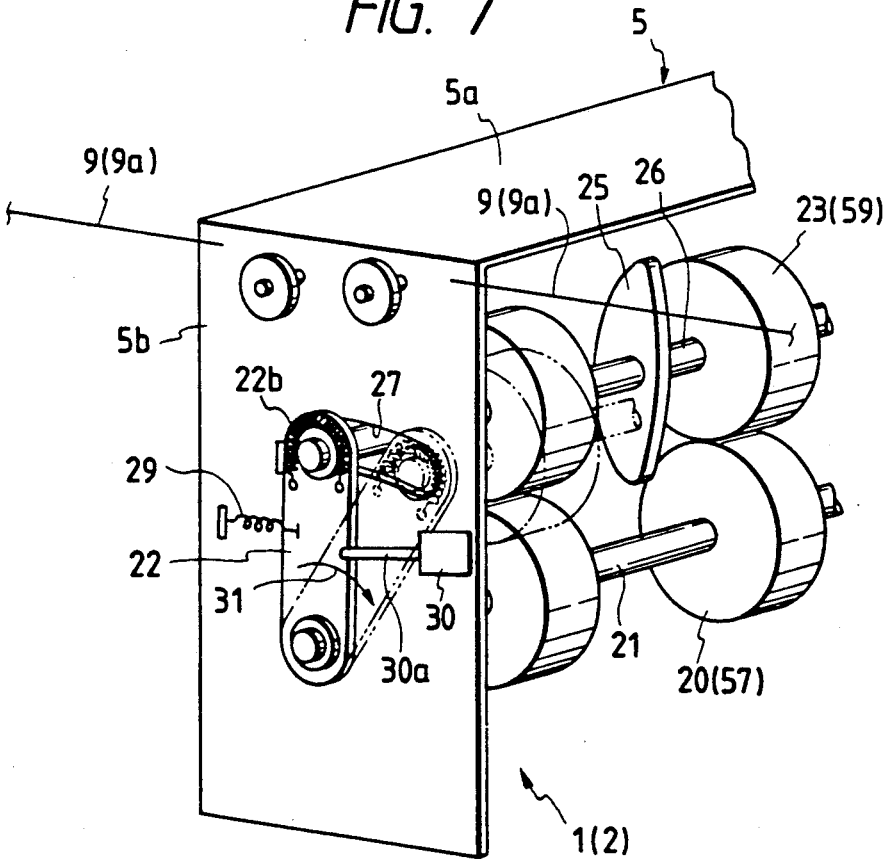
FIG. 7 is a perspective view of a deflecting mechanism for carriage rollers.

Said support lever 22 is biased anti-clockwise in FIG. 7 by a tension spring 29 of which both ends are fixed on the lateral plate 5*b* and the support lever 22, and is stopped in a position where the shaft 26 is in contact with the rear end (left end in FIG. 7) of the elongated hole 27. In this state, as shown in FIG. 5, the carriage rollers 23 are vertically contacting the carriage rollers 20.

An actuating lever 30*a* of a deflecting solenoid 30 is connected to a lateral edge of the support lever 22 opposite to said spring 29, and, when said deflecting solenoid 30 is energized at a timing to be explained later, the support lever 22 rotates clockwise about the shaft 21 as indicated by an arrow 31 and stops at a position where the shaft 26 is in contact with the front end (right-hand end in FIG. 7) of the elongated hole 27. In this state, as indicated by chain lines in FIG. 7, the carriage rollers 23 rotate about the carriage rollers 20 slightly in the sheet feeding direction (toward right in FIG. 7) while being maintained in contact with said rollers 20. Because of said rotation of the carriage rollers 23, the tangential direction of the contact positions between the carriage rollers 20, 23, or the discharge direction of the sheet S, becomes slightly downwards.

On the lateral plate 5*c* of the frame 5, there is fixed a motor 32 for driving the carriage rollers 20, 23. A gear 33 fixed on the shaft of said motor meshes with a gear 35 fixed on an end of the shaft 21, and said gear 35 meshes with a gear 36 fixed on an end of the shaft 26.

In a suitable position of the frame 5 there is mounted the base portion of an actuating member 42, of which free end extends upwards from said frame 5. Said actuating member 42 is detected by a sensor to be explained later, at the movement of the carriage unit 1. In front of and behind the carriage rollers 20, 23 of the carriage unit 1, there are provided carriage roller sensors 43 for detecting the sheet S.

The second carriage unit 2 is also provided with similar carriage rollers 57, 59 which are driven by a motor 16, and carriage roller sensors 60 for detecting the sheet S are provided in front of and behind said carriage rollers 57, 59.

Figure 4:
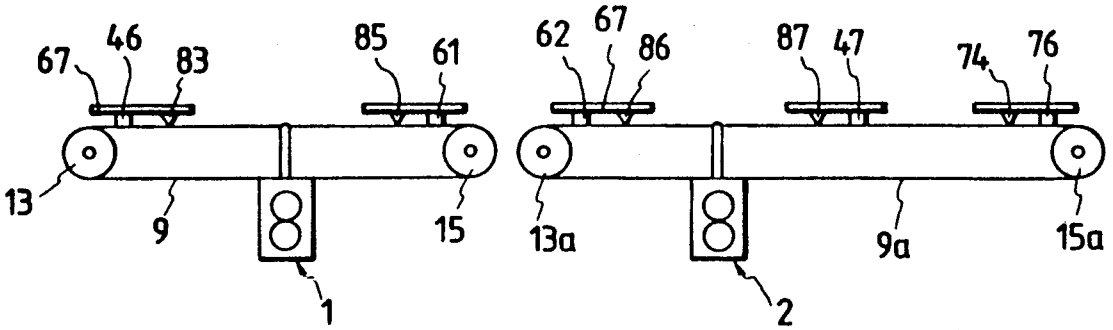
FIG. 4 is a lateral view showing the positional relationship of first and second carriage units, and microswitches and sensors for controlling the positions thereof.

As shown in FIG. 4, the carriage units 1, 2 and the belts 9, 9*a* for driving said units are serially positioned. In a range from the pulley 13 to the pulley 15*a* at the downstream side, there are provided microswitches 46, 61 for stopping the carriage unit 1 and microswitches 62, 47 for stopping the carriage unit 2, all mounted on a support plate 67. These microswitches are actuated by a notch 5*d* formed in the upper plate 5*a* of the frame 5 (cf. FIG. 5). Also at the downstream side of said pulley 13, there are provided sensors 83, 85 for detecting the actuating member 42 of the carriage unit 1, and sensors 86, 87 for detecting the actuating member 63 of the carriage unit 2, all mounted on said support plate 67.

In the following there will be explained the function of the above-explained structure in case of forming n (>1) half-sized two-side copies from an original, with reference to FIGS. 8 to 12. In the apparatus shown in FIG. 3, the operations of one-side copying on a sheet S and transportation thereof into the switchback path 186 are same as those in the conventional C-shaped path shown in FIG. 1.

Figure 8:
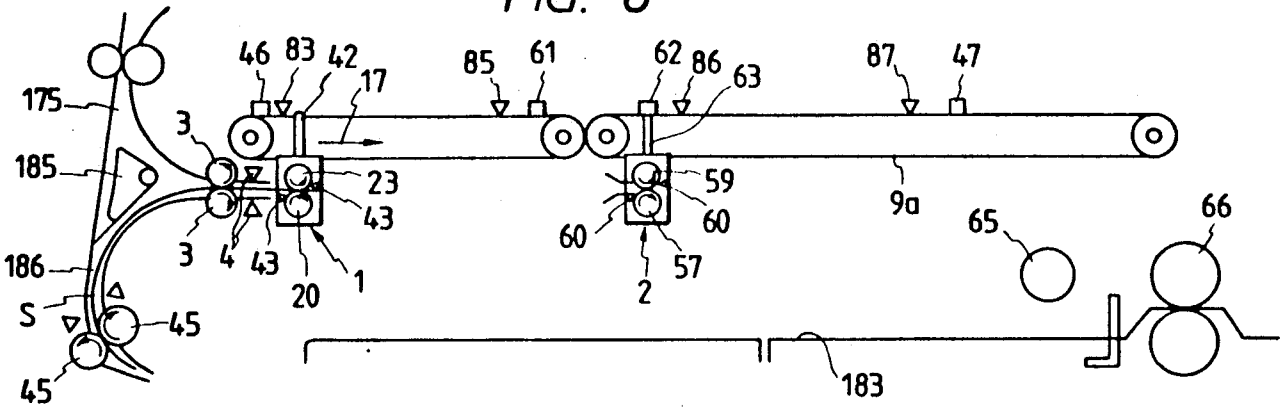
FIGS. 8 to 12 are views showing the functions for stacking half-sized sheets on the intermediate tray.

At first, as shown in FIG. 8, the first carriage unit 1 is in a position actuating the micro-switch 46. The switchback rollers 45 and the discharge rollers 3 are rotated as indicated by arrows, whereby the sheet S is advanced toward the carriage unit 1. When the intermediate tray discharge sensor 4 detects the front end of the sheet S, the carriage rollers 20, 23 of the carriage unit 1 are respectively rotated by the motor 32 as indicated by arrows to clamp the front end of the sheet S. In this state the carriage rollers 20, 23 rotate simultaneously with the switch-back rollers 45.

When the carriage roller sensor 43 in the first carriage unit 1 detects the clamping of the leading end of the sheet S in the nip between the carriage rollers 20, 23, the motor 32 is deactivated to stop the carriage rollers 20, 23. Then the motor 16 shown in FIG. 5 is activated, whereby the first carriage unit 1 starts to move in a direction 17 shown in FIG. 8, with a speed same as the peripheral speed of the switchback rollers 45. In this state, the second carriage unit 2 is stopped in a position actuating the microswitch 62.

Figure 9:
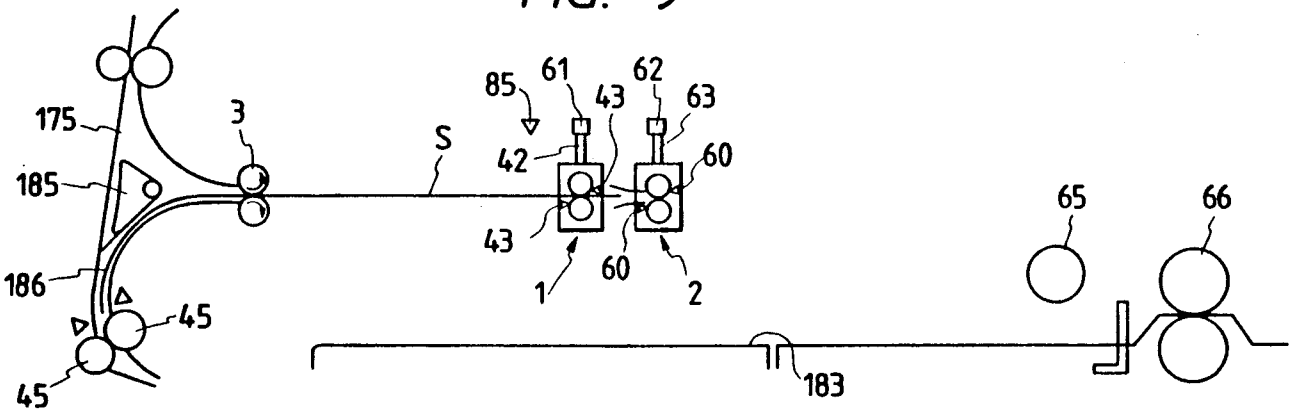

When the sensor 85 detects the notch 5*d* of the carriage unit 1 moving in the direction 17, the motor 16 for driving said carriage unit 1 is decelerated, and, when the actuating member 42 is detected by the microswitch 61, an unrepresented brake is applied to said motor 16 whereby the carriage unit 1 stops as shown in FIG. 9. In this state the carriage rollers 20, 23 of the first carriage unit 1 and those 57, 59 of the second carriage unit 2 start to rotate, thereby inserting the sheet S into the carriage unit 2.

Figure 10:
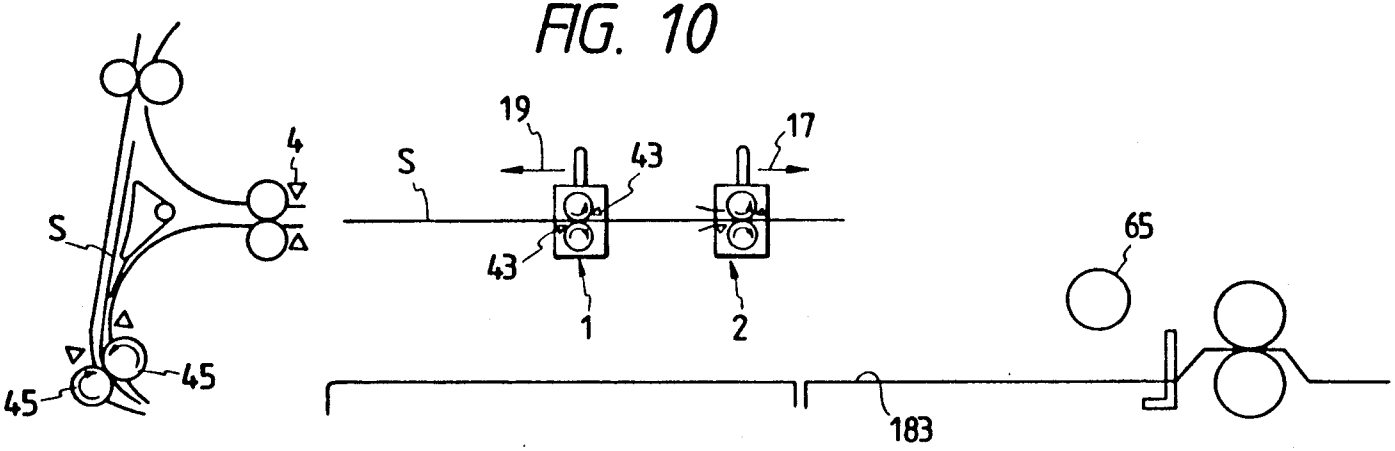

When the sensor 60 detects that the front end of the sheet S is pinched in the nip of the carriage rollers 57, 59 of the carriage unit 2, the carriage unit 1 moves in the direction 19 with a speed v as shown in FIG. 10, while the carriage unit 2 moves in the direction 17 with a speed V. The sheet S supported by the carriage unit 2 also moves in the direction 17 with the speed V. Said speed V is moving speed or process speed of the sheet S.

During the above-mentioned movement of the carriage unit 2, the carriage rollers 57, 59 of the carriage unit 2 are stopped, pinching the sheet S therebetween, but the carriage rollers 20, 23 of the carriage unit 1 are rotated with a peripheral speed (V +v). Even if the rotating speed of the carriage rollers 20, 23 is smaller than the moving speed of the sheet S, the damage in the sheet S can be prevented by the function of a one-way clutch (not shown) provided in the gear 36 integral with the carriage rollers 20 of the carriage unit 1.

Figure 11:
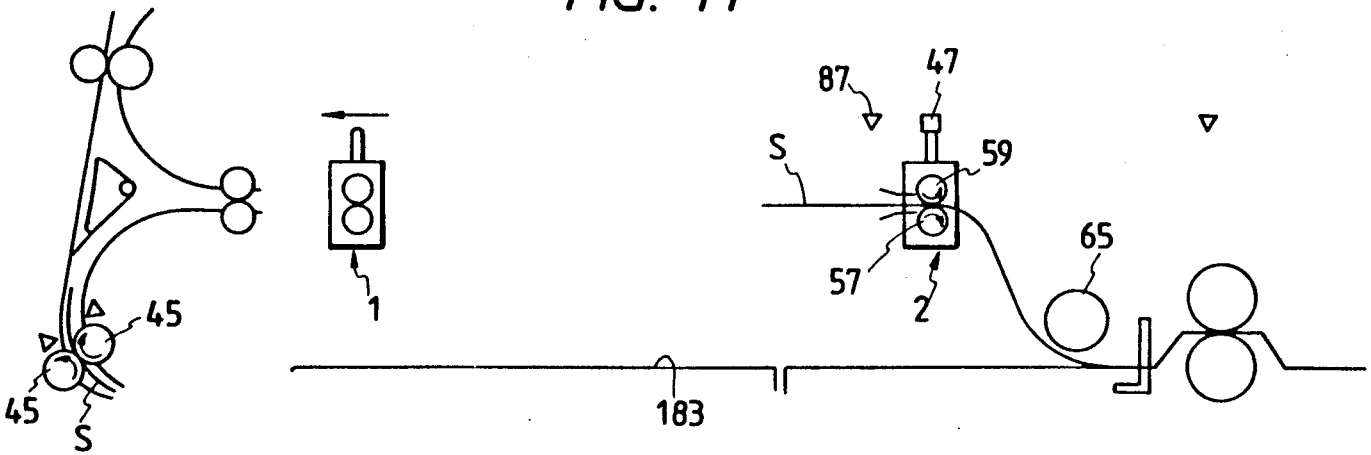
Figure 12:
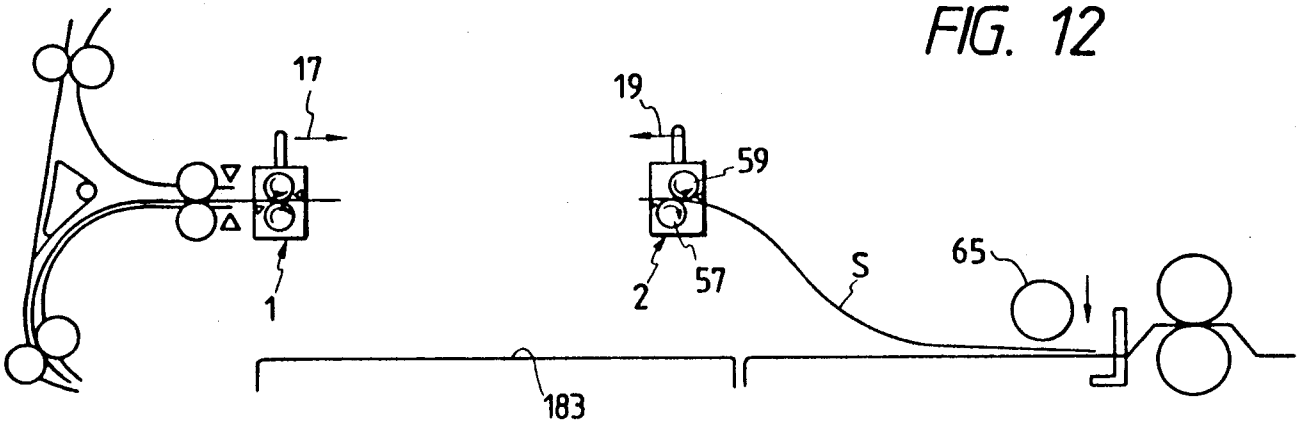
Figure 13:
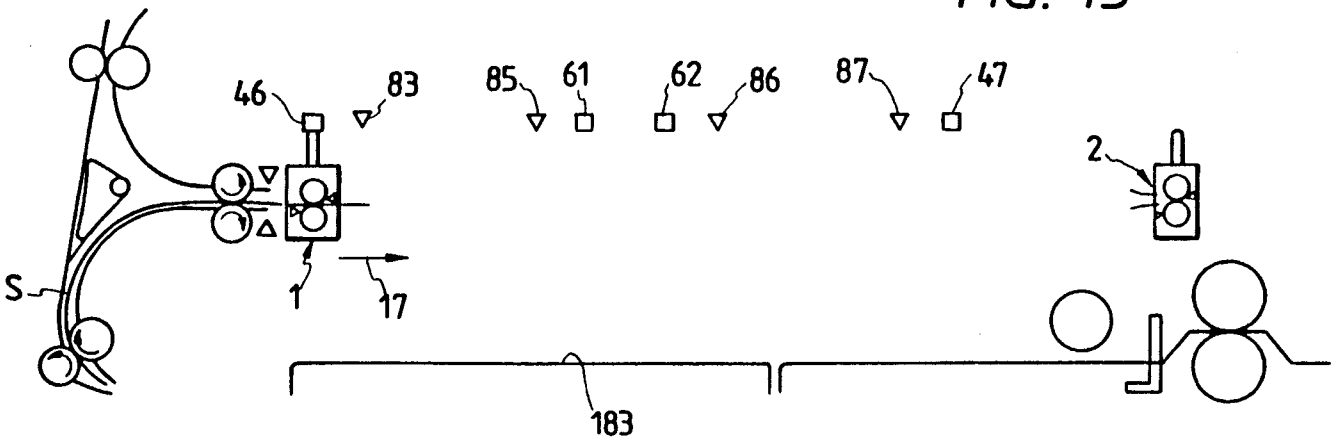
FIGS. 13 to 17 are views showing the functions for stacking large-sized sheets on the intermediate tray.

When the sensor 87 detects the notch 5*d* of the carriage unit 2 as shown in FIG. 11, in the course of movement of the carriage unit 2, a brake (not shown) is applied to the carriage unit 2, which is then stopped when the microswitch 47 is actuated by the actuating member 63. Also the deflecting solenoid 30 of the carriage unit 2 shown in FIG. 7 is energized whereby the carriage rollers 57 are shifted toward the discharge side as shown in FIG. 11 to obtain a slightly downward direction of discharge. The carriage rollers 57, 59 are rotated in the direction of arrow to discharge the sheet S. During said sheet discharge, the carriage unit 2 returns in the direction 19 with the speed v, as shown in FIG. 12.

In this state, since the second carriage unit 2 moves with a speed v while the sheet S is discharged with a speed V, the carriage rollers 57, 59 of the second carriage unit 2 rotate with a peripheral speed (V+v). While the carriage unit 2 executes the discharge of a sheet S, the carriage unit 1 moves in the direction 17, fetching a next sheet S. Upon completion of the sheet discharge onto the intermediate tray 183, solenoid (not shown) is energized to lower a feed roller 65 until it comes into contact with the sheet S. Then the deflecting solenoid of the carriage unit 2 is deactivated, whereby the carriage rollers 59 return to the original position.

Subsequently the first and second carriage units 1, 2 return to the state shown in FIG. 9 to effect again the transfer of sheet S to the second carriage unit, and the feed roller 65 is lifted from the sheet S on the intermediate tray (sheet storage means) 183 whereby the sheets S are stacked on said intermediate tray 183. Upon completion of said stacking, a lateral movement motor (not shown) is activated to align the stacked sheets in the lateral direction. The re-feeding of sheets from the intermediate tray 183 is conducted in the same manner as in the conventional apparatus shown in FIG. 1. The feed roller 65 is lowered by the solenoid (not shown) onto the stacked sheets to advance a sheet. Then a separating roller 66 at the downstream side separates a sheet S. The skewed feeding of the sheet S is corrected by forming loops between the second registration rollers 70 and the separating roller 66, and between the first registration rollers 69 and the second registration rollers 70.

In the following there will be explained the operation of forming n (>1) copies on large-sized sheets S from an original, with reference to FIGS. 13 to 17.

In response to a sheet size signal, the second carriage unit 2 is retracted from the home position where the microswitch 62 is actuated. The first carriage unit 1 pinches the front end of the sheet S at a position actuating the microswitch 46 as in the half-sized copying operation. Then the rotation of the carriage rollers 20, 23 is stopped, and the carriage unit 1 moves in the direction 17 in this state.

Figure 14:
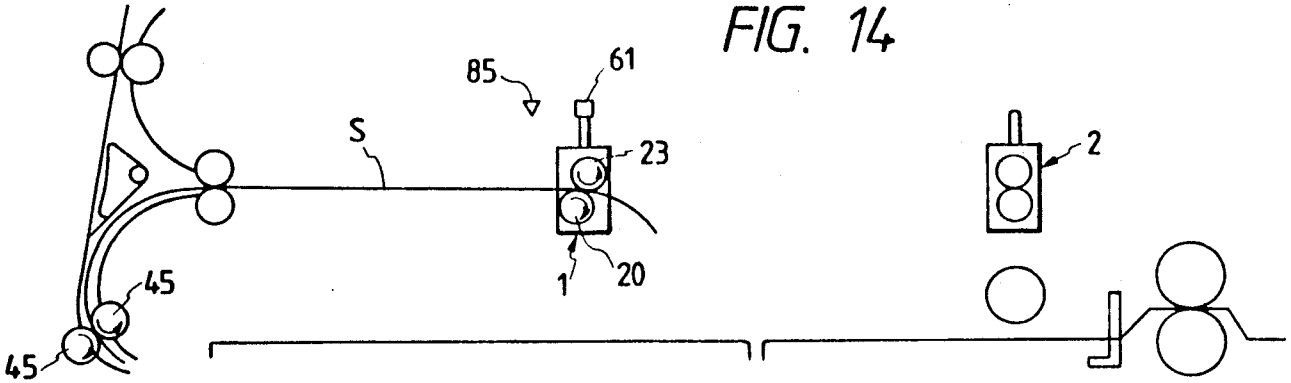
Figure 15:
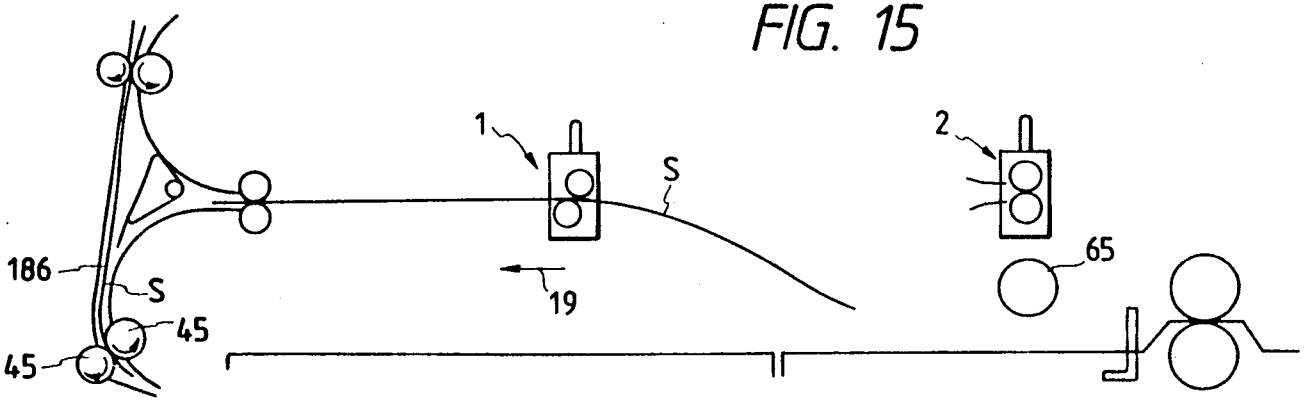
Figure 16:
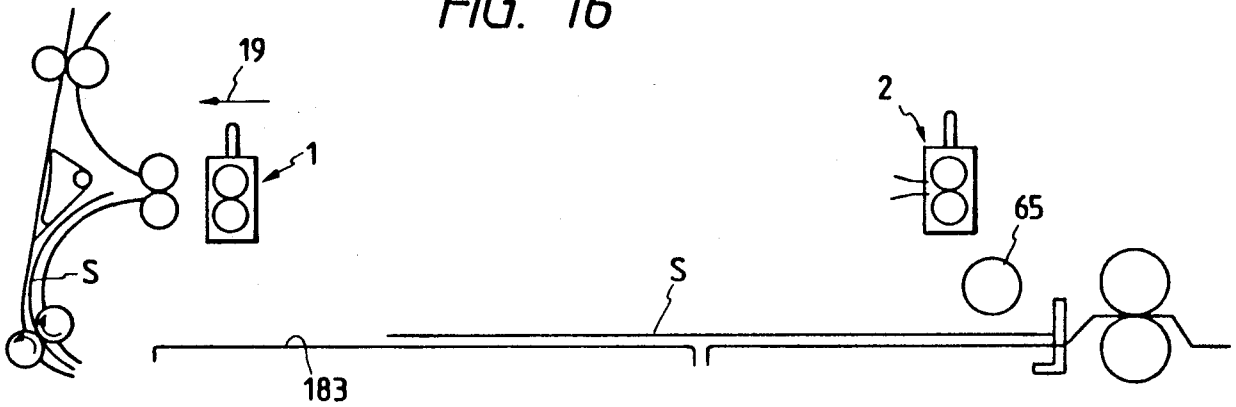
Figure 17:
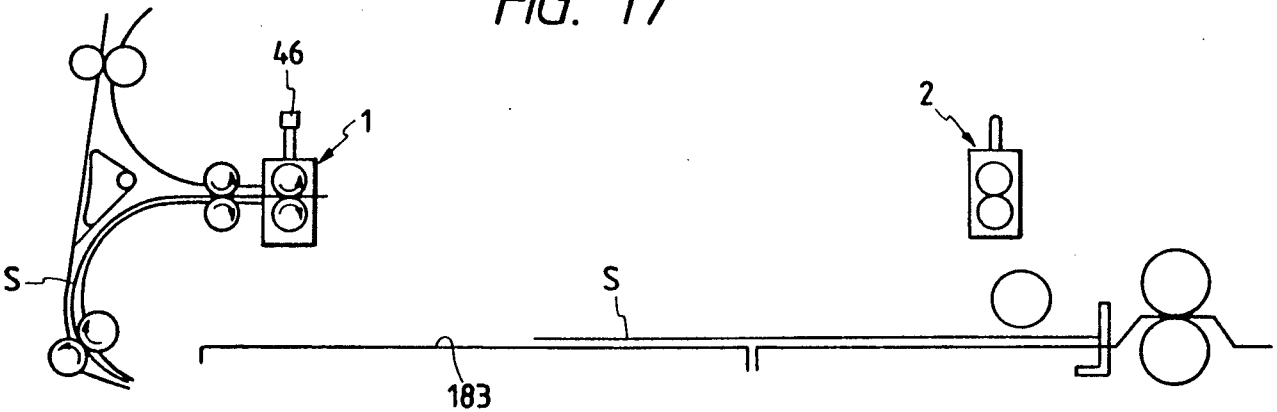

The carriage unit 1 is then stopped at a position actuating the microswitch 61 as shown in FIG. 14, whereupon the deflecting solenoid 30 shown in FIG. 7 is energized to define a downward discharge path by the carriage rollers 20, 23. Said carriage rollers 20, 23 are rotated in this state, whereby the sheet S is discharged onto the intermediate tray 183. While the sheet S is discharged, the carriage unit 1 moves in the direction 19.

When the carriage unit 1 moves with a speed v, the carriage rollers 20, 23 rotates with a peripheral speed (V+v) in order to transport the sheet S with a speed V by the carriage unit 1. At the same time, a next sheet S enters the switchback path 186 and is pinched between the switchback rollers 45. When the carriage unit 1 returns to the home position and actuates the microswitch 46, the next sheet S is pinched between the carriage rollers 20, 23 of the carriage unit 1.

The above-explained transportation and discharge of large-sized sheet enables stable transportation onto the intermediate tray 183, since the pushed distance of the sheet S is drastically reduced in comparison with that in the conventional structure. Also the efficiency of the sheet transporting apparatus is not deteriorated since the carriage unit 1 returns toward the home position during the transportation of the sheet S.

Figure 18:
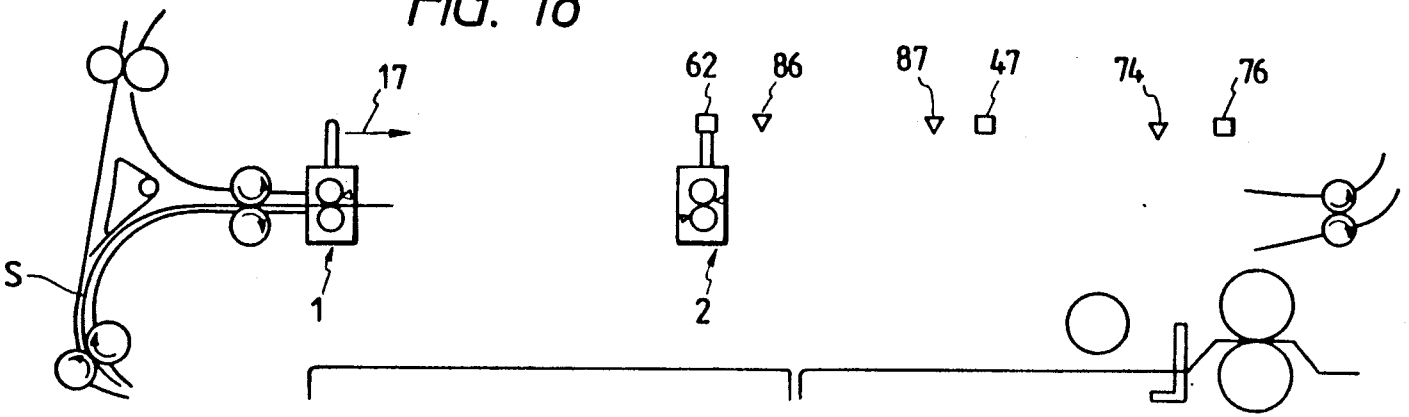
FIGS. 18 to 21 are views showing the functions in case of single copying.
Figure 19:
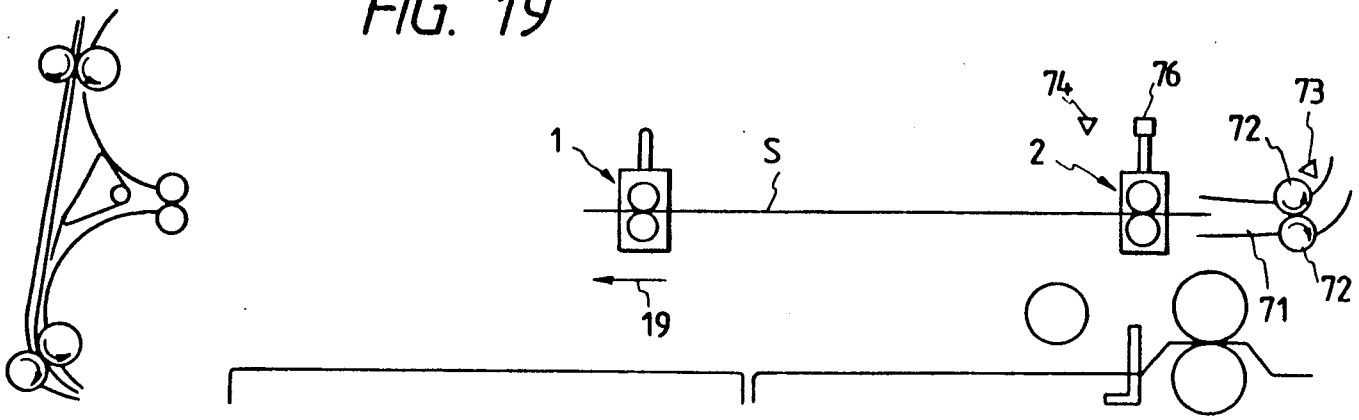
Figure 20:
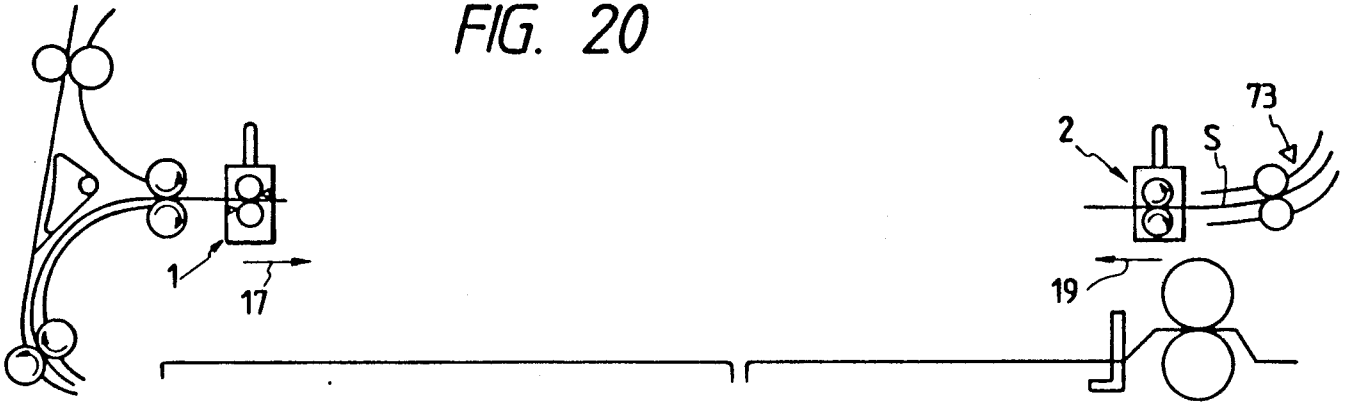

In the following there will be explained the operation of forming a two-side copy from a two-side original or from two one-side originals, either on a half-sized sheet or a large-sized sheet, with reference to FIGS. 18 to 20.

Figure 29:
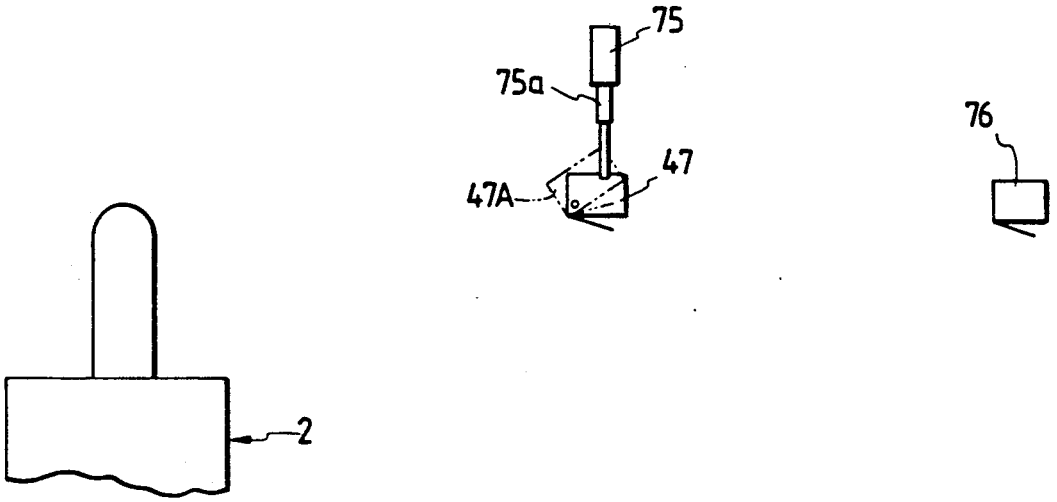
FIG. 29 is a lateral view of a microswitch 47.

The operation is same as in the two-side half-sized copying explained above, until the sheet is guided through the switchback path 186 and is pinched by the first and second carriage units 1, 2. The microswitch 47 for stopping the carriage unit 2 is connected, as shown in FIG. 29, to the plunger 75*a* of a solenoid 75, whereby said microswitch 47 is rotated to a chain-lined position 47*a* when said solenoid 75 is energized. The second carriage unit 2 moves to a position actuating the microswitch 76, and at the same time the carriage unit 1 moves in a direction 19 shown in FIG. 19.

Then the carriage rollers 57, 59 of the carriage unit 2 stopped at the position of said microswitch 76 are rotated to advance the sheet S into transport rollers 72 provided in a through-path 71. When a sensor 73 detects the frond end of the sheet S, the carriage unit 2 returns in the direction 19 as shown in FIG. 20, and the first carriage unit 1 moves in a direction 17, clamping the sheet S therein. When the carriage units 1, 2 reach the transfer position corresponding to the microswitches 61, 62, the sheet is transferred from the first unit 1 to the second unit 2.

The sheet S from the through-path 71 is transported with the formation of a loop between the transport rollers 72 and the first registration rollers 69. While the sheet S is temporarily freed in case of stacking onto the intermediate tray 183, the sheet S is always supported in case of passing through the through-path 71, so that the formation of a loop is sufficient for skewed feeding correction.

Figure 21:
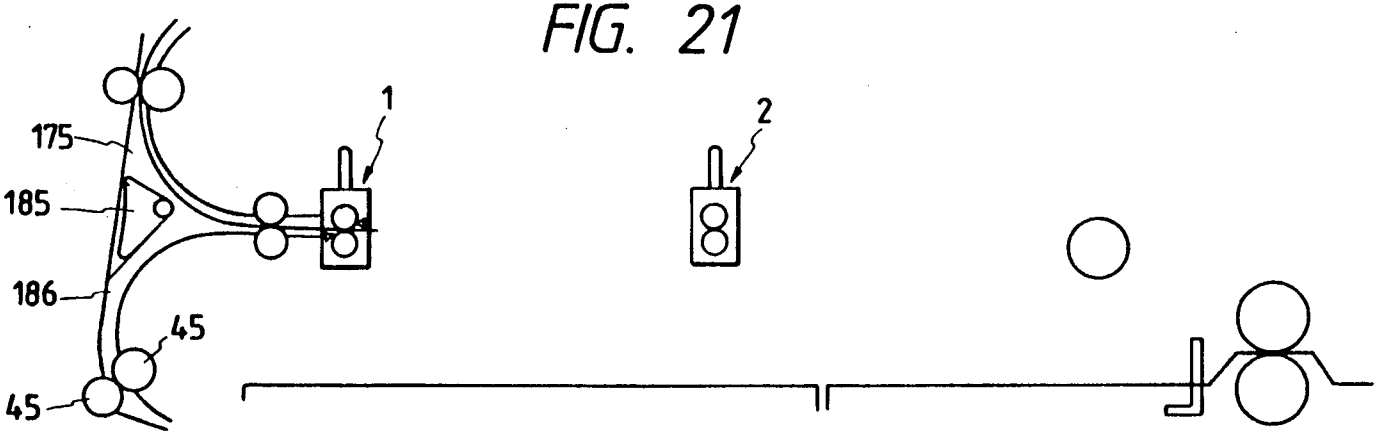

In case of overlay mode, the sheet S of any size does not pass through the switchback path 186 but is directly fetched by the carriage unit 1 by means of the flapper 185, as shown in FIG. 21.

Figures 22, 22A:
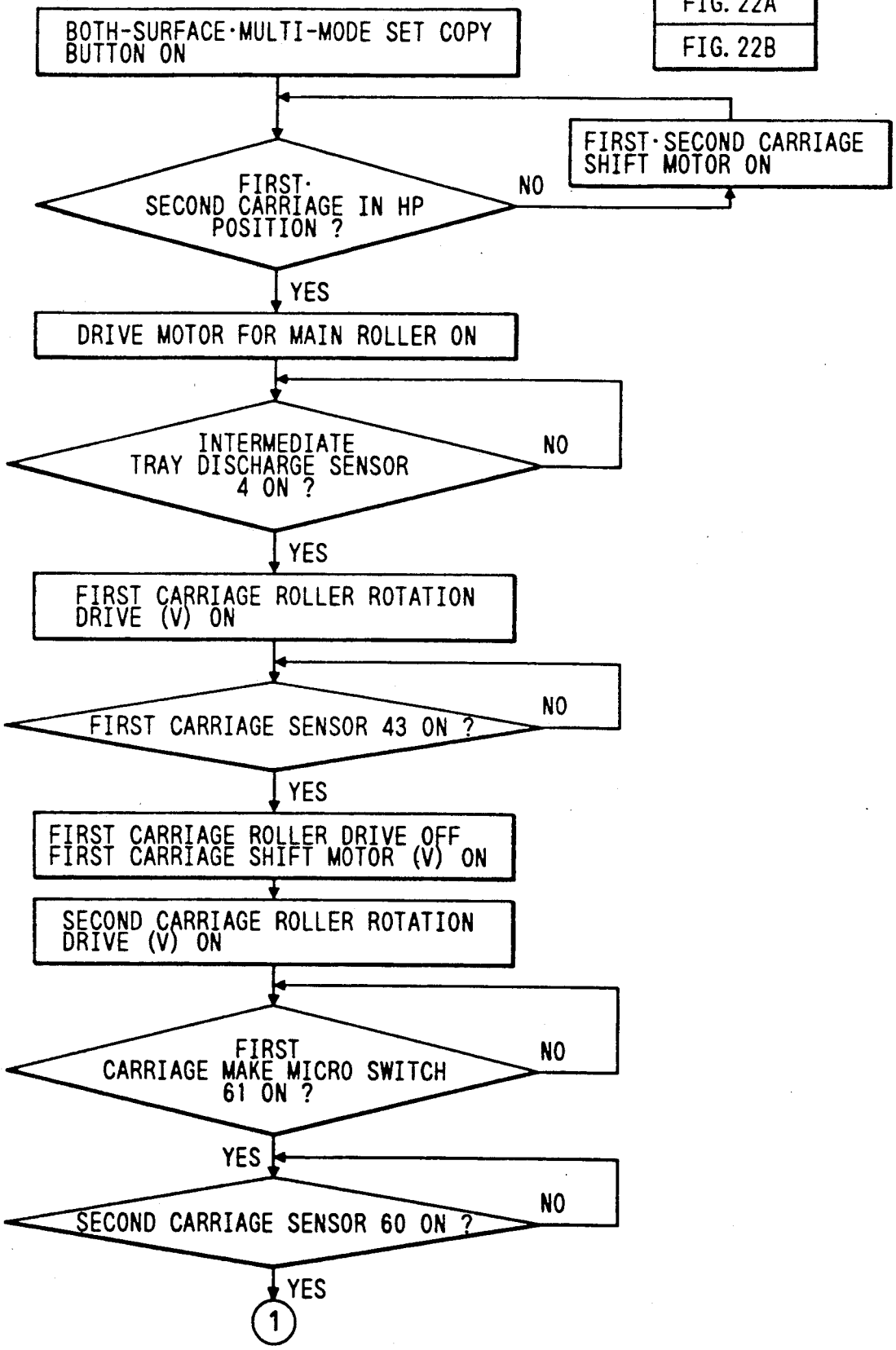
FIGS. 22, 22A, 22B, 23, 23A, 23B and 24 are flow charts of sheet transport/discharge operation.
Figure 22B:
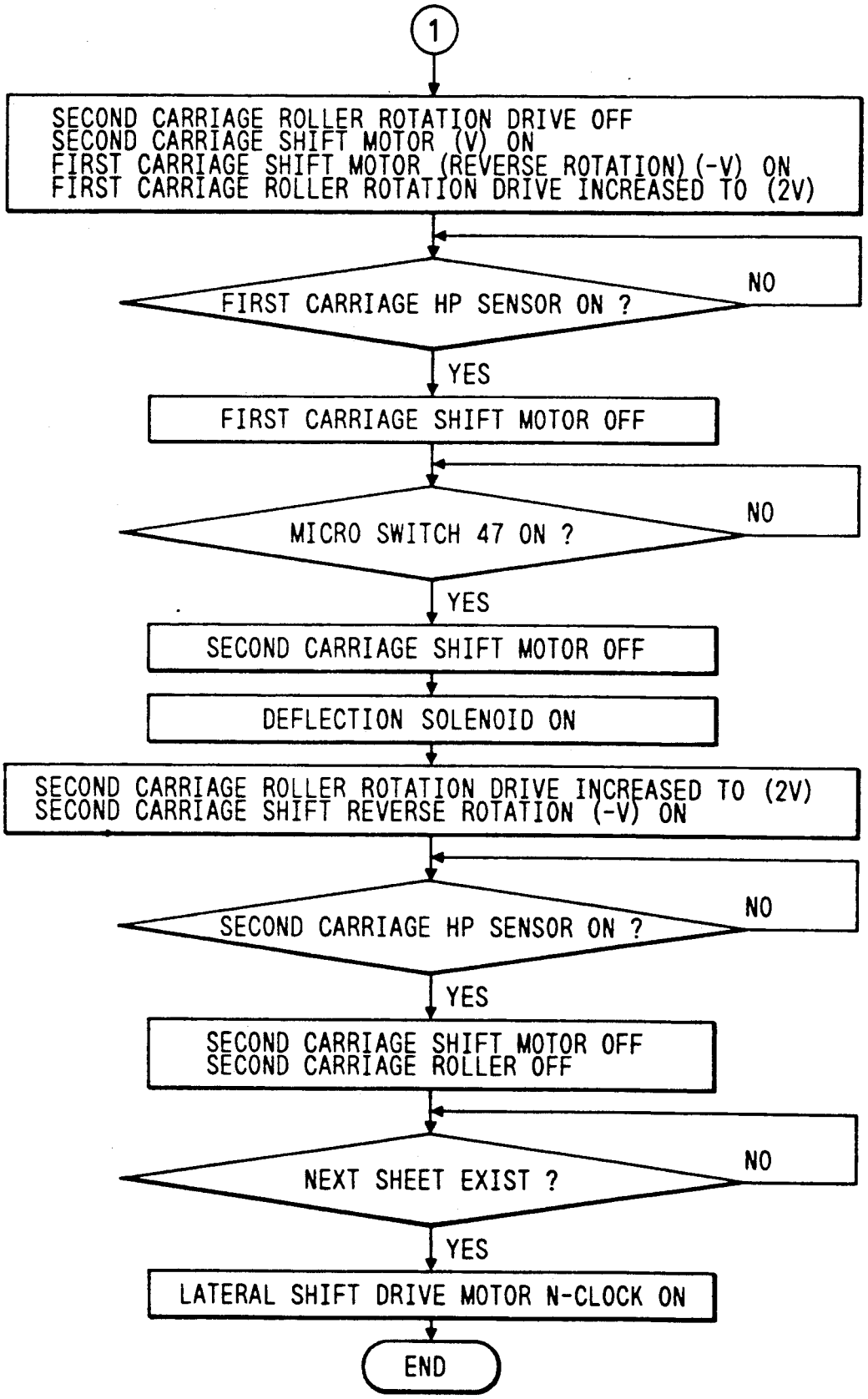
Figures 23, 23A:
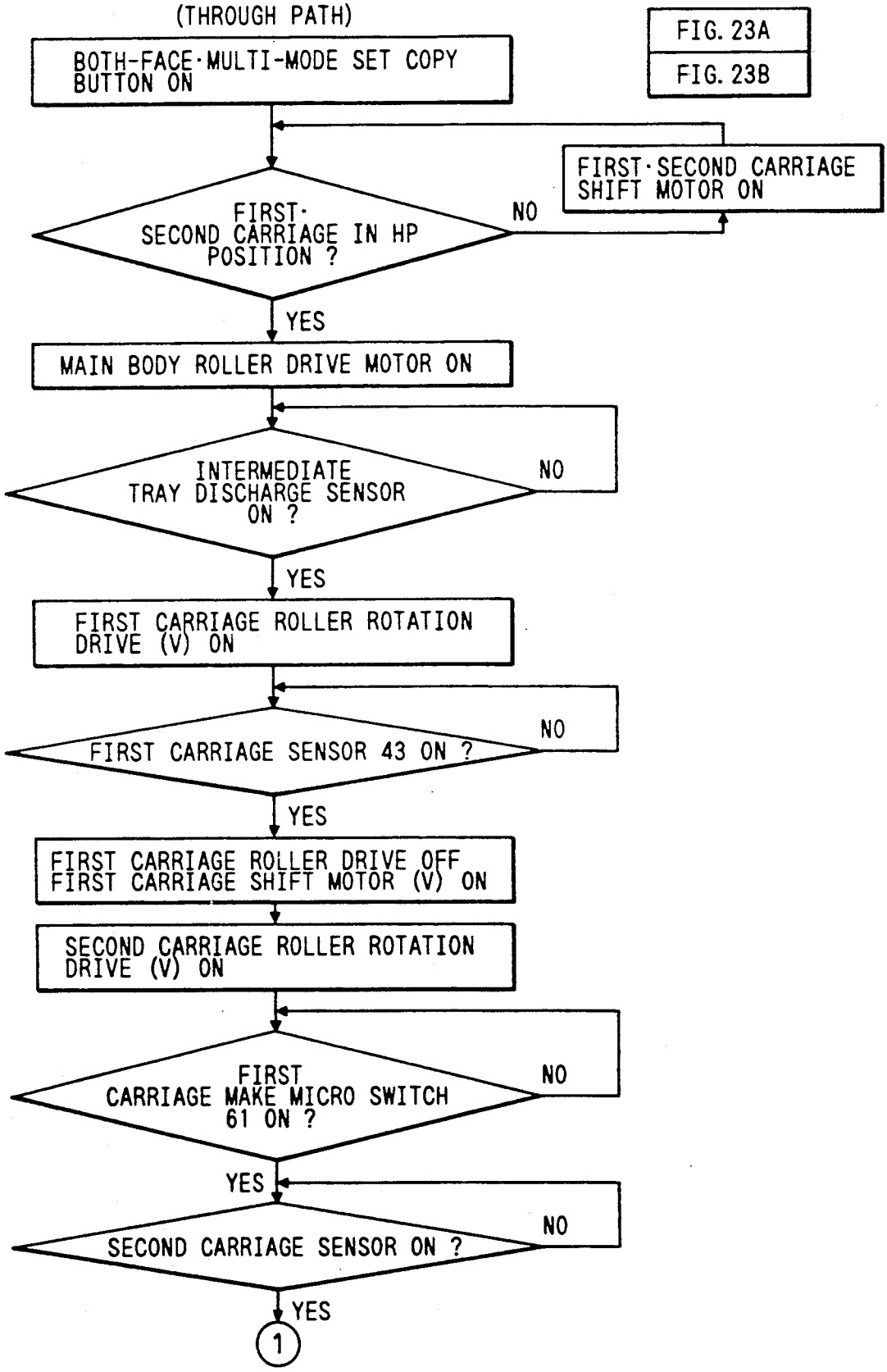
Figure 23B:
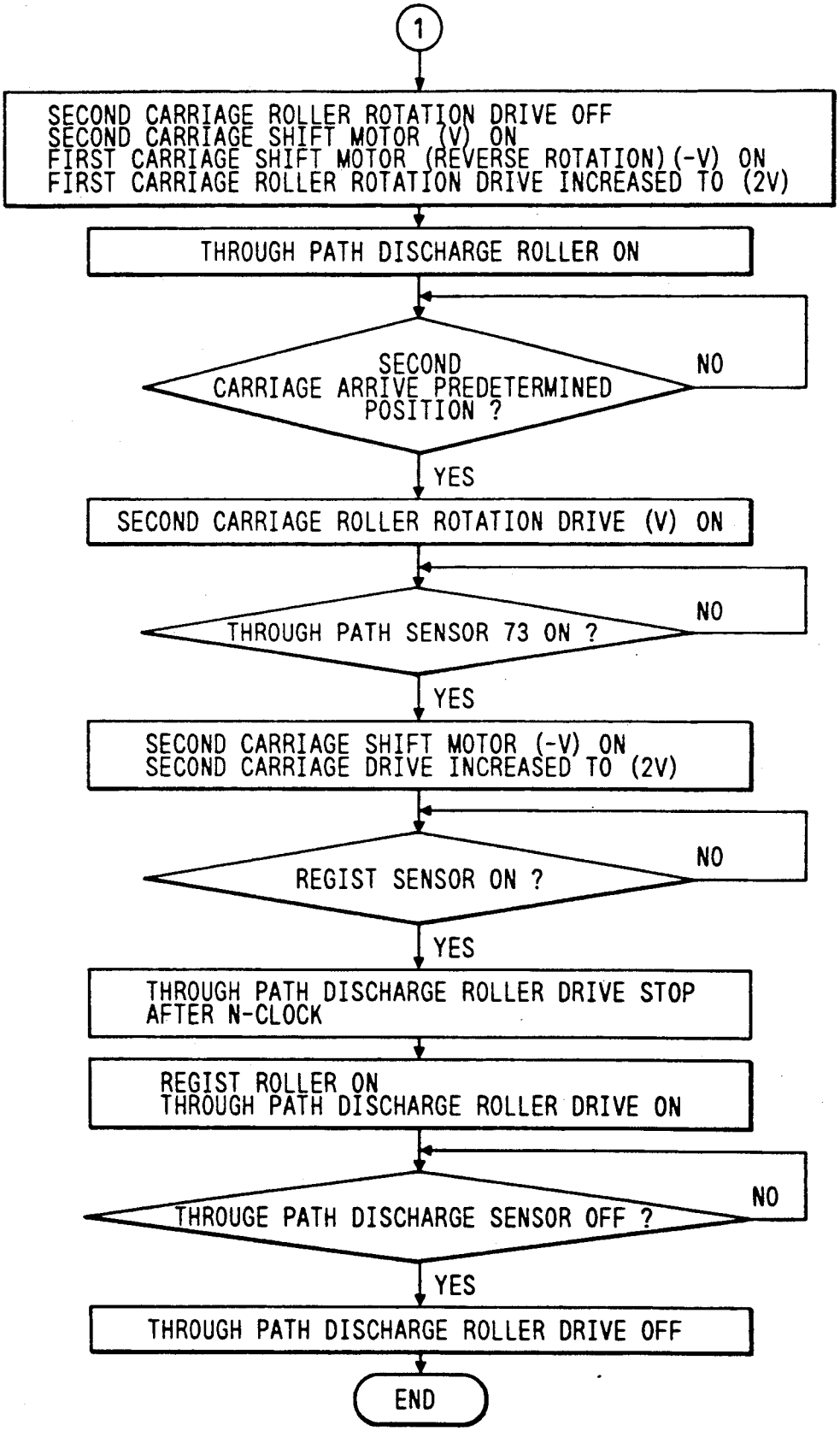
Figure 24:
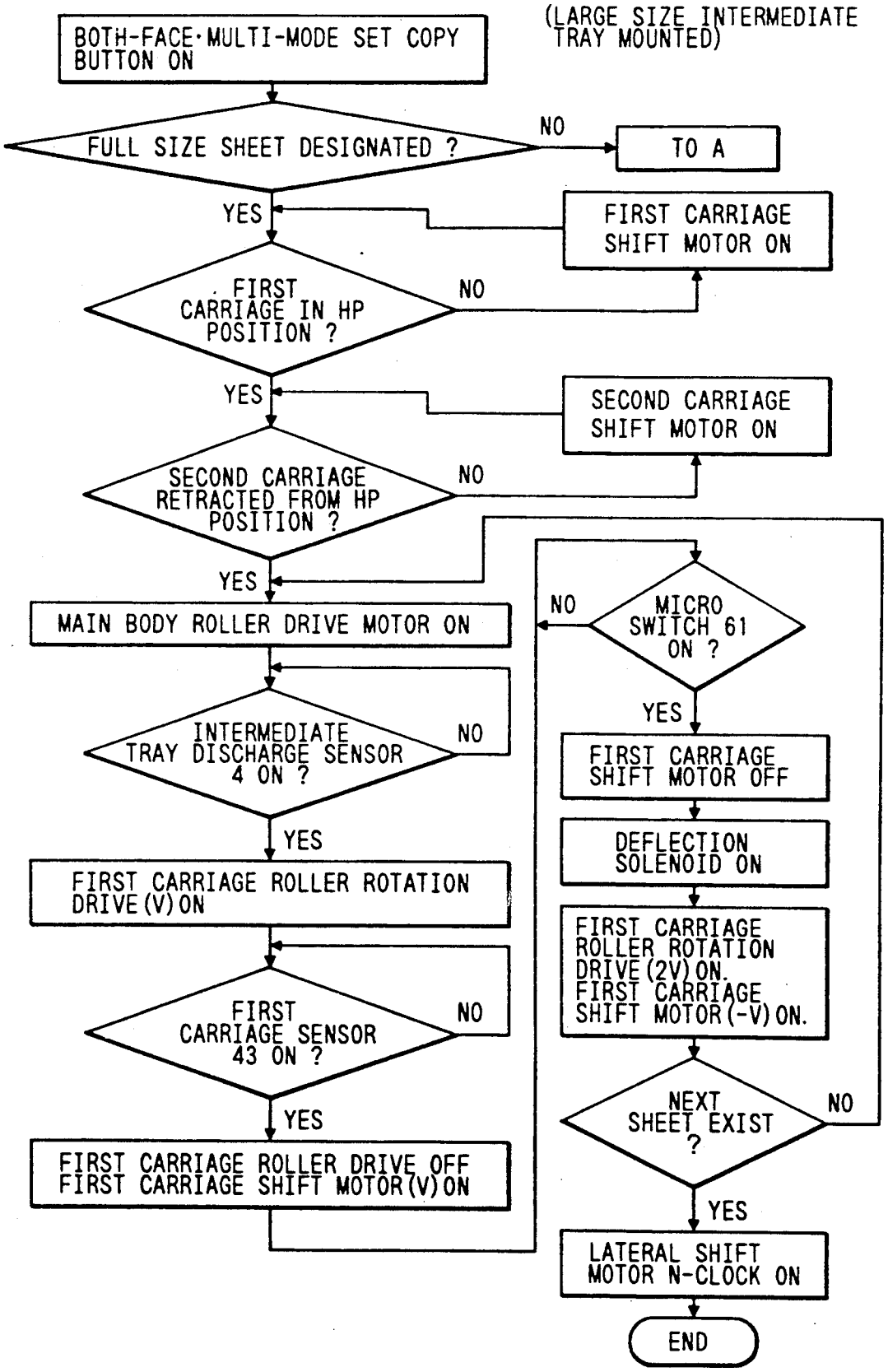

The above-explained sheet transport/discharge operations by the carriage units 1, 2 are summarized in flow charts shown in FIGS. 22 to 24, wherein HP indicates the home position, which means, for the first carriage unit 1, a position actuating the microswitch 46, or, for the second carriage unit 2, a position actuating the microswitch 62.

FIG. 22 is a flow chart of the operation for stacking half-sized sheets S onto the intermediate tray 183, in case of forming n (>1) two-side copies from an original. FIG. 23 is a flow chart in case the sheets S pass through the through-path, and FIG. 24 is a flow chart of the operation for stacking large-sized sheets S onto the intermediate tray 183 in case of forming n (>1) two-side copies from an original.

Figure 30:
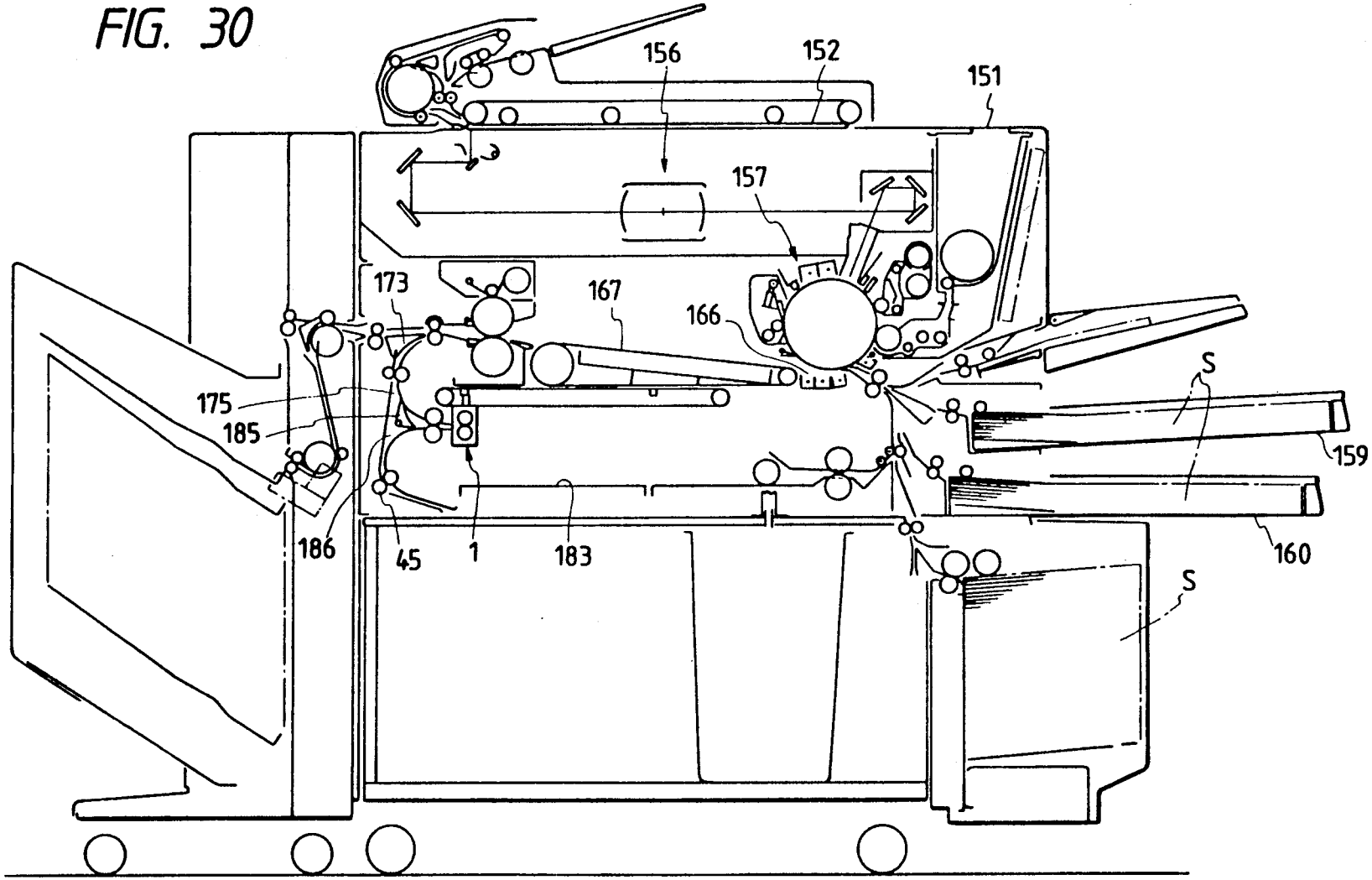
FIGS. 30 and 31 are longitudinal cross-sectional views of image forming apparatus employing variations of the present invention.
Figure 31:
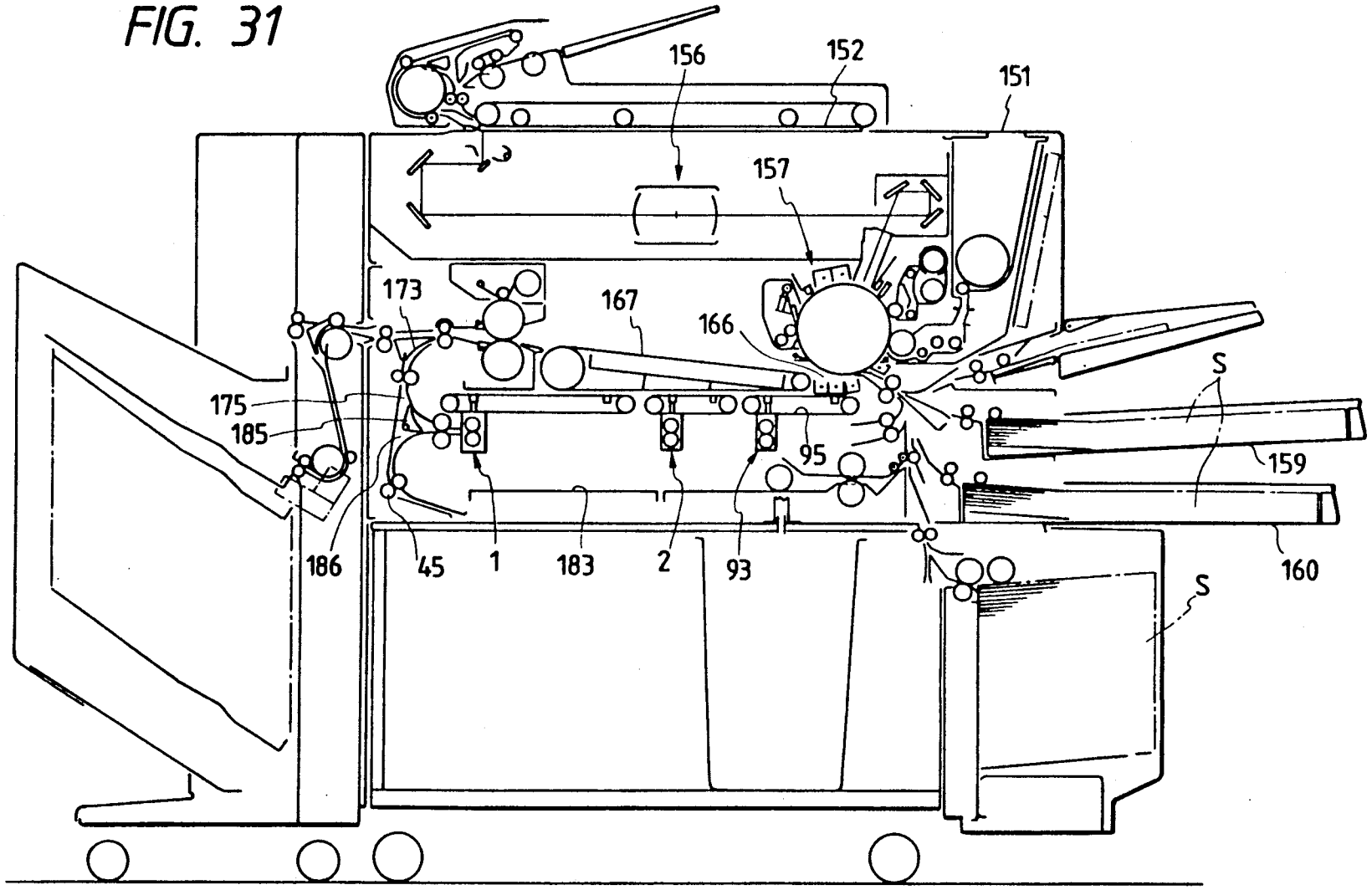

Through the above-explained embodiment employs two carriage units, there may also be employed only one carriage unit for transporting and discharging the sheets S as shown in FIG. 30. It is furthermore possible to employ more than two carriage units for example, as shown in FIG. 31, by adding a third carriage unit 93 at the downstream side, to the first and second carriage units 1, 2 shown in FIG. 3. Similar to the carriage units 1, 2, the carriage 93 is capable of reciprocating motion by a belt 95 supported by pulleys, and effects the transportation and discharge of the sheet S transferred from the carriage unit 2.

Figure 28:
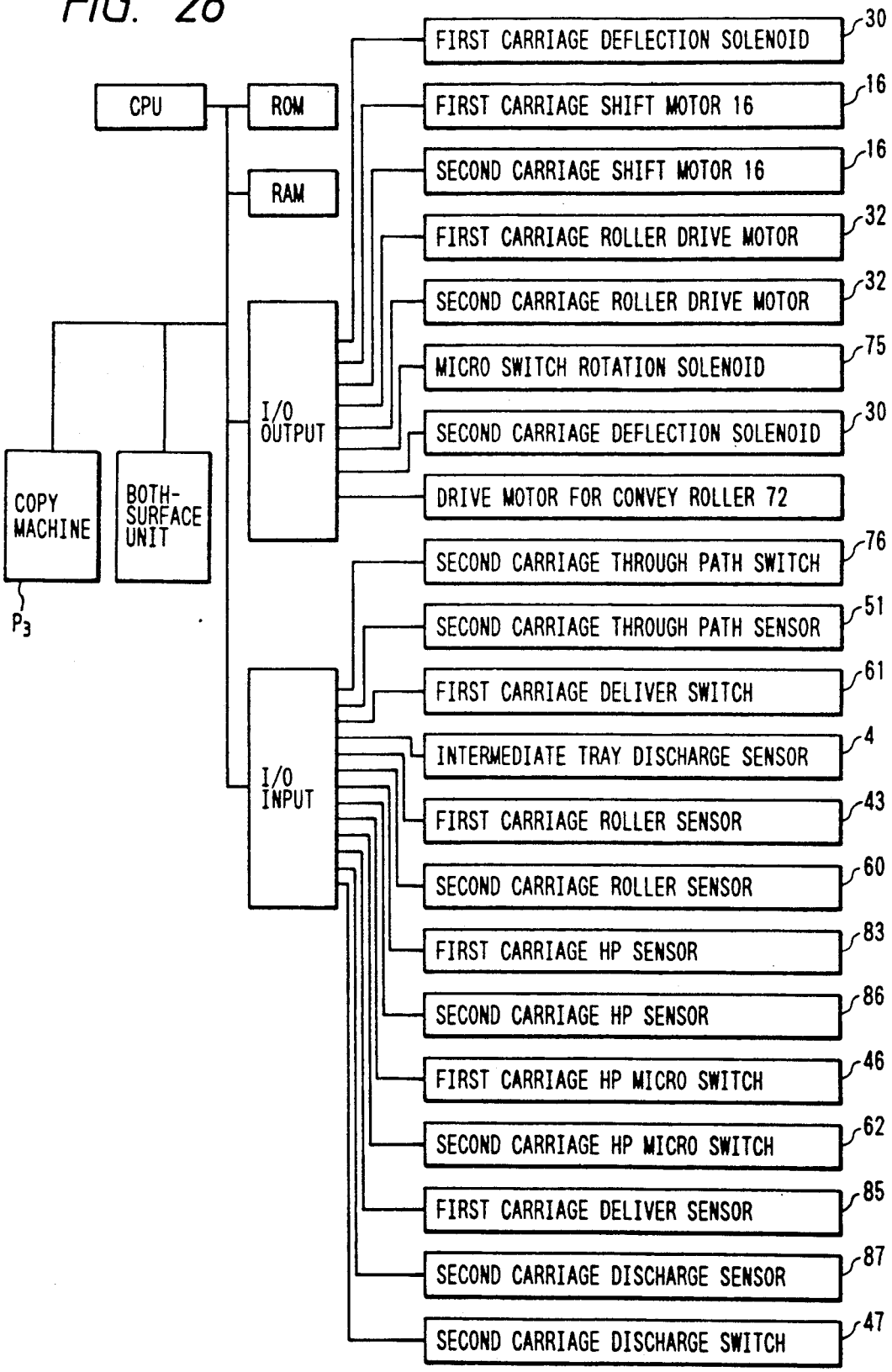
FIG. 28 is a block diagram of sheet transport/discharge control of the present invention.

FIG. 28 is a block diagram of the control system for sheet transportation and discharge, wherein the signals entered into the input portion of an I/O port are released, through a CPU, from an output portion of the I/O port, thereby controlling the transportation and discharge of the sheets S by the carriage units 1, 2.

Figure 25:
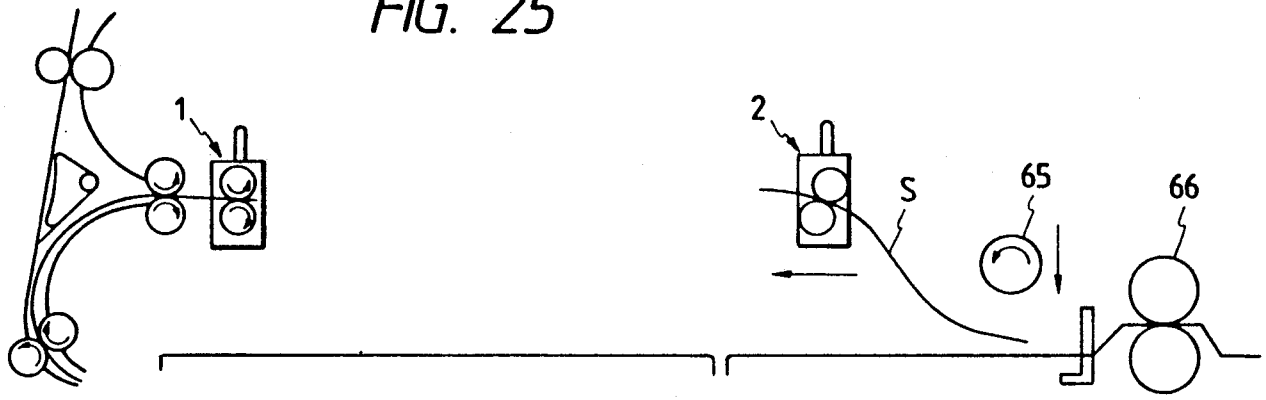
FIGS. 25 and 26 are views showing said operation in a second embodiment.
Figure 26:
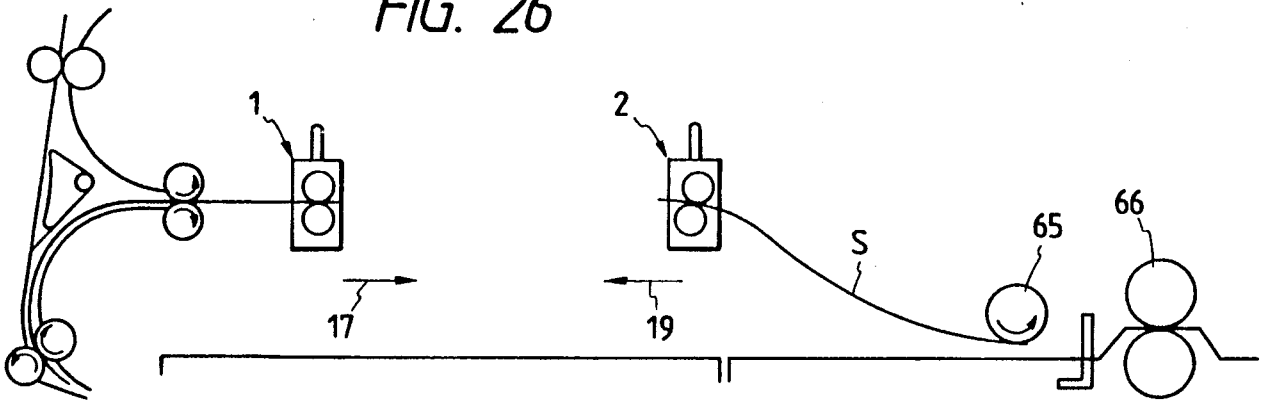
Figure 27:
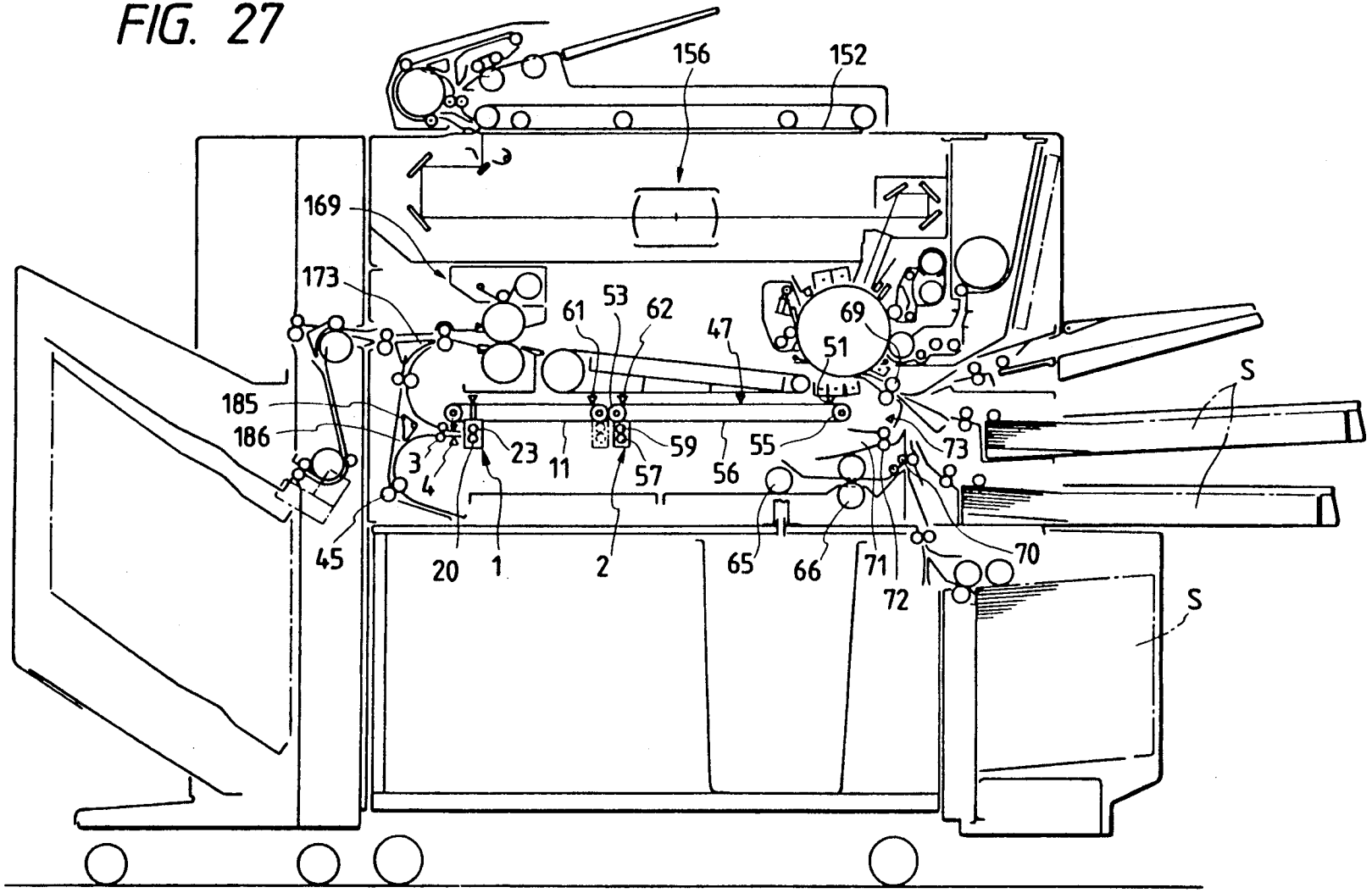
FIGS. 27 is a longitudinal cross-sectional view of an image forming apparatus employing a sheet transporting apparatus constituting a second embodiment of the present invention.

FIGS. 27, 25 and 26 illustrate a second embodiment of the present invention. The two-side unit of the image forming apparatus shown in FIG. 27 is provided with a through-path 71 for forming a copy from an original.

The transporting apparatus of the present invention can be formed, however, without said through-path 71. In such case, even when a copy is formed from an original, the sheet S is discharged onto the intermediate tray 183 as shown in FIGS. 25 and 26, as in the case of forming n (>1) copies from an original explained in the first embodiment.

Also as shown in FIG. 25, the feed roller 65 is lowered by a solenoid (not shown) at the timing, measured by a timer, of passing of the front end of the sheet S, and the sheet S is fed again by rotating the feed roller 65 and the separating roller 66 at a speed same as that of the sheet S. The separating roller 66, based on torque limited separation, has no difficulty in single-sheet transportation.

In the foregoing embodiments, the present invention is applied to the intermediate tray 183 of the main body 151 of the copying machine, but a similar effect can be obtained also when it is applied to a recycling document feeder.

In the following there will be explained an embodiment in which the present invention is applied to a recycling document feeder (RDF).

Figure 32:
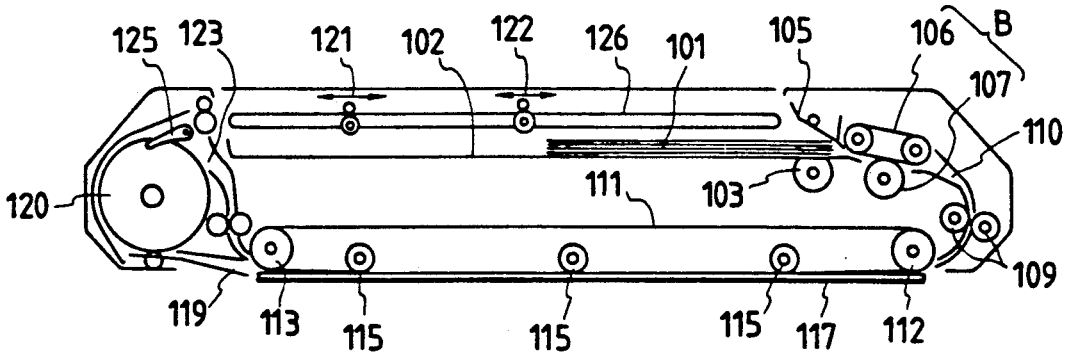
FIG. 32 is a longitudinal cross-sectional view of a cyclic document feeder embodying the present invention.

FIG. 32 is a longitudinal cross-sectional view of a recycling document feeder. On an original tray 102, there are stacked originals 101 with image bearing faces upwards, which are fed into a separating station B from the bottom, by means of a semi-circular roller 103 and a weight 105. Said separating station B is composed of a separating belt 106 and a feed roller 107, and serves to separates the lowermost original.

The separated original 101 enters a path 110, then impinges on paired registration rollers 109 to form a predetermined loop, and is further transported by said registration rollers 109 to a platen 117 of the main apparatus. A belt 111 supported by a driving roller 113 and an idler roller 112 is positioned opposite to said platen 117, and is pressed thereto by means of plural press rollers 115. The original 101 fed into the gap between said platen 117 and the belt 111 is transported to a predetermined position at an end (left-hand end in FIG. 32) of the platen 117.

The original 101 is read in this state by reading means, such as an unrepresented optical system in the main body of the copying machine. Upon completion of said reading operation, the belt 111 is activated again to advance the original 101 into a path 119. Then the original 101 is inverted by a large roller 120, then transferred from a first carriage unit 121 to a second carriage unit 122, and is set, with the image bearing face downwards, on the stacked originals 101. Subsequently the above-explained operations are repeated for the remaining originals 101, thereby forming a set of copies for plural originals.

There are also provided a path 123 for inverting two-side originals and a switching flapper 125 for said path, but these components are not directly related to the present invention.

Each of said first and second carriage units 121, 122 is provided with paired rollers as in the above-explained carriage units 1, 2, thereby being capable of transporting the original 101 between said rollers, and can move in both directions as indicated by arrows, being guided by an elongated hole 126 formed in the lateral plate of the recycling document feeder. The original 101 can be transported and discharged in a pinched state, by means of said first and second carriage units 121, 122.

The detailed functions of said carriage units 121, 122 are same as those in the intermediate tray 183 in the foregoing embodiments, whereby the removal of jammed sheet in the recycling document feeder can be facilitated as in the aforementioned copying machine P1.

In the foregoing embodiments, in which the sheet transporting mechanism is composed of carriage unit(s) 1 (2) capable of reciprocating above the intermediate tray, in case of sheet jamming in said intermediate tray 183, the space above said tray can be opened wide by estimating the state of jammed sheet from a jam signal from the main body 151 of the copying machine and from the recognition of position of said jamming by sensors and by moving the carriage unit 1 to a suitable corresponding position, whereby the user can easily remove the jammed sheet.

Also, since the carriage unit 1 can be positioned at an arbitrary position on the intermediate tray 183, the change in the position of sheet discharge from the carriage unit 1 to the intermediate tray 183 can be achieved without the use of plural deflecting means, so that the mechanism can be simplified.

Also in relation to the stacking of the sheets, it is rendered possible, for example, to move the carriage unit 1 in the opposite direction in the course of sheet discharge, by suitable control of the discharge speed of the carriage rollers 20, 23 of the carriage unit 1. It is therefore rendered possible to bring the sheet discharge position, from the carriage unit 1 to the intermediate tray 183, infinitely close to the entrance for sheet re-feeding, regardless of the size (length) of the sheet S. It is thus possible to suppress the freedom of the front end of sheet before reaching the re-feeding entrance, thereby preventing the stacking failure by sheet bending at the stacking particularly of less rigid large-sized sheets S, and also preventing the mutual sticking of a sheet and the front end of a next sheet resulting from the state of toner on the image bearing face of the already stacked sheets, particularly in the two-side copying operation.

Furthermore, in the conventional fixed discharge path, it has not been possible to vary the sheet discharging operation according to the number of sheets S discharged onto the intermediate tray 183. For this reason, in case of forming a large number of two-side copies, the stable sheet stacking has been difficult to achieve as the sheet discharge condition varies according to the change in the height of the stacked sheets. On the other hand, in the present invention, the sheet can be always stably supplied to the intermediate tray 183 at a suitable discharge position with a suitable discharge angle, and can be stacked in satisfactory manner on the intermediate tray 183, because the discharge position of the carriage unit 1 can be changed by a small amount and because the angle of the carriage rollers 20, 23 of the carriage unit 1 can be regulated, both depending on the number of sheets or on the physical properties of the sheet.

Furthermore, the mechanical noise and the frictional noise between the guide member and the sheet in the conventional sheet transporting apparatus employing fixed discharge path are drastically reduced by the apparatus of the present invention employing the carriage units.

It is furthermore possible to improve the efficiency of the image forming apparatus, and to improve the stacking of the sheets S, by moving the carriage unit 2 in a direction opposite to the direction of sheet discharge, in the course of sheet discharge onto the intermediate tray 183.

In the following there will be explained, with reference to FIGS. 33 to 52, a third embodiment of the present invention, in which the sheet discharge position of the carriage is varied according to the sheet size.

Figure 33:
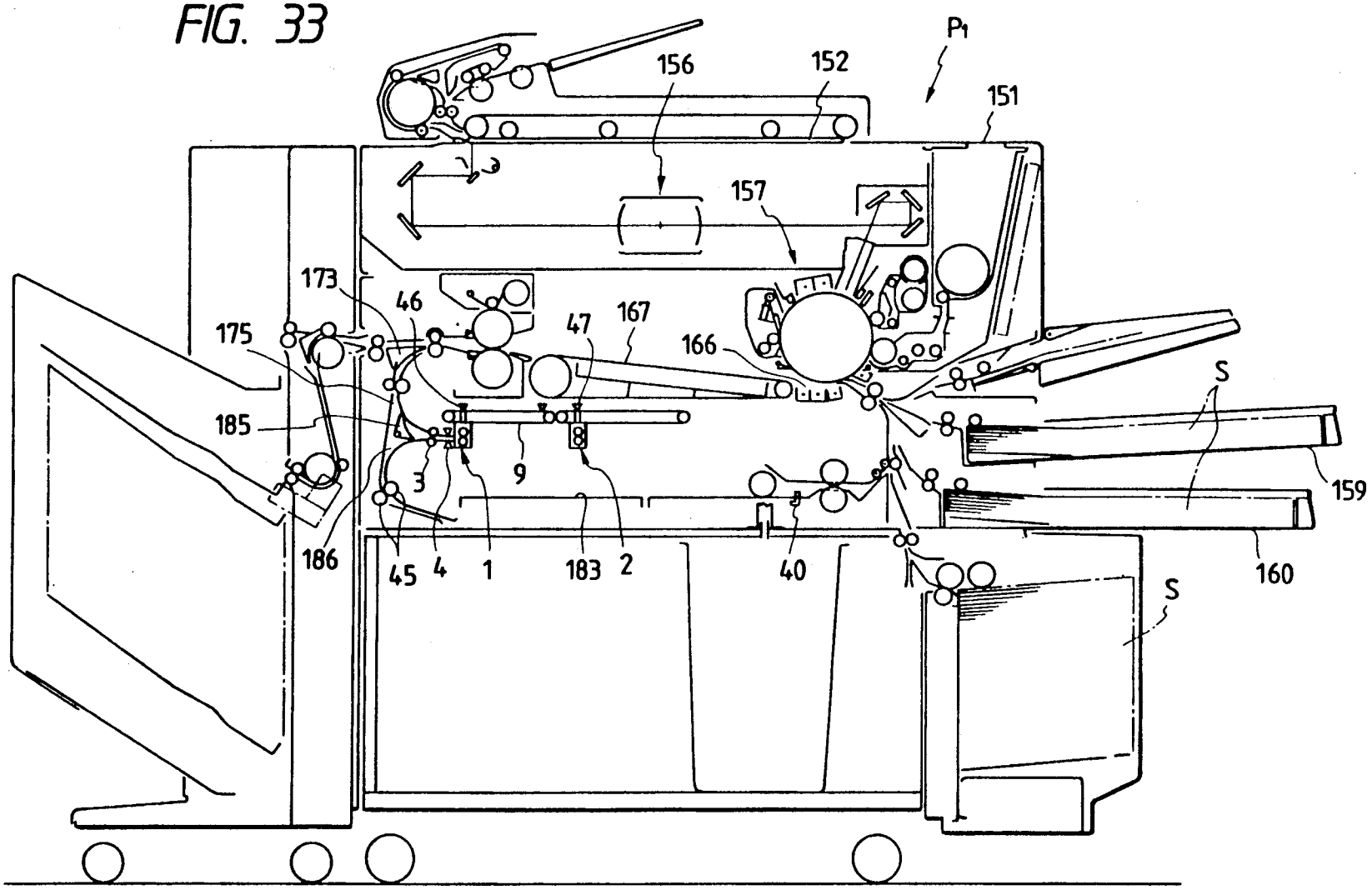
FIG. 33 is a longitudinal cross-sectional view of an image forming apparatus employing a sheet transporting apparatus constituting a third embodiment of the present invention.
Figure 34:
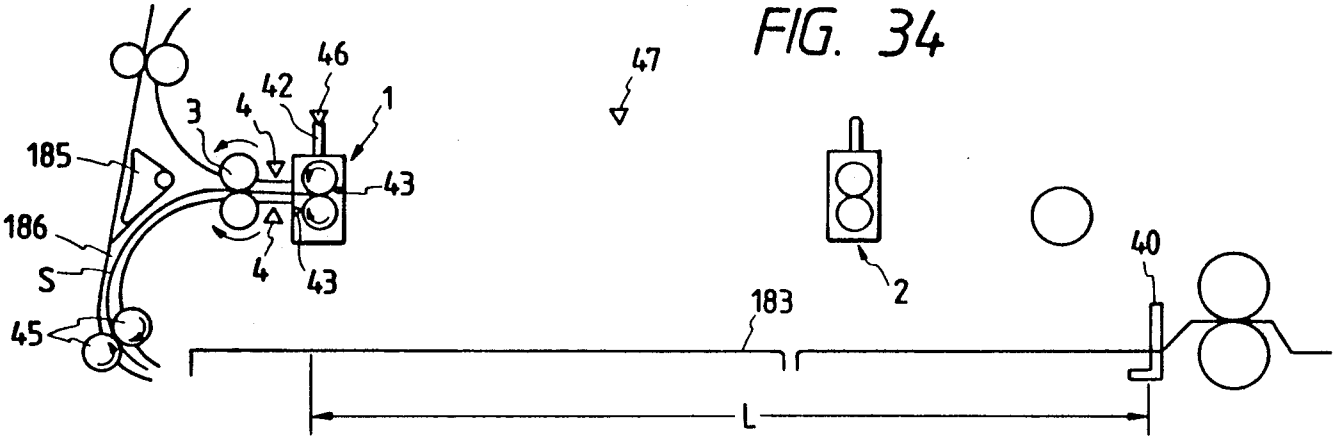
FIGS. 34 to 37 are views showing the functions for large-sized sheet transportation.

Referring to FIG. 33, a shaft 21 on which plural carriage rollers 20 are fixed in rotatably supported by lateral plates 5*b*, 5*c* of a frame 5, and a pair of support levers 22 are rotatably mounted, at the base portions thereof, on both ends of said shaft 21 extending from said lateral plates 5*b*, 5*c*. A shaft 26 supports plural carriage rollers 23 respectively paired with said carriage rollers 20, and plural sheet reinforcing rollers 25 respectively positioned between said carriage rollers 23 and larger than said carriage rollers 23 in diameter. Both ends of said shaft 26 pass through elongated holes 27 formed on the lateral plates 5*b*, 5*c* and are fitted in elongated hole 22*a* formed in the free ends of said support levers 22, and said shaft 26 is biased by spring 22*b* toward the shaft 21, namely in a direction to press the carriage rollers 23 to the carriage rollers 20.

On the lateral plate 5*c* of the frame 5 there is mounted, by a support member (not shown), a motor 32 for driving the carriage rollers 20, 23, and a gear 33 fixed on the shaft of said motor meshes with a gear 35 fixed on the shaft 21. Said gear 35 also meshes with a gear 36 which is fixed, through a one-way clutch (not shown), on a shaft 26 integral with the carriage rollers 23.

On the rear side of the upper plate 5*a* of the frame 5, there is mounted the base portion of an actuating member 42, of which free end extends upward through the upper plate 5*a*. There are also provided a HP (home position) sensor 47 for detecting said actuating member 42, and a transfer sensor 47 for the second carriage unit. In front of and behind the carriage rollers 20, 23 of the carriage unit 1 there are provided roller sensor 43 for sheet detection. The aforementioned motor 16 for driving the first carriage unit 1 is provided with a clock disk (not shown) and a sensor for counting the number of clock pulses, whereby the unit can be stopped at a predetermined position, corresponding to the number of clock pulses from said transfer sensor 47.

A second carriage unit 2, of the same structure as that of the first unit 1, is provided at the downstream side thereof, and is so supported as to be movable in the direction 17 or 19.

Other structures are sams as those shown in FIG. 3.

FIGS. 34 to 37 illustrate the operations of the above-explained structure in the transportation of large-sized sheet. The operations from the one-side copying on the sheet S to the entry thereof into the switchback path 186 are same as those in the conventional C-shaped path shown in FIG. 1. The sheet S transported from said switchback path 186 by the switchback rollers 45 is deflected by a flapper 185 toward discharge rollers 3.

Figure 35:
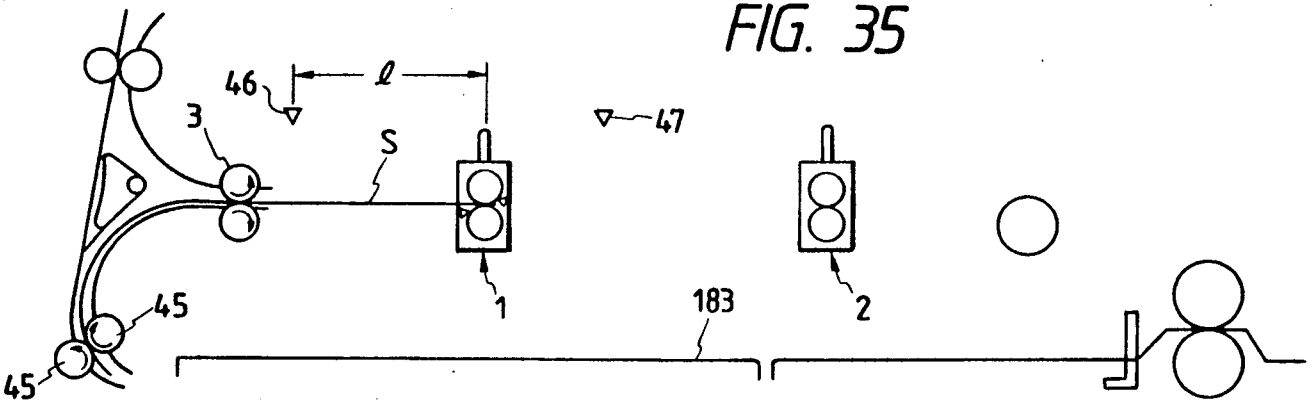
Figure 36:
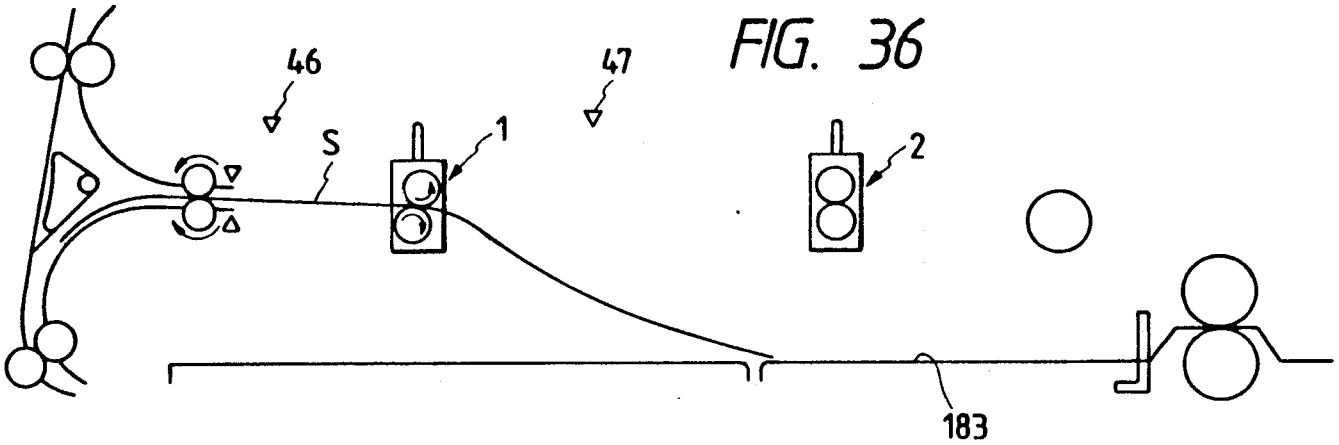
Figure 37:
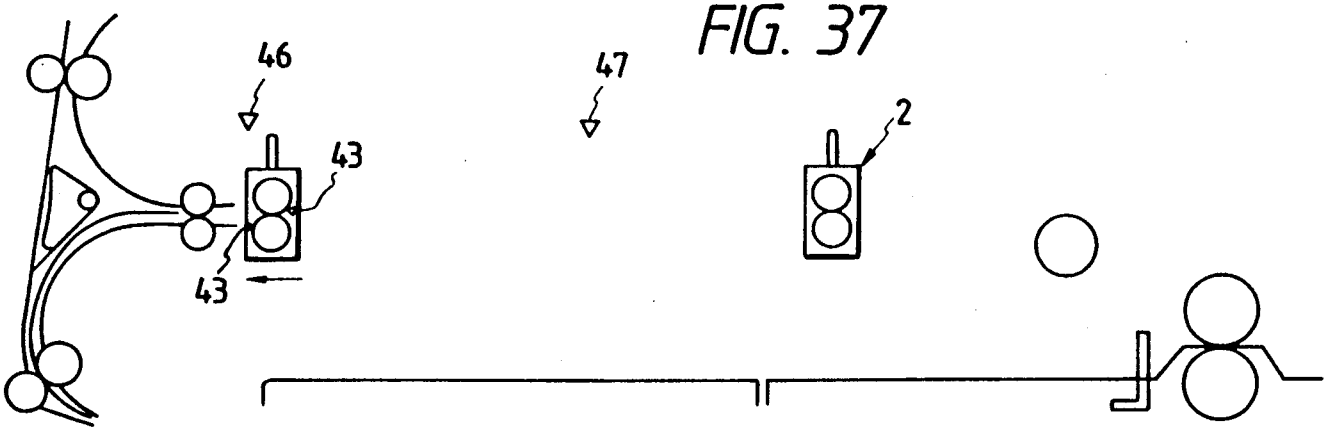
Figure 38:
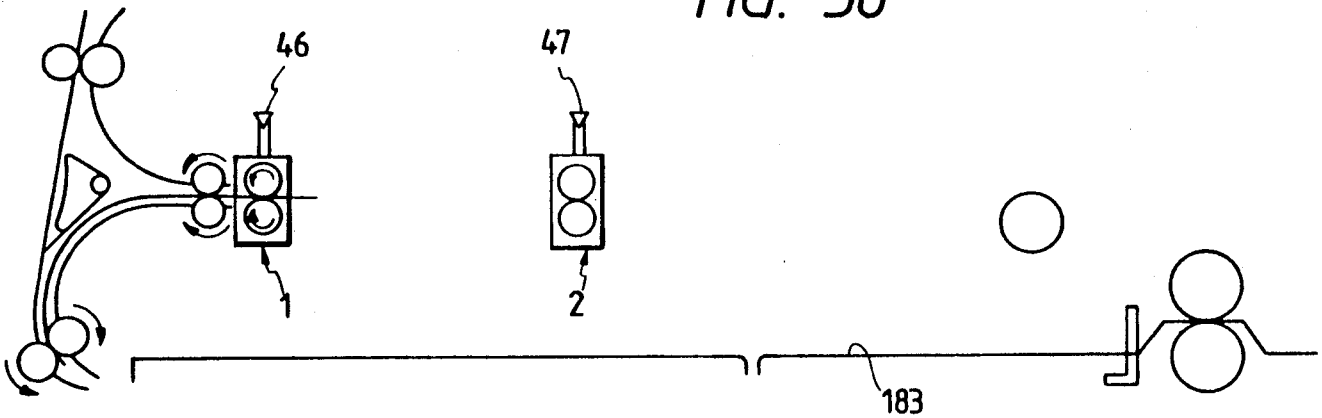
FIGS. 38 to 43 are views showing the functions of small-sized sheet transportation.
Figure 39:
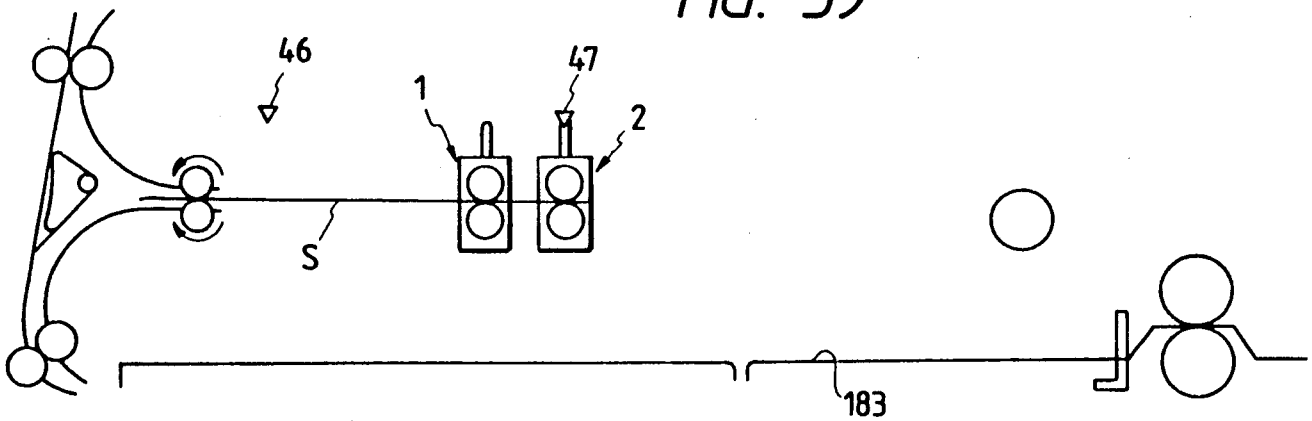

The second carriage unit 2 is retracted to a position of n clock pulses in the direction 17 from the transfer sensor 47. Then the sheet S is advanced by the rotation of the switchback rollers 45 and discharge rollers 3 in the direction of arrow indicated in FIG. 34. When said sheet S is detected by the intermediate tray discharge sensor 4, the aforementioned motor 32 is activated to rotate the carriage rollers 20, 23 in the direction of arrow, thereby clamping the front end of said sheet S. Upon detection of the sheet S by the roller sensor 43 in the carriage unit 1, the motor 32 is deactivated to stop the carriage rollers 20, 23. The first carriage unit 1 starts to move, and is stopped upon counting l clock pulses supplied from the HP sensor 46, as shown in FIG. 35. Since:

$$L-l=\text{sheet length } S+\alpha$$

wherein L is the constant distance from the HP sensor 46 to the stopper 40 and $\alpha>0, \alpha\geq 0$, l is determined by the sheet size, which can be entered in advance or detected by size detection means in the course of transportation. When the carriage unit 1 is stopped after advancement by l, the aforementioned solenoid 30 is energized to rotate the support levers 22 in a direction 31, whereby the discharge direction of the carriage rollers 20, 23 is shifted slightly downwards. Then said carriage rollers 20, 23 are rotated by the motor 32 to discharge the sheet S onto the intermediate tray (sheet storage means) 183. When the carriage roller sensor 43 detects that the sheet S is disengaged from the nip of the carriage rollers 20, 23, the first carriage unit 1 returns toward the HP sensor 46 to fetch the next sheet S, thereby returning to the state shown in FIG. 34.

In the following there will be explained the transportation and discharge of half-sized sheet S, with reference to FIGS. 38 to 43. As in the case of large-sized sheet, the carriage unit 1 fetches, in a position actuating the HP sensor 46, the sheet supplied from the switchback rollers 46, and moves in the sheet feeding direction. The second carriage unit 2 waits in a position actuating the transfer sensor 47. The carriage unit 1 stops after a predetermined number of clock pulses, and the carriage rollers 20, 23 are rotated simultaneously with those of the second carriage unit 2, whereby the sheet is transferred thereto.

Figure 40:
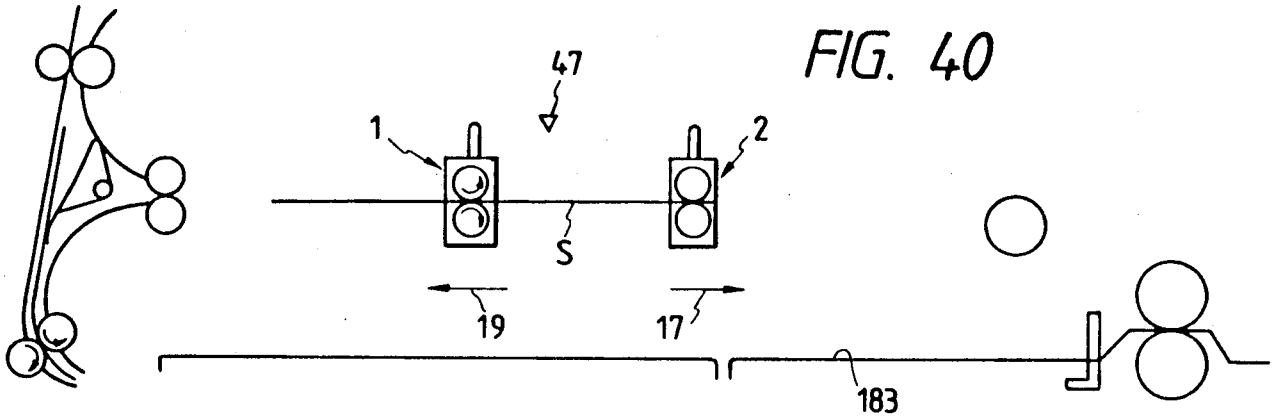

When the carriage roller sensor (not shown) detects that the sheet S is clamped in the nip of the carriage rollers (not shown) of the second carriage unit 2, the carriage rollers thereof are stopped and said carriage unit 2 moves in a direction 17 shown in FIG. 40.

The first carriage unit 1 moves in the opposite direction 19, and the carriage rollers thereof rotate at a speed corresponding to the sum of the speed of said movement and the sheet discharge speed. When the carriage roller sensor 43 of the first carriage unit 1 detects that the sheet S is disengaged from the nip of the carriage rollers 20, 23, said carriage rollers 20, 23 are stopped and the first carriage unit 1 is stopped at a position actuating the HP sensor 46. The carriage unit 2 moves by a predetermined number of clock pulses (corresponding to the distance l2) from the transfer sensor 47. There is preferred a relation:

$$L-(l1+l2)=\text{sheet length } S+\alpha$$

wherein l1 is the distance from the HP sensor 46 to the transfer sensor 47, and $\alpha>0$, $\alpha\cong0$.

Figure 41:
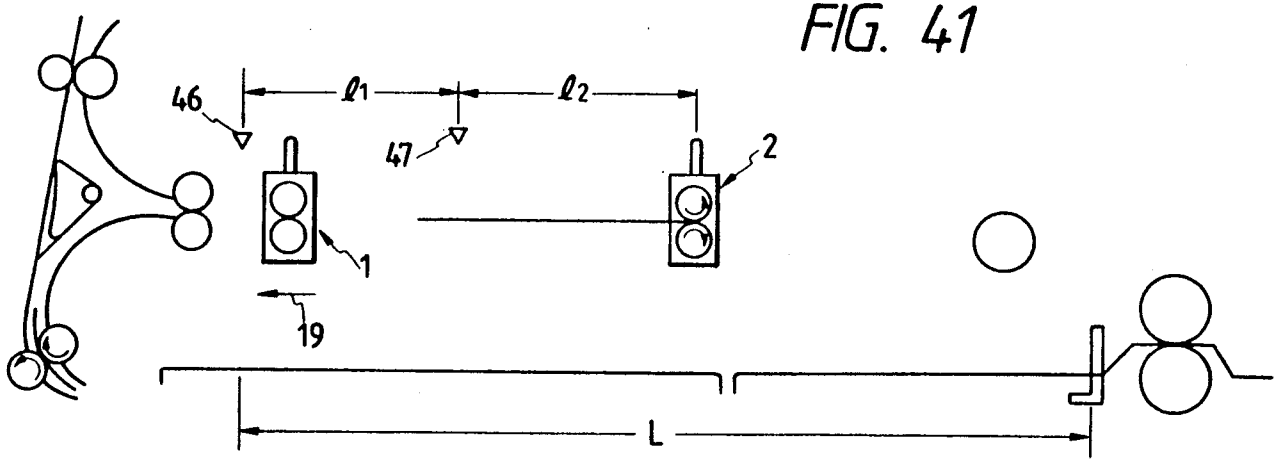
Figure 42:
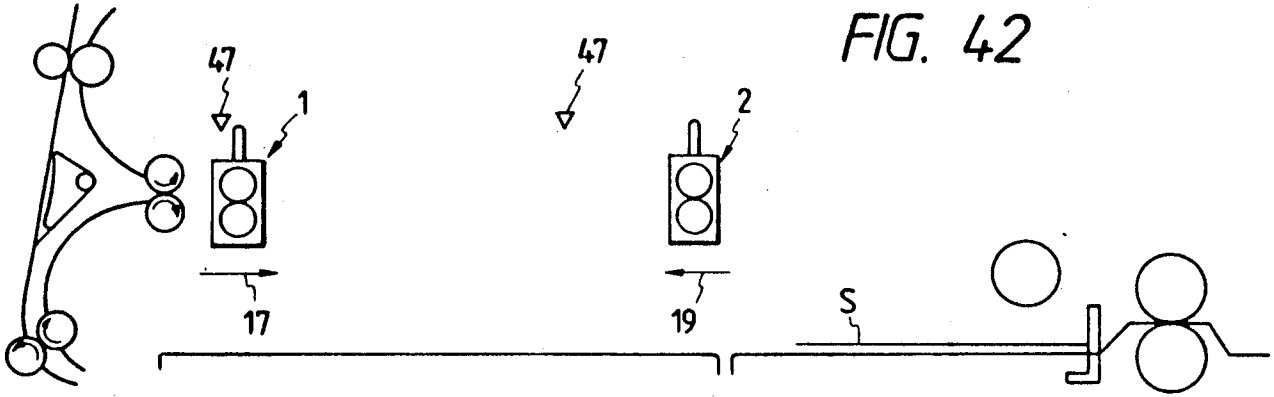
Figure 43:
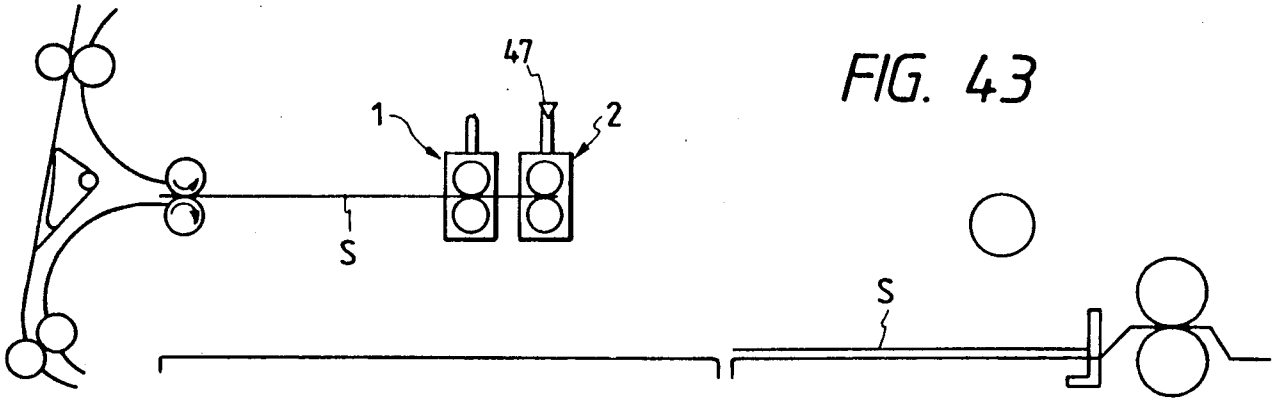

Since L and l1 are constant, l2 can be determined from the length of the sheet S. The carriage unit 2 stops after movement by l2 from the transfer sensor 47 as shown in FIG. 41. Then the solenoid 30 is energized to shift the discharge direction of the carriage rollers (not shown) slightly downward, and the motor 32 is activated in this state to start the sheet discharge. Though the sheet S is only supported by the second carriage unit 2 in this state, the sheet S does not hang down because of the presence of the reinforcing rollers 25 among the upper carriage rollers 23. Upon completion of the sheet discharge as shown in FIG. 42, the carriage unit 2 returns toward the transfer sensor 47. The first carriage unit 1 fetches the next sheet S and moves in the direction 17. The sheet S transported by said first carriage unit 1 is again transferred to the carriage unit 2 as shown in FIG. 43, whereby the state shown in FIG. 39 is reached again.

Now reference is made to FIGS. 44 to 51 for explaining a fourth embodiment, which is a variation of the third embodiment.

Figure 44:
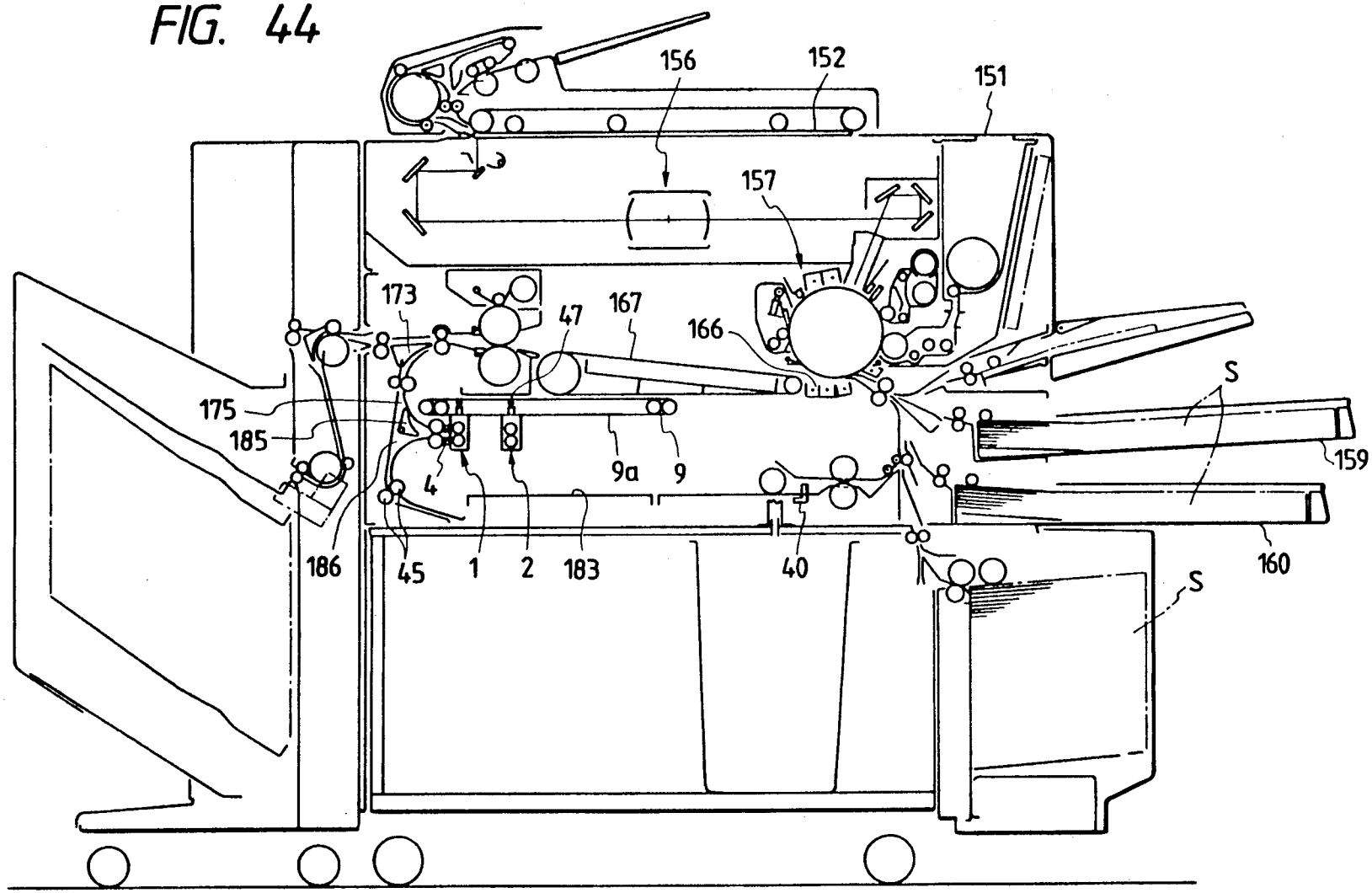
FIG. 44 is a longitudinal cross-sectional view of an image forming apparatus employing a fourth embodiment of the present invention.
Figure 45:
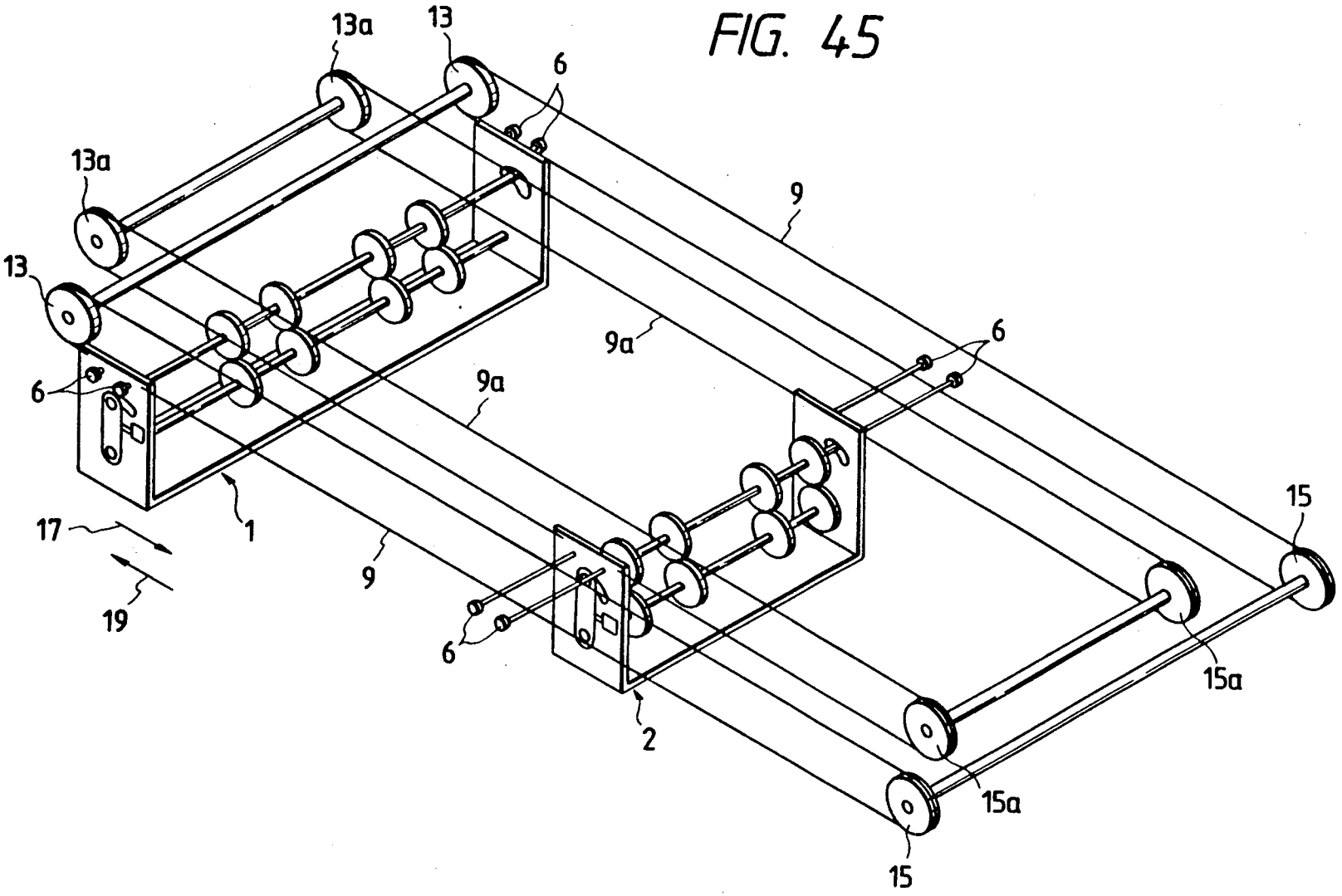
FIG. 45 is a perspective view of a carriage unit.
Figure 46:
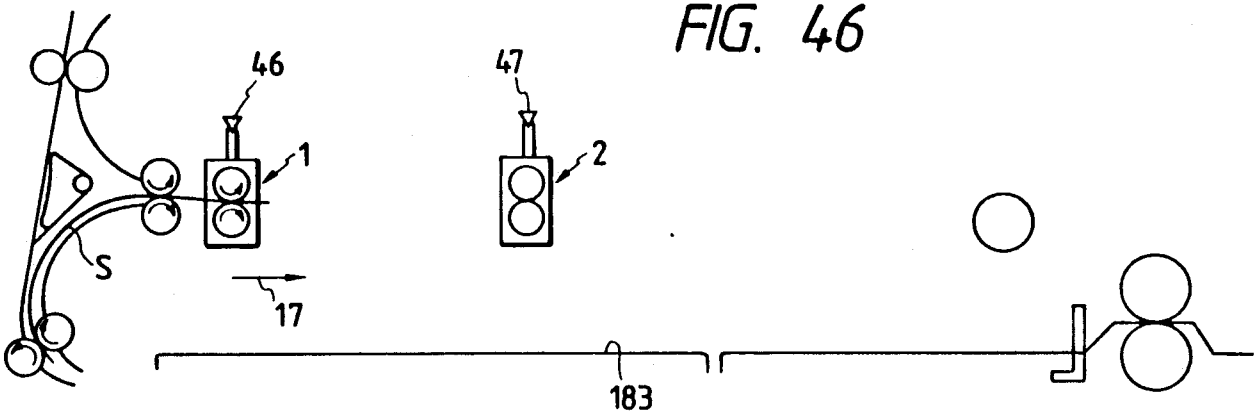
FIGS. 46 to 51 are views showing the functions of sheet transportation.

Referring to FIGS. 44 and 45, a pair of belts 9*a* of which both ends are connected to the second carriage unit 2 are supported by paired pulleys 13*a*, 15*a*, which are respectively positioned close to the pulleys 13, 15 supporting the belts 9 for the first carriage unit 1. The above-explained arrangements of the first and second carriage units 1, 2 and the belts 9, 9*a* enable independent movement of the carriage units 1, 2.

In the following there will be explained the operation of the above-explained structure, in case of transportation of half-sized sheet S, with reference to FIGS. 46 to 51.

Figure 47:
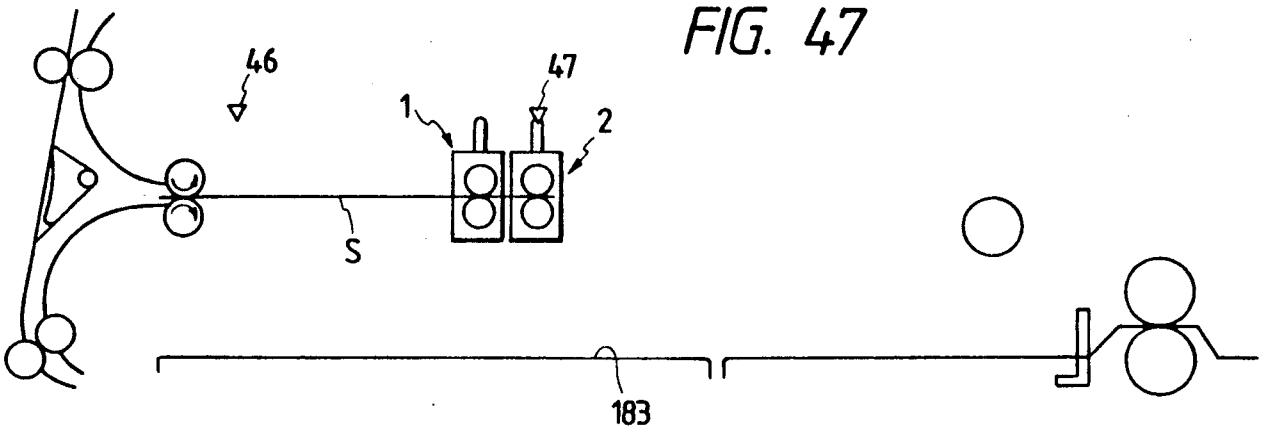
Figure 48:
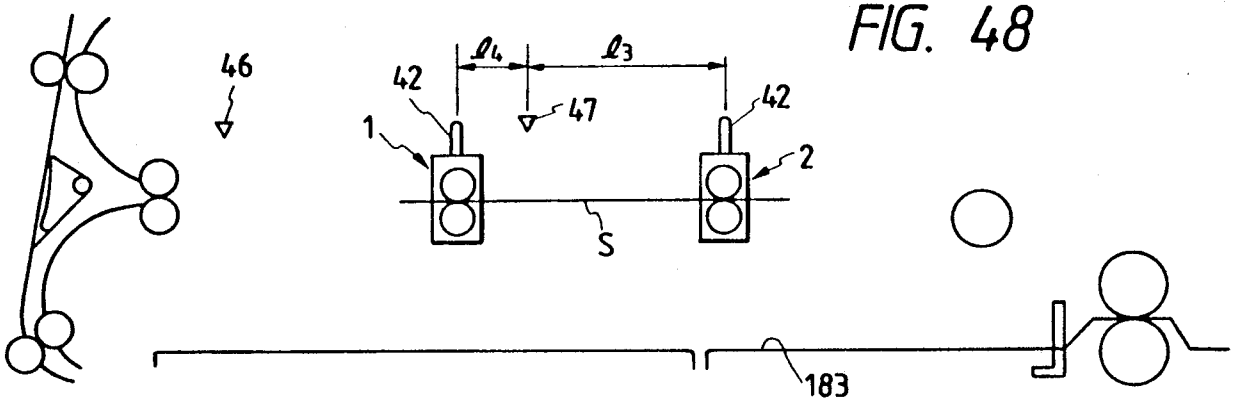

At a position actuating the HP sensor 46, the first carriage unit 1 fetches the sheet S supplied from the switchback rollers 45. When the carriage roller sensor 43 of the carriage unit 1 detects said fetching of the sheet, the carriage rollers 20, 23 are stopped. Then the carriage unit 1 moves by a predetermined number of clock pulses, then actuates the transfer sensor 47 and transfers the sheets S to the stopped second carriage unit 2. The carriage rollers of the carriage unit 2 are stopped when the sheet is clamped in the nip therebetween as shown in FIG. 47, and the carriage unit 2 moves in a direction 17 as shown in FIG. 48. In this state the carriage rollers 20, 23 of the carriage unit 1 rotate at a peripheral speed same as the moving speed of the carriage unit 2.

Figure 49:
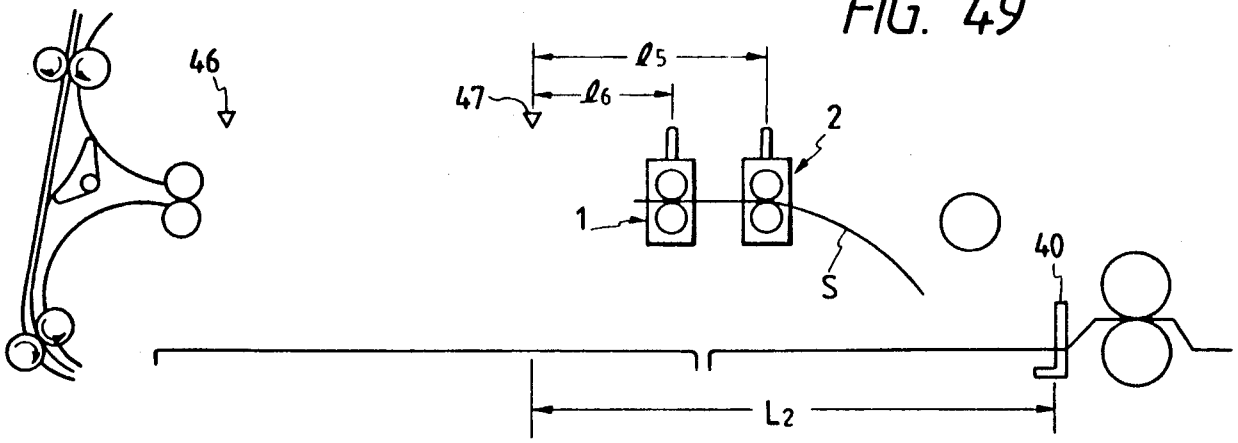
Figure 50:
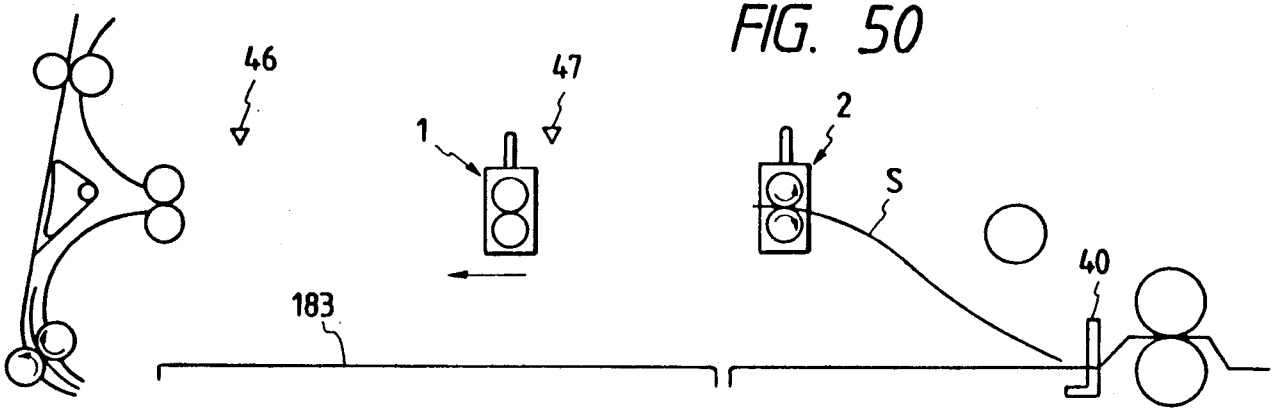

The distance l4 from the actuating member 42 of the carriage unit 1 to the transfer sensor 47 can be estimated from the moving distance of the carriage unit 1 from the HP sensor 46. Also the moving distance l3 of the carriage unit 2 from the HP sensor 46 can be determined from the number of clock pulses. Thus, when distance (l3+l4) comes close to the sheet length, the rear end of the sheet should be positioned close to the nip of the carriage unit 1. Therefore the rotation of the carriage rollers 20, 23 is stopped, and the carriage unit 1 moves in the same direction, with the same speed, as the carriage unit 2. As shown in FIG. 49, the carriage unit 2 stops after movement by distance l5 from the transfer sensor 47. There stands a relation:

$$L1-l5=\text{sheet length } S+\alpha$$

wherein L2 is the distance from the transfer sensor 47 to the stopper 40, and $\alpha>0$, $\alpha\cong0$.

After being stopped, the carriage unit 2 starts the sheet discharge by rotating the carriage rollers thereof. The carriage unit 1 stops after movement by distance l6 from the transfer sensor 47, and rotates the carriage rollers 20, 23 at a same peripheral speed as that of the carriage rollers of the carriage unit 2. For preventing creases in the sheet, there are preferred conditions l5>l6 and (l5-l6)<half of sheet length.

Figure 51:
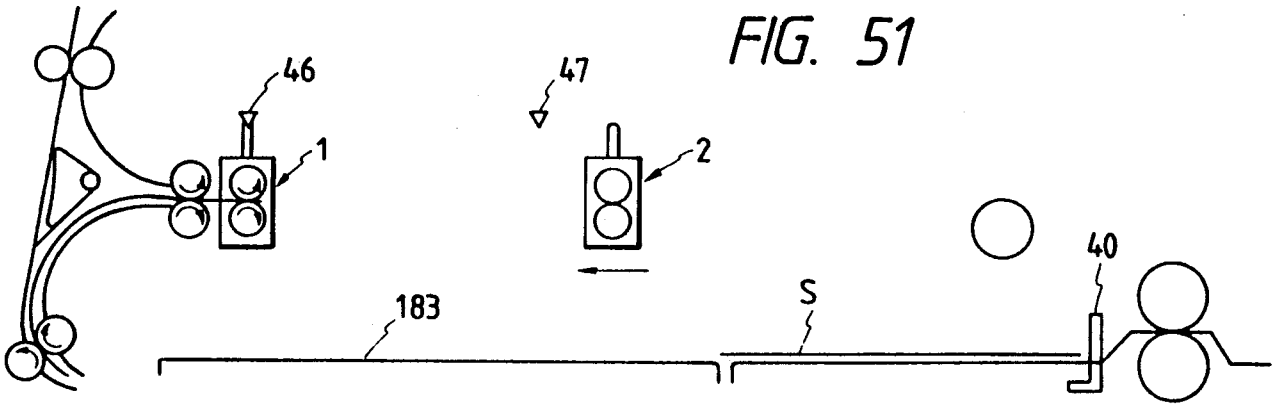
Figure 52:
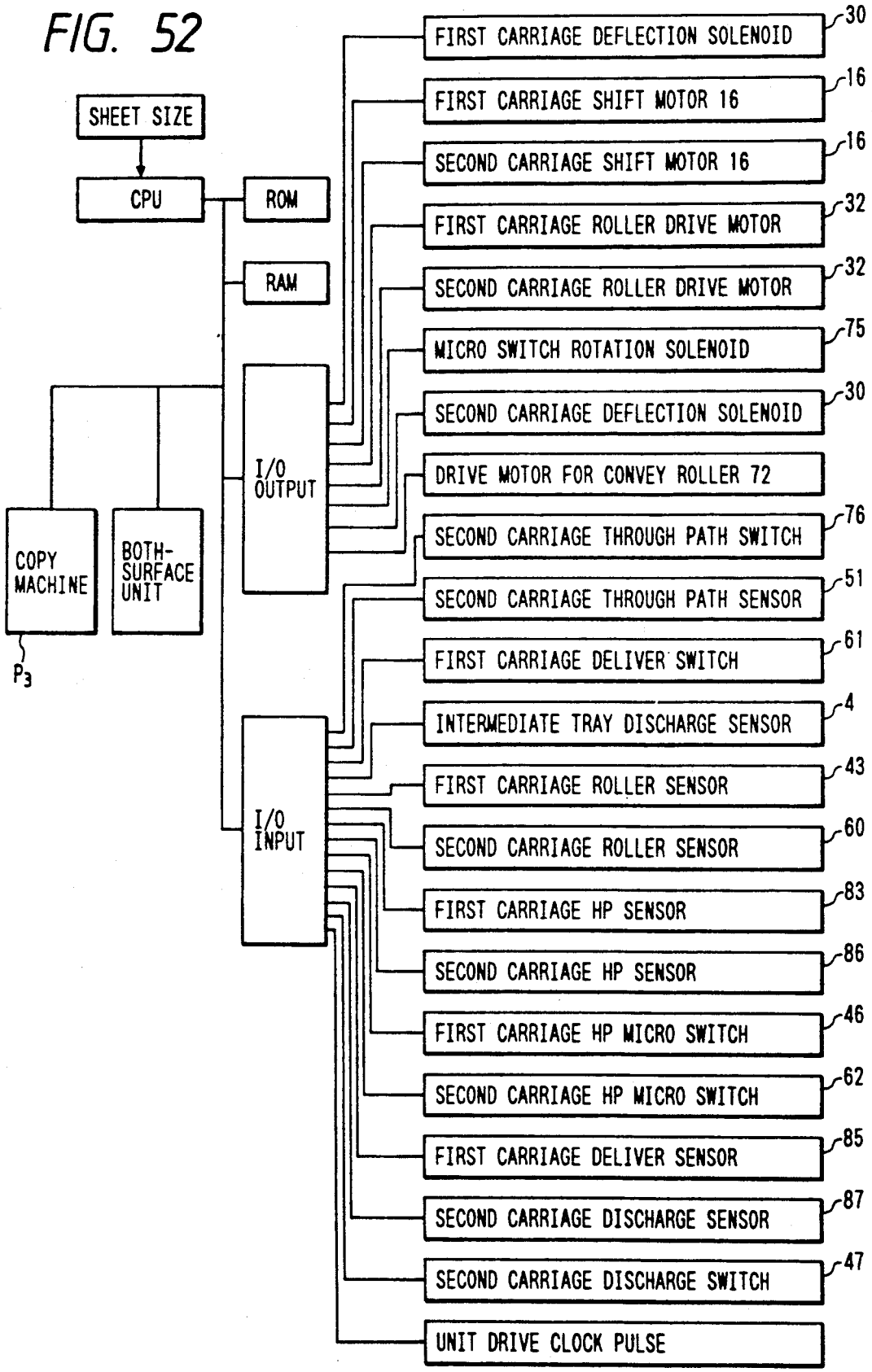
FIG. 52 is a block diagram of sheet transport/discharge control of the present invention.

Upon detection that the rear end of the sheet S is disengaged from the nip of the carriage rollers 20, 23 as shown in FIG. 51, the rotation of the carriage rollers 20, 23 is stopped, and the carriage unit 1 starts to move toward the HP sensor 46. Also the carriage unit 2 returns toward the transfer sensor 47. In this case the reinforcing rollers 25 shown in the first embodiment are not required.

For the large-sized sheet, the second carriage unit 2 is retracted by n clock pulses from the position of the transfer sensor 47 as in the first embodiment, and the transportation and discharge of the sheet S are conducted solely by the first carriage unit 1 only.

In the foregoing embodiment, the present invention is applied to the intermediate tray 183 in the main body 151 of a copying machine, but similar effect can be obtained when it is applied to a recycling document feeder.

In the following there will be explained a fifth embodiment of the present invention in which the carriage unit is stopped at a predetermined position upon detection of sheet jamming, with reference to FIGS. 53 to 89.

Figure 53:
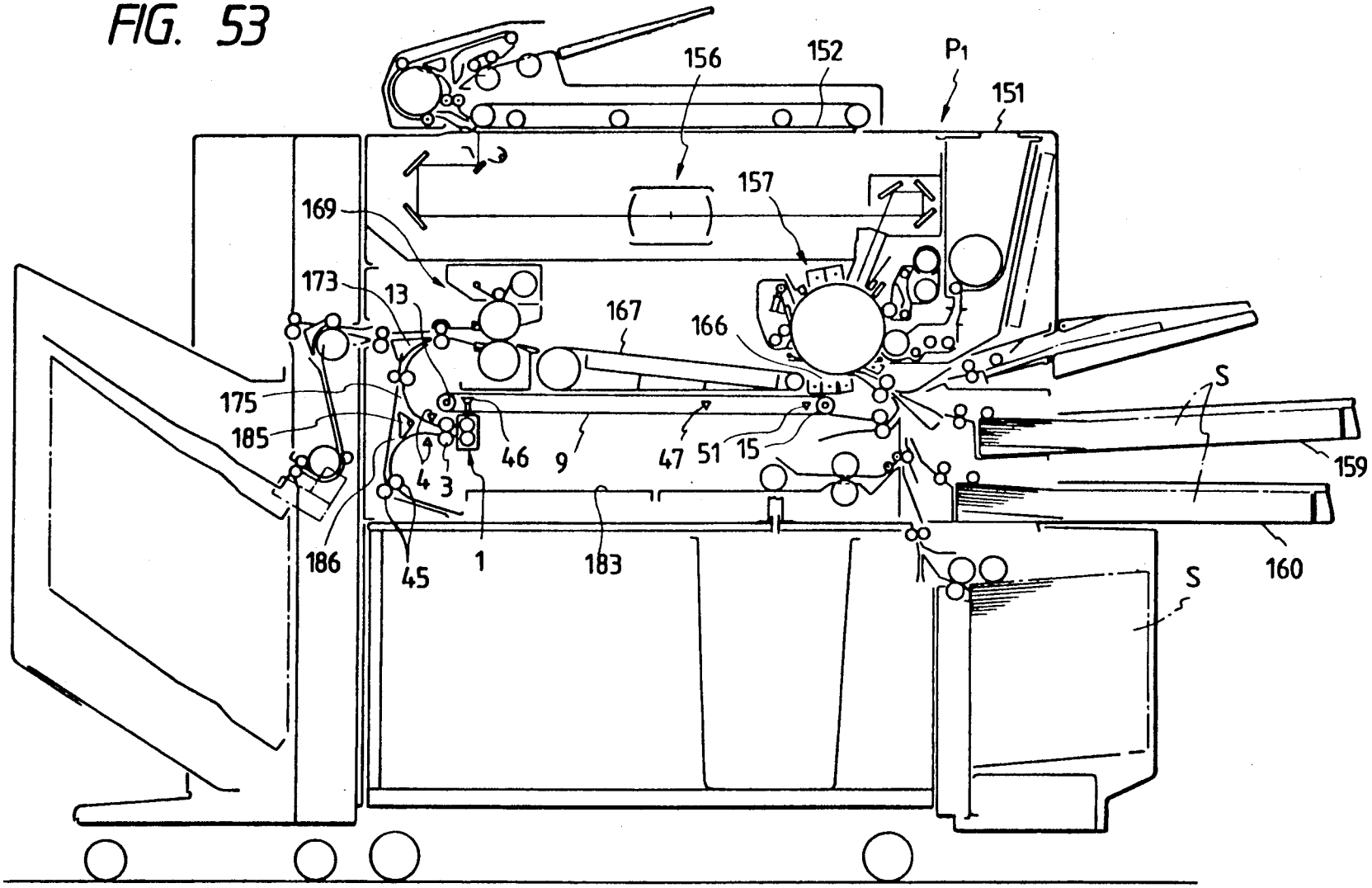
FIG. 53 is a longitudinal cross-sectional view of an image forming apparatus employing a sheet transporting apparatus constituting a fifth embodiment of the present invention.

Referring to FIG. 53, a motor 32 for driving carriage rollers 20, 23 is fixed on a lateral plate 5*b*of a frame 5, and a gear 33 fixed on the shaft of said motor meshes with a gear 35 mounted, through one-way clutch (not shown), on the end of a shaft 21. Said gear 35 also meshes with an idler gear 36 which is mounted, through a clutch 39 (cf. FIG. 54), on a shaft 37 rotatably supported by the lateral plate 5*b*. On said shaft 37 there is mounted an eccentric cam 40 which is in contact with the periphery of an eccentric cam 41 fixed on the end of said shaft 26.

In the following there will be explained the operation of the above-explained structure in case of forming n (>1) two-side copies from an original, with reference to FIGS. 56 to 59. The operations from the one-side copy on the sheet S to the entry thereof into the switchback path 186 are same as those in the conventional C-shaped path shown in FIG. 1. The sheet S transported from the switchback path 186 by the switchback rollers 45 is forwarded to the discharge rollers 3 by the flapper 185. A home position (HP) sensor 46 is provided in the vicinity of said discharge rollers 3, and an intermediate tray discharge sensor 47 is provided at the downstream side thereof.

Figure 56:
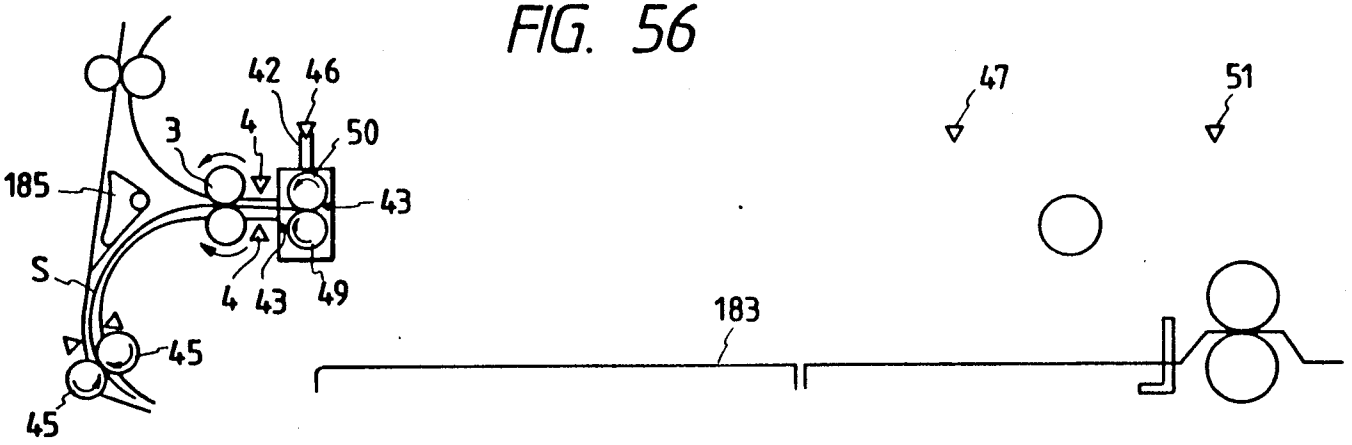
FIGS. 56 to 60 are views showing the functions of sheet transportation.
Figure 57:
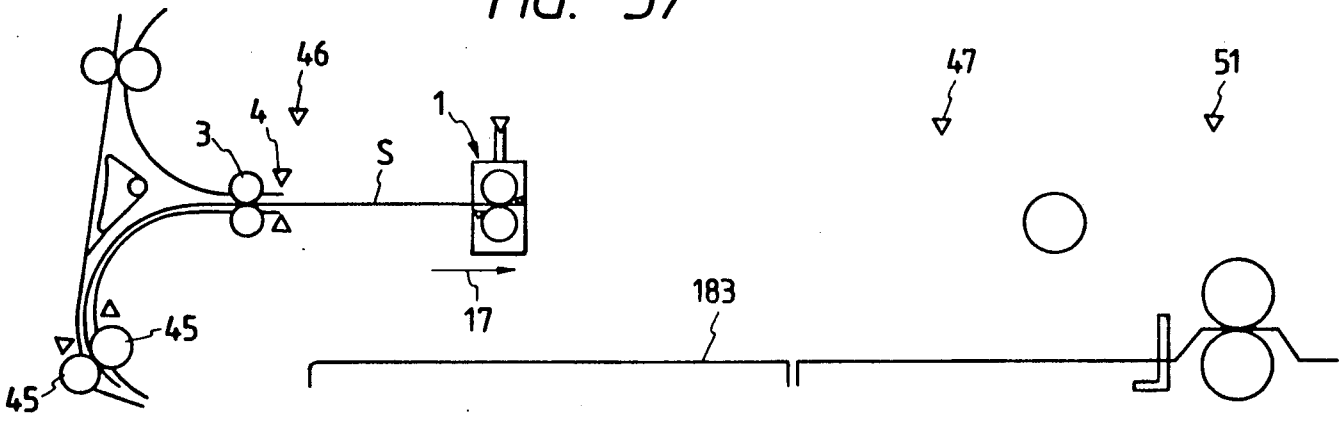

In a state in which the carriage unit 1 is in the home position shown in FIG. 56 and the home position sensor 46 is actuated by the actuating member 42, when the intermediate tray discharge sensor 4 is actuated by the sheet S, the carriage rollers 20, 23 of the unit 1 respectively rotate in directions 49, 50 to clamp the sheet S therebetween. When the sheet S is detected by the roller sensor 43 in the carriage unit 1, the carriage rollers 20, 23 are stopped, and the carriage unit 1 moves in the sheet discharging direction 17 as shown in FIG. 57.

Figure 54:
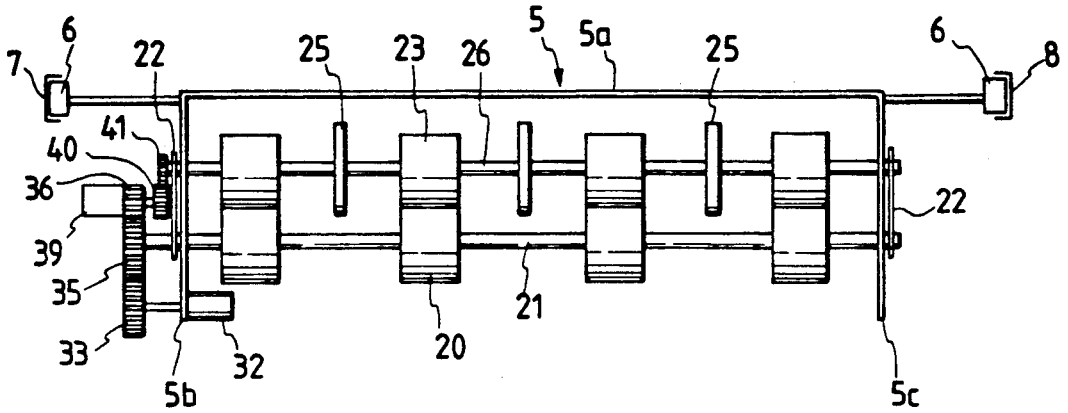
FIG. 54 is a front view of carriage unit of the present invention.
Figure 55:
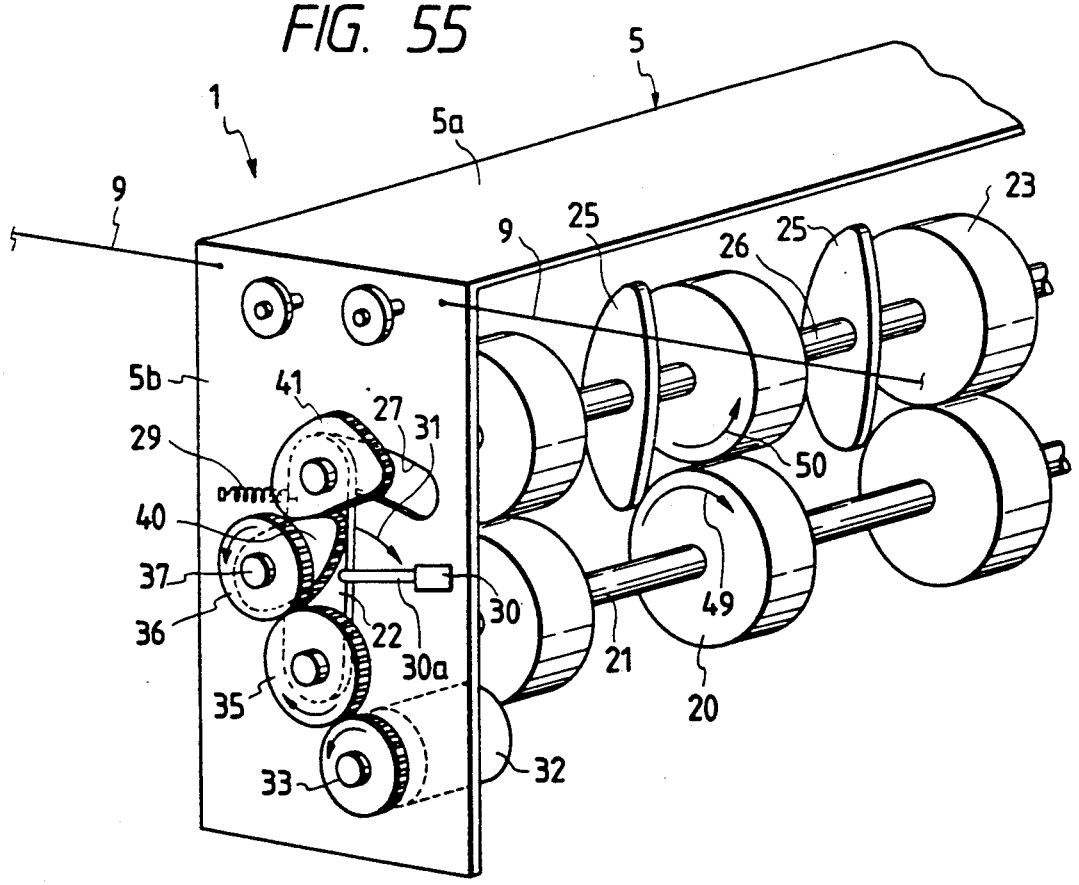
FIG. 55 is a partical magnified perspective view of an essential part thereof.
Figure 58:
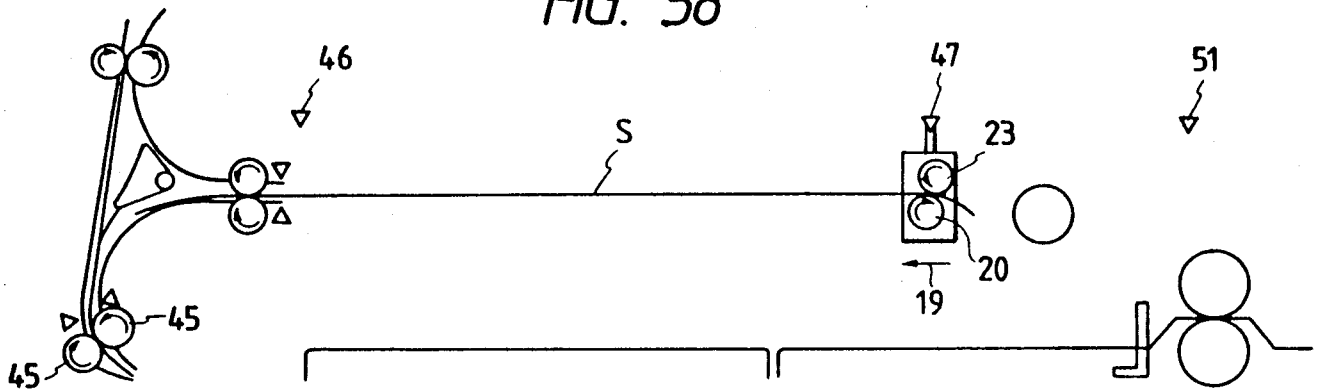
Figure 59:
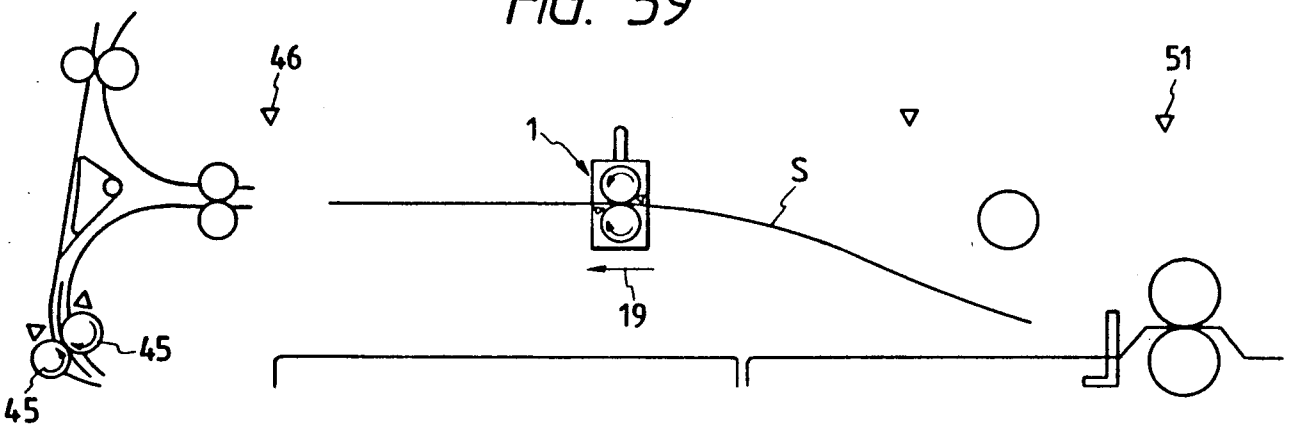
Figure 60:
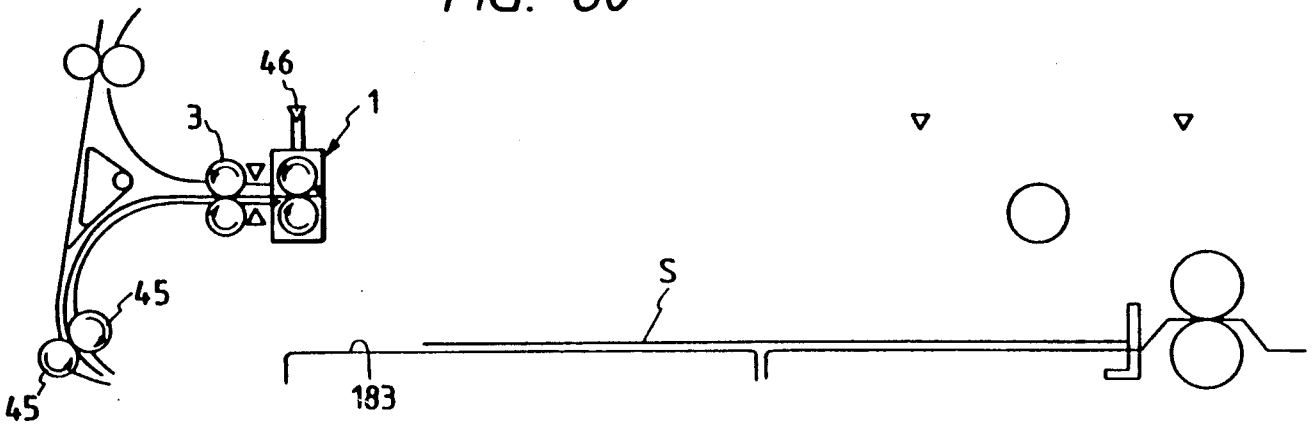

When the carriage unit 1 reaches a position below the intermediate tray discharge sensor 47 and said sensor 47 is actuated by the actuating member 42, the deflecting solenoid 30 of the carriage unit 1 shown in FIG. 55 is energized to rotate the support levers 22 in a direction 31, whereby the sheet discharge direction of the carriage rollers 20, 23 is shifted slightly downward as shown in FIG. 58. In this state the carriage rollers 20, 23 start to rotate thereby discharging the sheet S, and simultaneously the carriage unit 1 starts to move in a direction 19 toward the home position, as shown in FIG. 58. The rear end of the sheet S does not hang down even during the transportation by the carriage unit 1 only, because of the presence of reinforcing rollers 25 coaxial with the carriage rollers 23 as shown in FIGS. 54 and 55. The carriage unit 1 stops at the home position as shown in FIG. 60 when the HP sensor 46 is actuated by the actuating member 42.

The carriage rollers 20, 23 rotate at a speed (V+v), wherein V is the returning speed of the carriage unit 1 and v is the discharge speed of the sheet S. Upon completion of the sheet discharge to the intermediate tray 183, the carriage unit 1 receives the next sheet at the position of the HP sensor 46 from the switchback rollers 45. Thereafter the operations shown in FIGS. 57 to 60 are repeated to stack the sheets S in succession on the intermediate tray 183.

In the following there will be explained the operations in case of sheet jamming.

Figure 61:
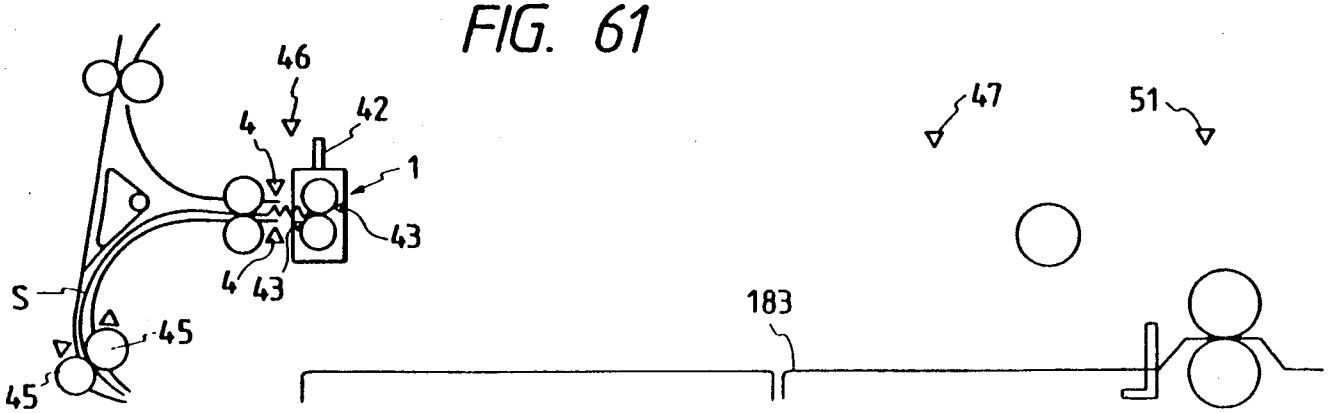
FIGS. 61 to 64 are views showing the functions for jammed sheet removal.
Figure 62:
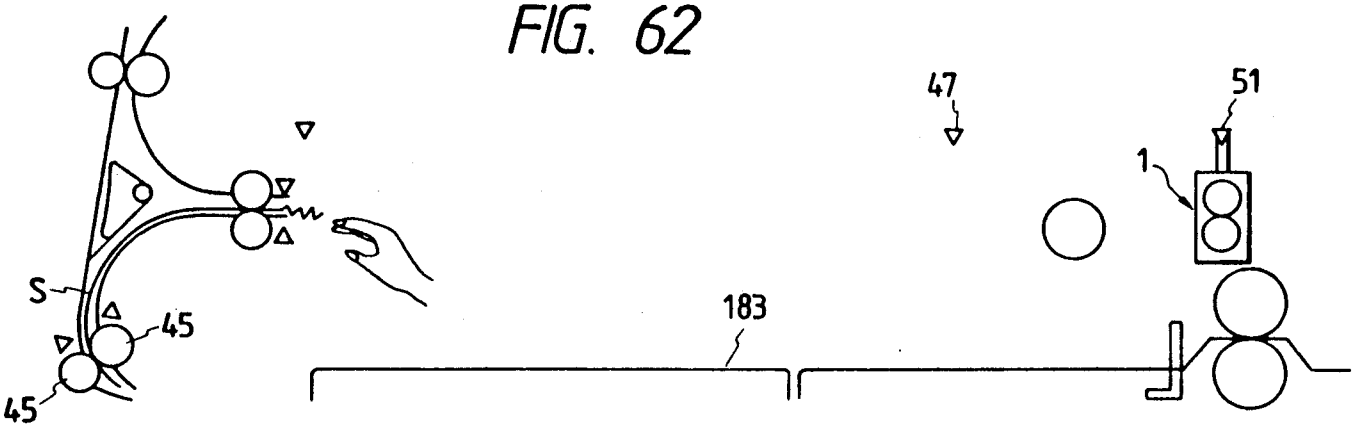

FIG. 61 shows a state of sheet jamming at the sheet transfer to the carriage unit 1. In this state the discharge rollers 3 are activated but the roller sensor 43 of the carriage unit 1 is turned off. In this case, since the sheet S is not clamped in the nip of the carriage rollers 20, 23 of the carriage unit 1, said unit 1 moves toward the through-path sensor 51 provided at the downstream side of the intermediate tray discharge sensor 47 as shown in FIG. 62, and is stopped when said through-path sensor 51 is actuated by the actuating member 42.

In case the sheet jamming occurs while the sheet S is pinched by the discharge rollers 3 and the carriage rollers 20, 23 of the carriage unit 1 and in the course of the movement thereof in the direction 17 as shown in FIG. 57, the intermediate tray discharge sensor 47 and the roller sensor 43 are actuated, whereby the main body 151 of the copying machine detects the location of sheet jamming. In response, the clutch 39 shown in FIG. 54 is turned on, and the motor 32 is momentarily activated, whereby the rotation of the gear 35 is transmitted through the idler gear 36 to the eccentric cam 40 in a direction indicated by an arrow. When said clutch 39 is turned off, the idler gear 36 is not coupled with the eccentric cam 40 but can freely rotate with respect thereto.

Figure 63:
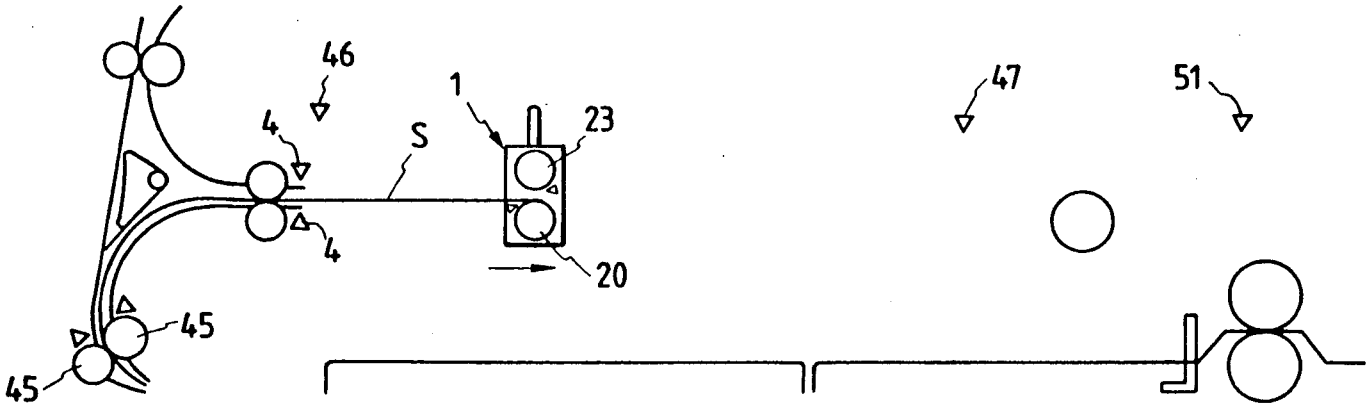

When the clutch 39 is turned on, the eccentric cam 40 rotates integrally with the idler gear in the direction of arrow, whereby the protruding portion of said cam 40 pushes that of the eccentric cam 41 thereby moving the shaft 26 toward the free end portion of the support lever 22. The movement of said support levers 22 releases the carriage rollers 20 from the pressure of the carriage rollers 23. Thus the carriage unit 1 moves toward the through-path 51 with released carriage rollers 23 as shown in FIG. 63. The removal of the jammed sheet is conducted in a state shown in FIG. 64, in which the carriage unit 1 is stopped at the through-path sensor 51. After said sensor 51 is actuated by the carriage unit 1, the carriage rollers 23 may be brought again into contact with the rollers 20.

Then, in case the sheet jamming occurs while the sheet S is pinched only by the carriage unit 1, the main body 151 detects that the roller sensor 43 of the carriage unit 1 is turned on alone and releases the pressure of the carriage rollers 23, and the carriage unit 1 moves to the home position sensor 46.

Figures 64, 65:
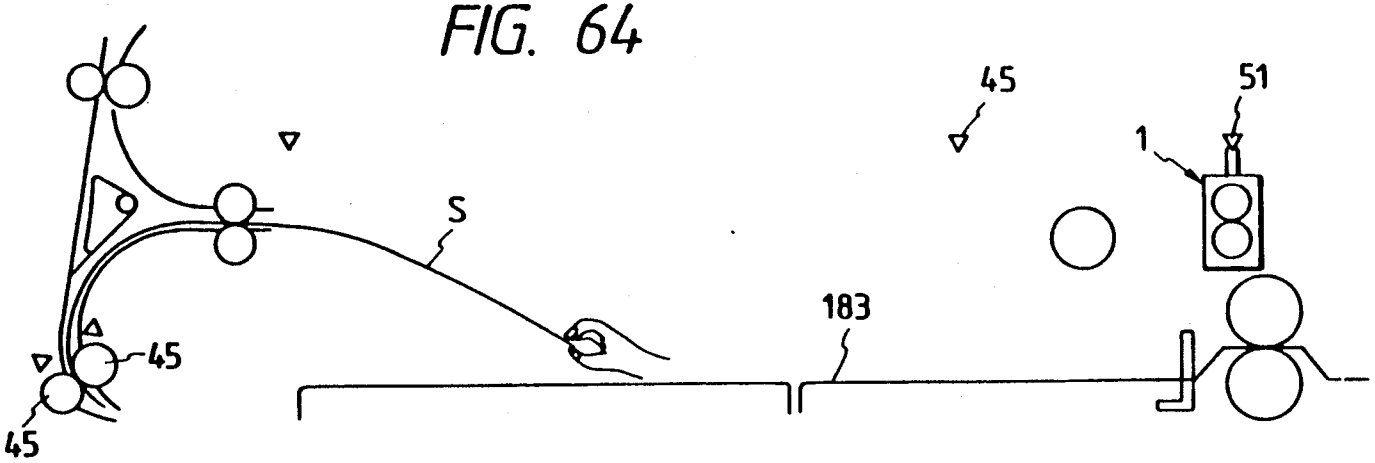
FIG. 65 is a chart showing the relation between the location of jamming and the position of carriage movement.

The above-explained method of jammed sheet removal is not dependent on the sheet size, but is applicable to the sheets of various sizes. FIG. 65 summarizes the relationship among the location of sheet jamming, position of movement of the carriage unit 1 and the pressure of the carriage rollers 23, wherein "a" indicates a position actuating the HP sensor 46, and "b" indicates a position actuating the through-path sensor 51.

Figure 66:
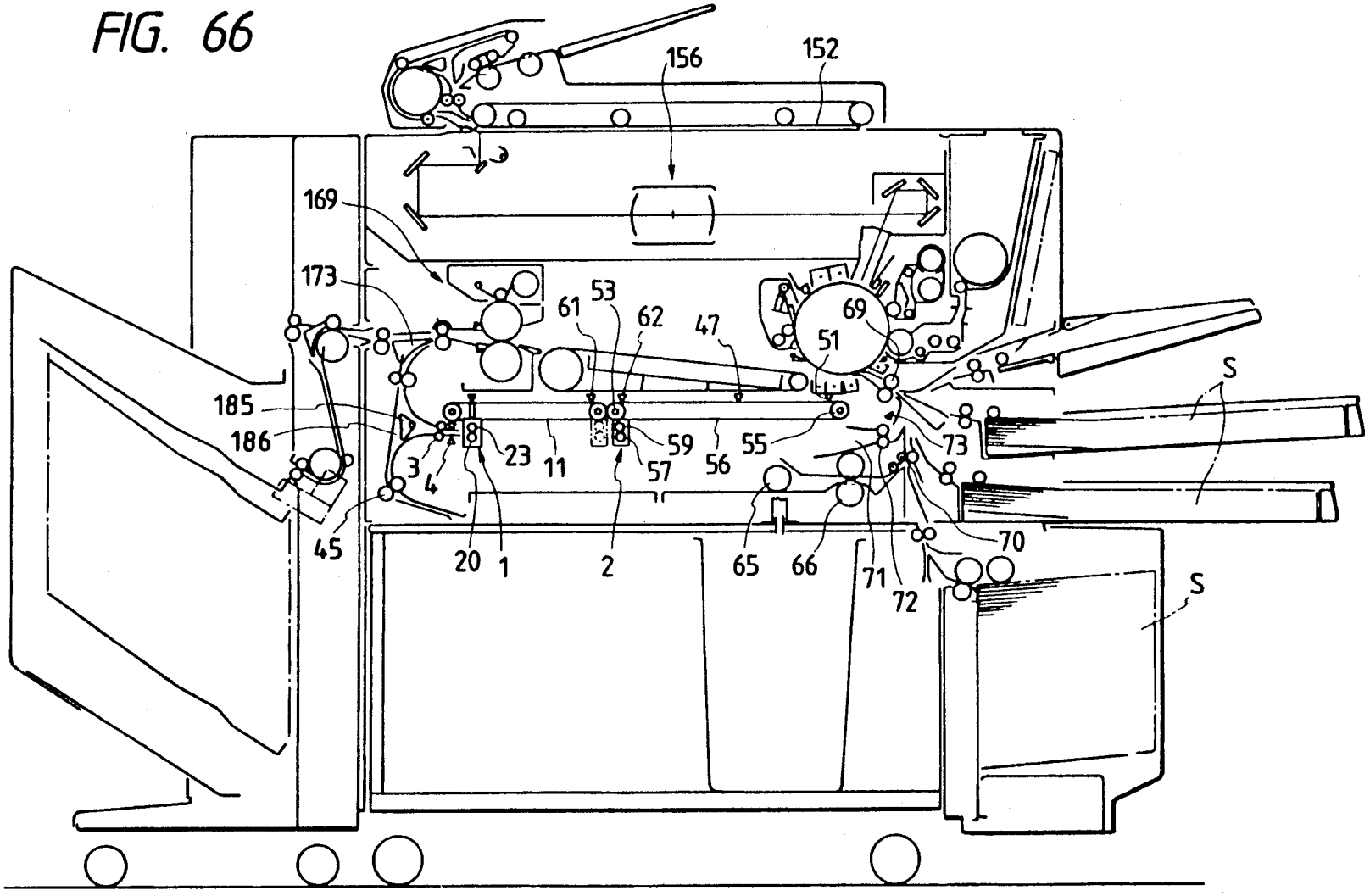
FIG. 66 is a longitudinal cross-sectional view of a sheet transporting apparatus constituting a sixth embodiment of the present invention.

FIG. 66 illustrates an image forming apparatus employing a sheet transporting apparatus constituting a sixth embodiment of the present invention.

The present embodiment is equipped with two carriage units which are independently movable, and the carriage rollers 20, 23 of the first carriage unit 1 and those 57, 59 are also independently rotatable.

Figure 67:
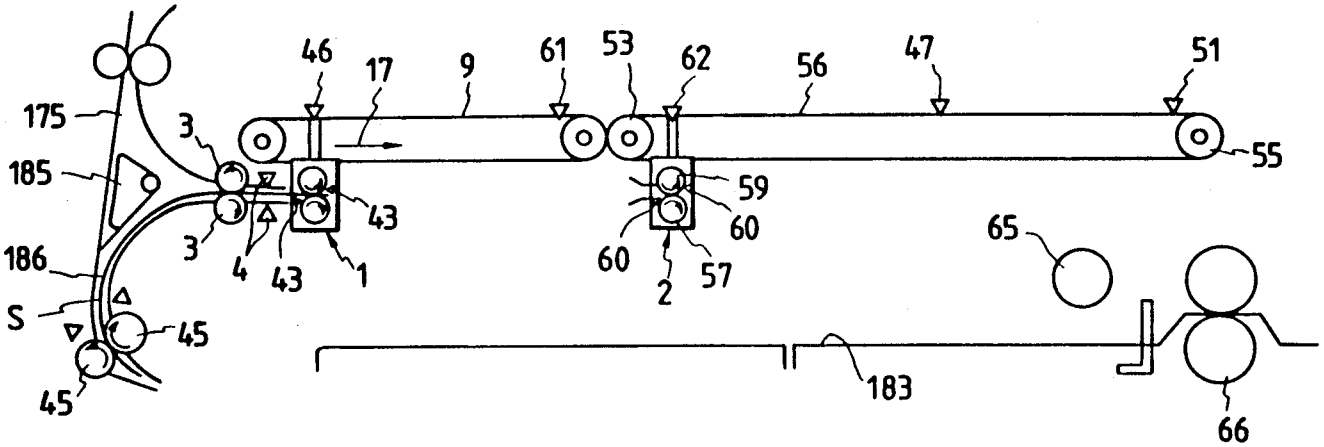
FIGS. 67 to 71 are views showing the functions of half-sized sheet transportation.

As shown in FIG. 67, the first carriage unit 1 can be moved by the belt 9 in the sheet discharging direction 17 or in the opposite direction, as in the foregoing embodiments. Also the second carriage unit 2 is movably supported in the direction 17 and is driven by belts 56, which are supported by pulleys 53 driven by an unrepresented motor and idler pulleys 55, and the upstream side of said belts 56 is positioned close to the downstream side of the belts 9.

Said carriage unit 2 is provided, at the nip side of the carriage rollers 57, 59, with a guide slot 2a for receiving the sheet S from the carriage unit 1 and a pair of roller sensors 60 for detecting the sheet S. At the downstream side of the HP sensor 46 for detecting the home position of the carriage unit 1, there are provided a sensor 61 to be actuated by the first carriage unit 1 and sensors 62, 47, 51 etc. to be actuated by the second carriage unit 2.

In the following there will be explained the function of the above-explained structure, in case of forming n (>1) two-side half-sized copies from an original.

The operations from the one-side copying on path 186 are same as those in the conventional C-shaped path shown in FIG. 1, and are therefor not explained.

Referring to FIG. 67, the switchback rollers 45 and the discharge rollers 3 rotate as indicated by arrows to advance the sheet S toward the carriage unit 1. When the intermediate tray discharge sensor 4 detects the front end of the sheet, the carriage rollers 20, 23 of the carriage unit 1 are rotated as indicated by arrows by means of the motor 32, thereby clamping the front end of said sheet S. In this state the switchback rollers 45 rotate simultaneously with said carriage rollers 20, 23.

When the carriage roller sensor 43 in the first carriage unit 1 detects that the front end of the sheet S is clamped in the nip between the carriage rollers 20, 23, the motor 32 is deactivated to stop the carriage rollers 20, 23. Then the driving motor 16 shown in FIG. 54 is activated to move the first carriage unit 1 in the direction 17 shown in FIG. 67, and the switchback rollers 45 rotates with a peripheral speed same as the moving speed of the carriage unit 1. In this state the second carriage unit 2 is stopped at a position actuating the sensor 62.

Figure 68:
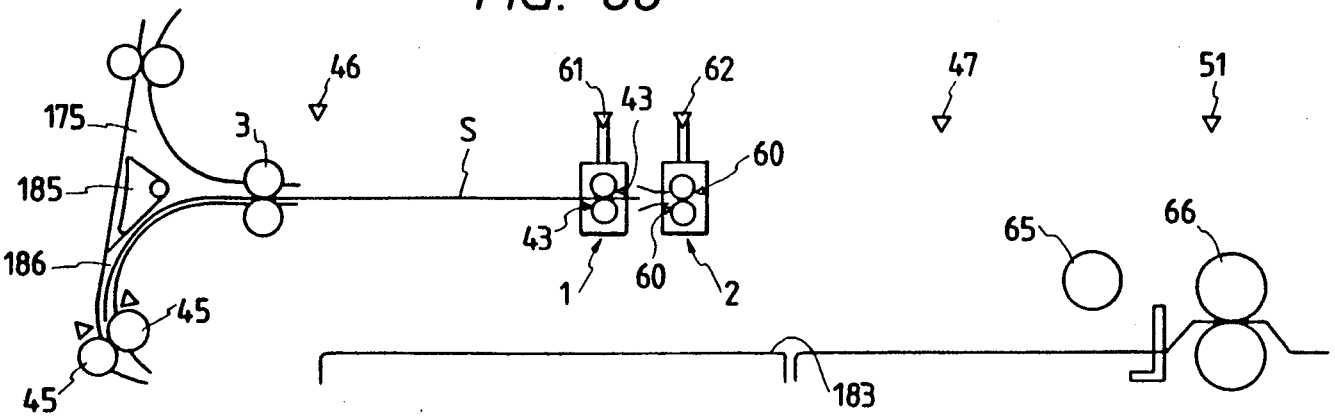

When the sensor 61 is actuated by the actuating member 42 (cf. FIG. 5) of the carriage unit 1 moving in the direction 17, a brake (not shown) is applied to said motor 16 whereby the carriage unit 1 is stopped in a state as shown in FIG. 68. In this state the carriage rollers 20, 23 of the first carriage unit 1 and those 57, 59 of the second carriage unit 2 start to rotate, whereby the sheet S is inserted into said carriage unit 2.

Figure 69:
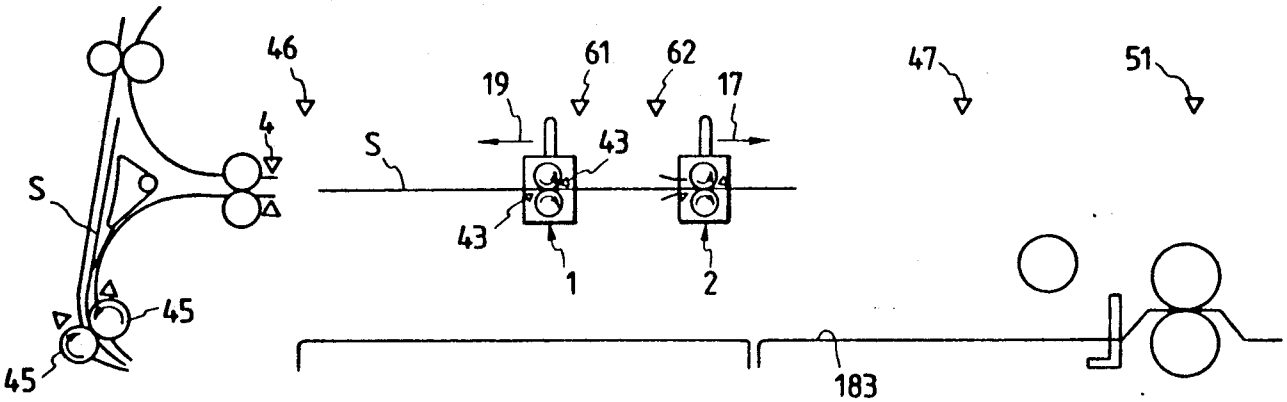

When the sensor 60 detects that the front end of the sheet S is clamped in the nip between the carriage rollers 57, 59 of the carriage unit 2, the carriage units 1, 2 respectively move in the directions 19 and 17 with a speed V, as shown in FIG. 69. Also the sheet S supported by the carriage unit 2 moves in the direction 17 with a speed V.

In the course of said movement of the carriage unit 2, the carriage rollers 57, 59 thereof are in the stopped state, thus clamping the sheet S therebetween, while the carriage rollers 20, 23 of the carriage unit 1 rotate with a peripheral speed 2V. Even if the rotating speed of said carriage rollers 20, 23 is less than the moving speed of the sheet S, it is protected from breakage due to the presence of one-way (not shown) clutch provided in the gear 35 integral with the carriage rollers 20 of the carriage unit 1.

Figure 70:
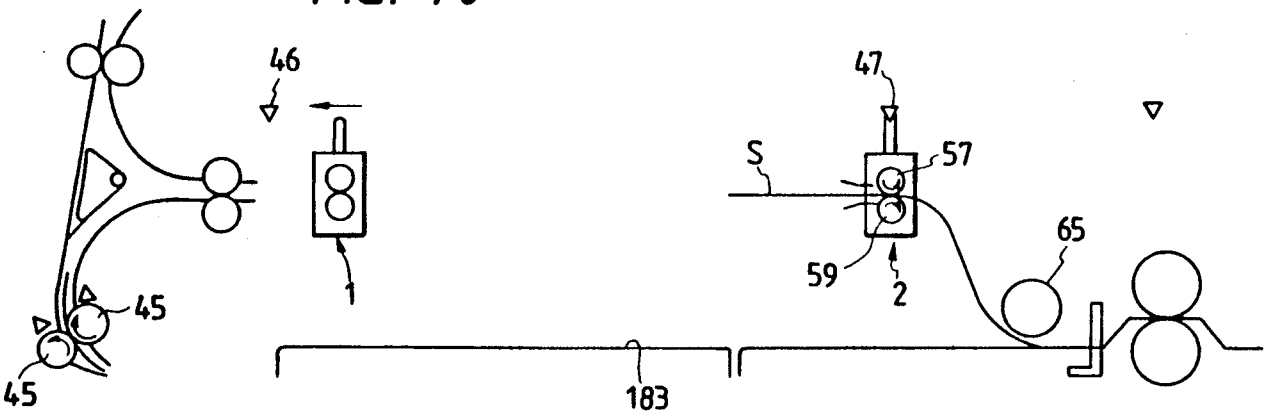
Figure 71:
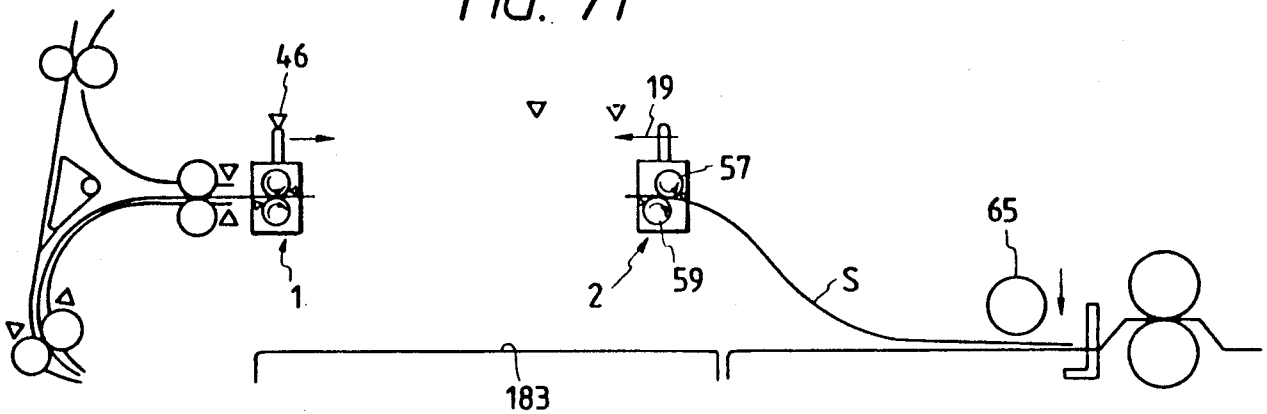
Figure 72:
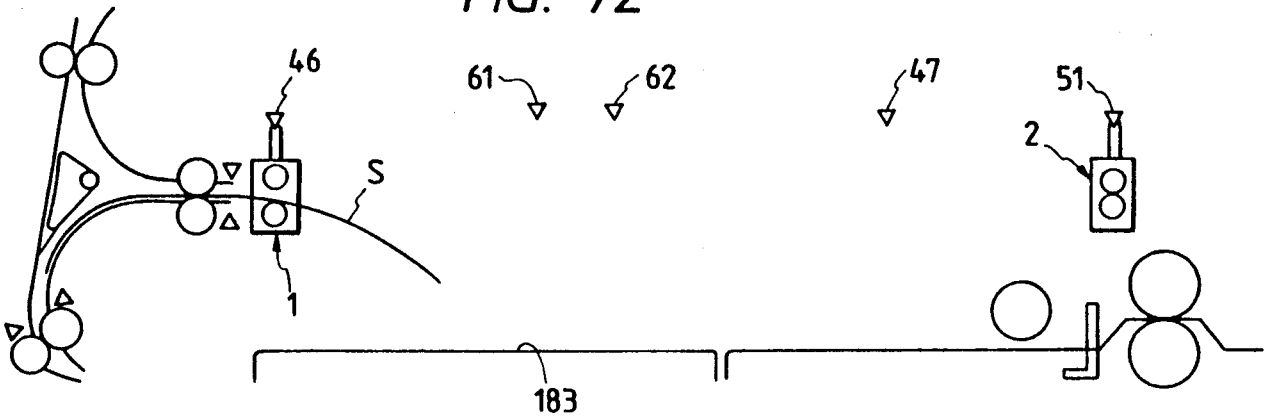
FIGS. 72 to 74 and 75 are charts showing the relation between the location of sheet jamming and the position of carriage movement.

The carriage unit 2 is stopped when the discharge sensor 47 detects the actuating member 63 of the carriage unit 2 as shown in FIG. 61. Also deflecting solenoid (not shown) of the carriage unit 2 (corresponding to the solenoid 30 of the carriage unit 1) is energized to shift the carriage rollers toward the sheet discharge side as shown in FIG. 70 thereby shifting the sheet discharge direction slightly downward. The carriage rollers 57, 59 are rotated as indicated by arrows to discharge the sheet S. In the course of said sheet discharge, the carriage unit 2 returns in the direction 19 with a speed V, as shown in FIG. 71.

Since the discharge speed of the sheet S is V, it is stopped relative to the intermediate tray 183 and merely drops thereon. In the sheet discharge mentioned above, the carriage rollers 57, 59 of the carriage unit 2 rotate with a peripheral speed 2V. In the course of the sheet discharge by the carriage unit 2, the carriage unit 1 fetches the next sheet S and moves in the direction 17. Upon completion of the sheet discharge onto the intermediate tray 183, solenoid (not shown) is energized to lower the feed roller 65 into contact with the sheet S. Then the deflecting solenoid of the carriage unit 2 is deactivated to return the carriage rollers 59 to the original position.

Then the first and second carriage units 1, 2 return to the state shown in FIG. 68 to again effect the sheet transfer to the carriage unit 2. Also the feed roller 65 is lifted from the sheet S on the intermediate tray 183, and the next sheet is stacked onto the intermediate tray 183. When the sheet stacking on said tray 183 is completed, the stacked sheets are aligned in the lateral direction by an unrepresented lateral movement motor. The sheet refeeding from the intermediate tray 183 is conducted in the same manner as in the conventional apparatus shown in FIG. 1. More specifically the feed roller 65 is lowered by the function of the solenoid (not shown) onto the stacked sheets S to advance the same, and a sheet is separated by the separating roller 66 at the downstream side. The skewed sheet feeding is corrected by formation of loops between the second registration rollers 70 and the separating roller 66, and between the first registration rollers 69 and the separating roller 66.

In the following there will be explained the removal of sheet jamming eventually taking place in the course of above-explained functions.

If the first and second carriage units 1, 2 are in a state shown in FIG. 67 or 68 (sensors 4, 43 being on but sensor 60 being off), the pressure of the carriage rollers 23 of the first carriage unit 1 is released by the method explained in the first embodiment. At the same time the carriage unit 1 moved to a position actuating the intermediate tray discharge sensor 4 while the second carriage unit 2 is moved to a position actuating the through-path sensor 51.

Figure 73:
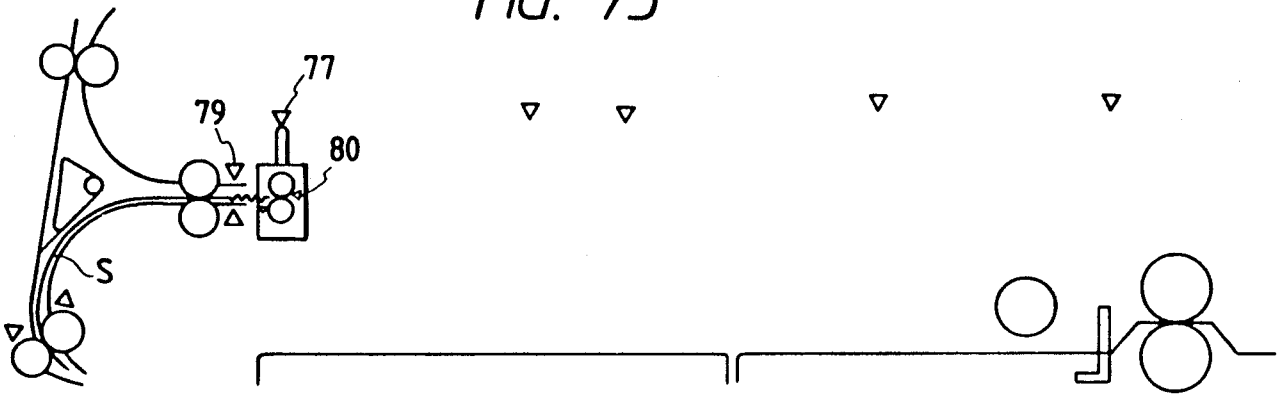
Figure 74:
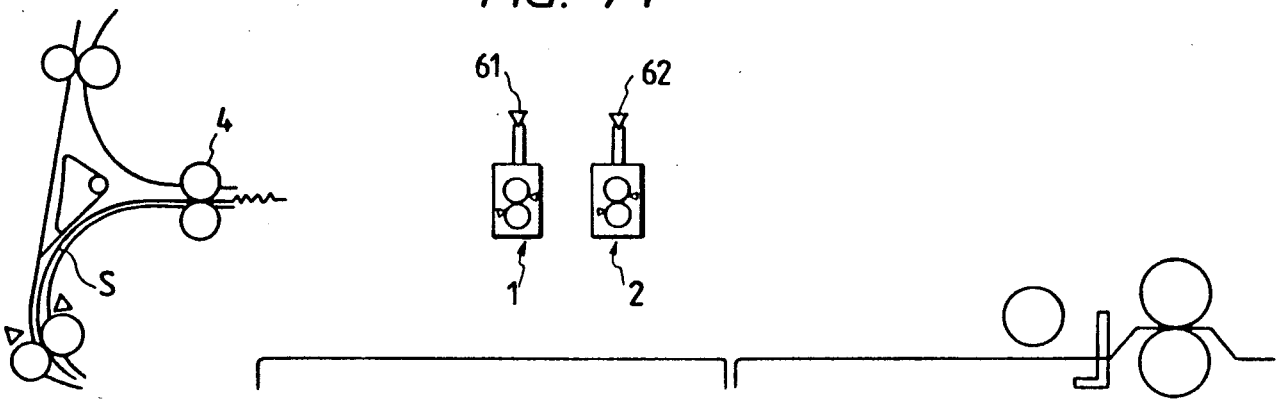

Also if the sheet jamming occurs, as shown in FIG. 73, from the failure in the sheet transfer to the nip of the carriage rollers 20, 23 of the first carriage unit 1 (sensor 79 being on but sensors 80, 60 being off), the removal of the jammed sheet is conducted by moving, as shown in FIG. 74, the carriage unit 1 to a position actuating the sensor 61 and the carriage unit 2 to a position actuating the sensor 62.

Figures 75, 76:
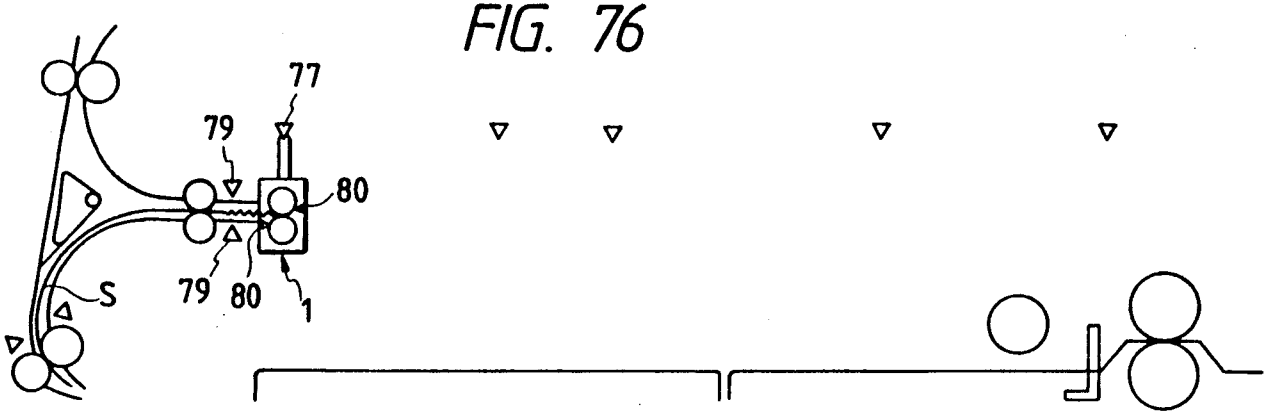
FIGS. 76 and 77 are views showing the functions of jammed sheet removal for half-sized sheet.

Also if the sheet jamming takes place in a state shown in FIG. 69 (sensor 4 being on but sensors 43, 60 being off), the pressure is released in the carriage rollers 23, 59 of the first and second carriage units 1, 2, and the carriage unit 1 is moved toward the HP sensor 46 while the carriage unit 2 is moved toward the through-path sensor 51. FIG. 75 summarizes the on-off states of the sensors and the positions of the carriage units 1, 2 in these sheet jamming states, wherein A, B, C and D respectively indicate positions for actuating the sensor 46, 61, 62 and 51.

In the following there will be explained the operation of forming n (>1) large-sized copies from an original, with reference to FIGS. 78 to 81.

In such operation, the second carriage unit 2 is retracted to the position actuating the throughpath sensor 51. The first carriage unit 1 fetches the front end of the sheet S at the position of the intermediate tray discharge sensor 4 as in the half-sized copying, and then moves in the direction 17 with stopped carriage rollers 20, 23. Then the carriage unit 1 stops at a position actuating the sensor 61, and the solenoid 30 shown in FIG. 55 is energized to shift the discharge direction of the carriage rollers 20, 23 slightly downward, and said rollers are rotated in this state to discharge the sheet S onto the intermediate tray 183.

Figure 80:
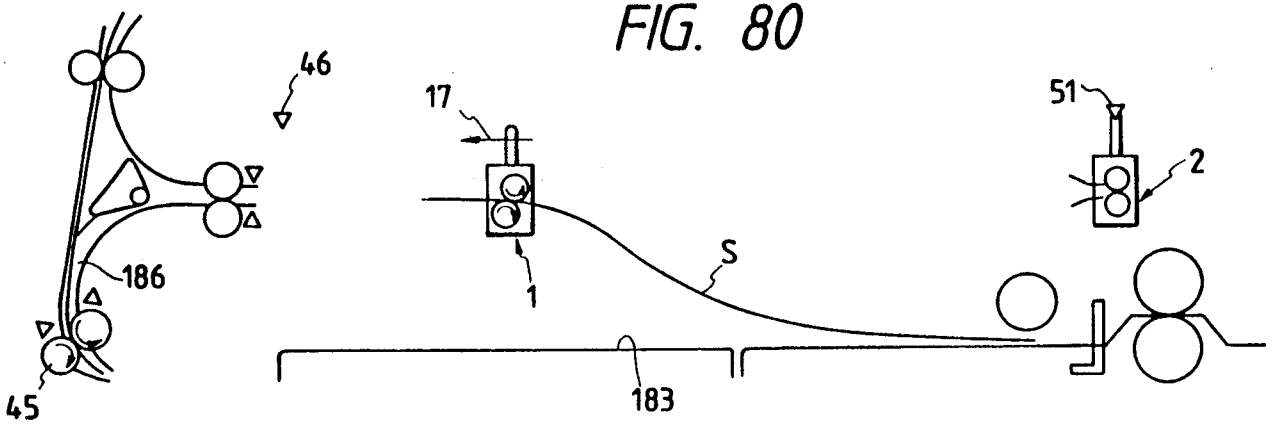

In the course of said sheet discharge, the carriage unit 1 moves in the direction 19 as shown in FIG. 80. In order that the carriage unit 1 discharges the sheet with a speed V while moving at a speed V, the carriage rollers 20, 23 are rotated with a speed 2V. At the same time the next sheet enters the switchback path 186 and is pinched by the switchback rollers 45. When the carriage unit 1 returns to the home position and actuates the sensors 79, said next sheet is clamped by the carriage rollers 20, 23.

In the following there will be explained the operation in case of sheet jamming in the course of the operation of the carriage unit 1 explained above.

Figure 77:
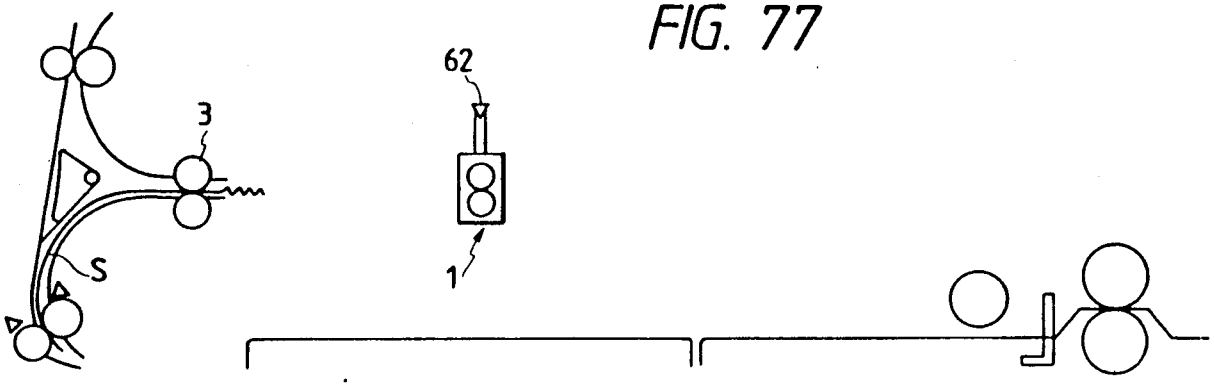
Figure 78:
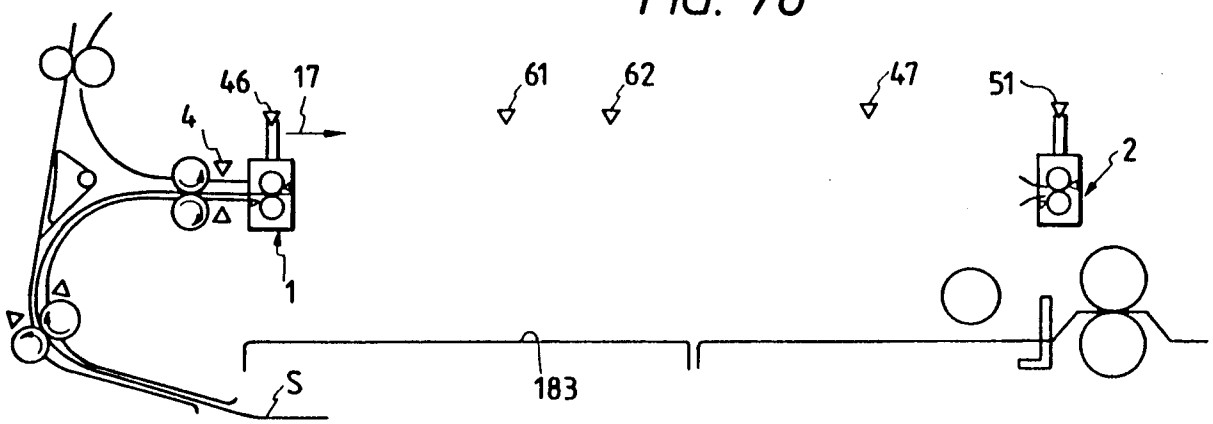
FIGS. 78 to 81 are views showing the functions of jammed sheet removal for large-sized sheet.
Figure 79:
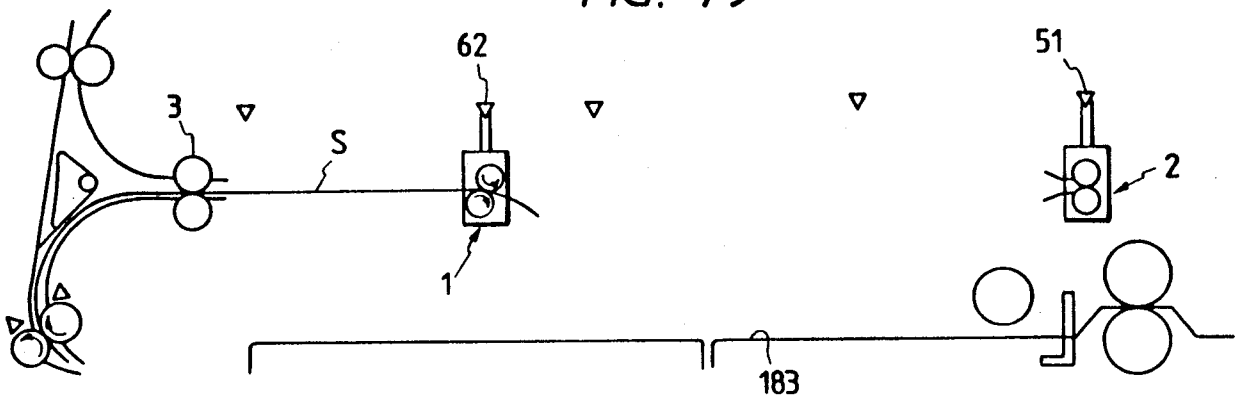
Figures 85, 86:
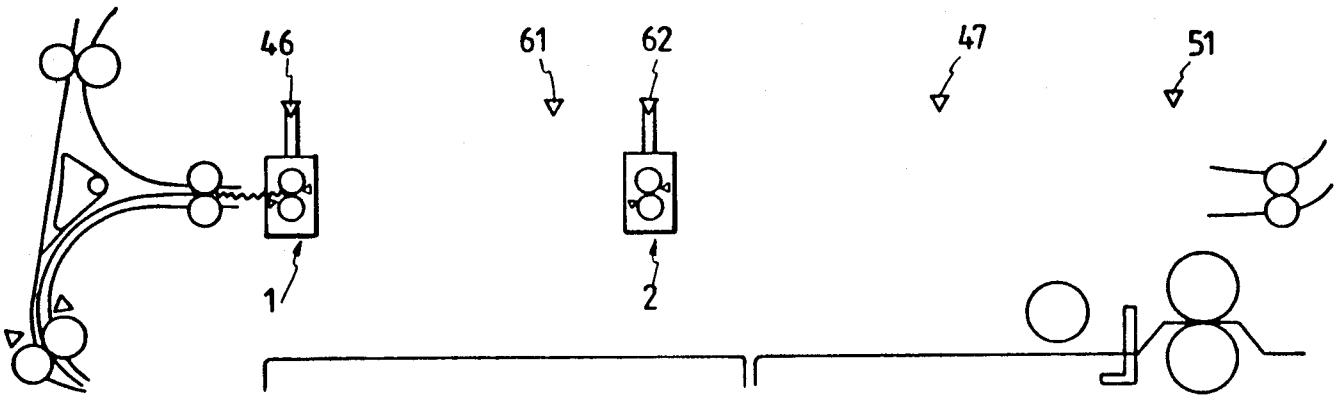

If the sheet jamming occurs by a failure in the sheet transfer to the carriage unit 1 as shown in FIG. 76, the carriage unit 1 moves to a position actuating the sensor 62 as shown in FIG. 77. Also if the sheet jamming occurs in a state shown in FIG. 78 or 79 (sensors 79, 80 being on), the pressure of the carriage roller 23 of the carriage unit 1 is released, and said carriage unit 1 moves toward the sensor 62 as shown in FIG. 79. Also if the sheet jamming occurs in a state shown in FIG. 80 (sensor 79 being off, but sensor 80 being on), the roller pressure of the carriage unit 1 is released and said unit 1 moves toward the sensor 79. FIG. 86 summarizes the functions of the carriage units 1, 2 and the sensors 79, 80.

In the following there will be explained the operations of forming a two-side copy from a two-side original or from two one-side originals, either on half-sized or large-sized sheet, with reference to FIGS. 82, 83 and 89.

The advancement of the sheet S through the switchback path 186 to the carriage rollers 20, 23 of the unit 1 and to those 57, 59 of the unit 2 is conducted in a similar as shown in FIGS. 67 to 69. The carriage unit 2 moves to a position actuating the through-path sensor 51 as shown in FIG. 82, and at the same time the carriage unit 1 moves in a direction 17. By the rotation of the carriage rollers 57, 59 of the carriage unit 2, the sheet S is forwarded to the transport rollers 72 in the through-path 71 (see FIG. 66).

When the front end of the sheet S is detected by the sensor 73, the carriage unit 2 returns in the direction 19, while the carriage unit 1 moves in the direction 17, fetching the next sheet. Said sheet is transferred to the unit 2, when the carriage units 1, 2 reach the transfer position. The sheet discharged from the carriage unit 2 is forwarded with formation of a loop between the transport rollers 72 and the first registration rollers 69. Though the sheet S is temporarily freed in case it is stacked on the intermediate tray 183, it is always supported when it is guided through the through-path, so that the formation of only a loop is sufficient for skewed feed correction.

Figure 82:
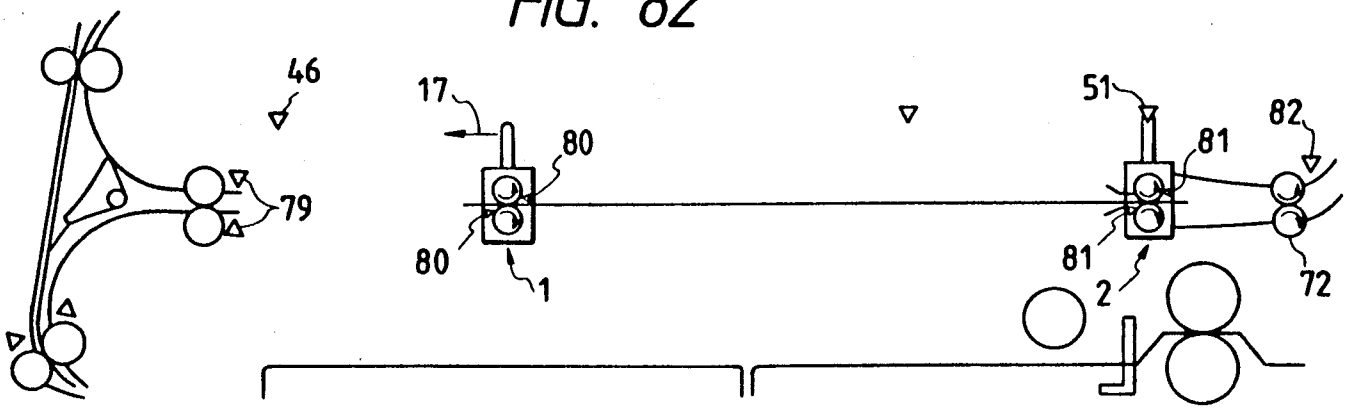
Figure 83:
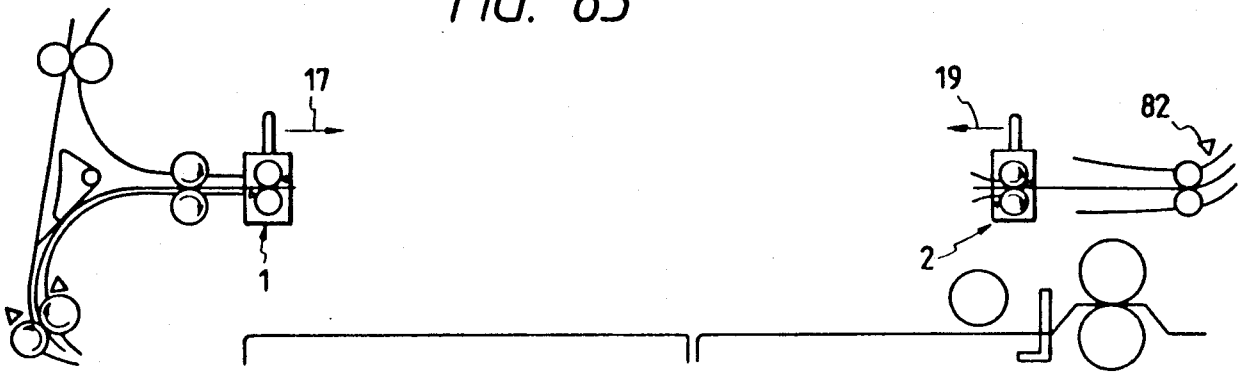
Figure 84:
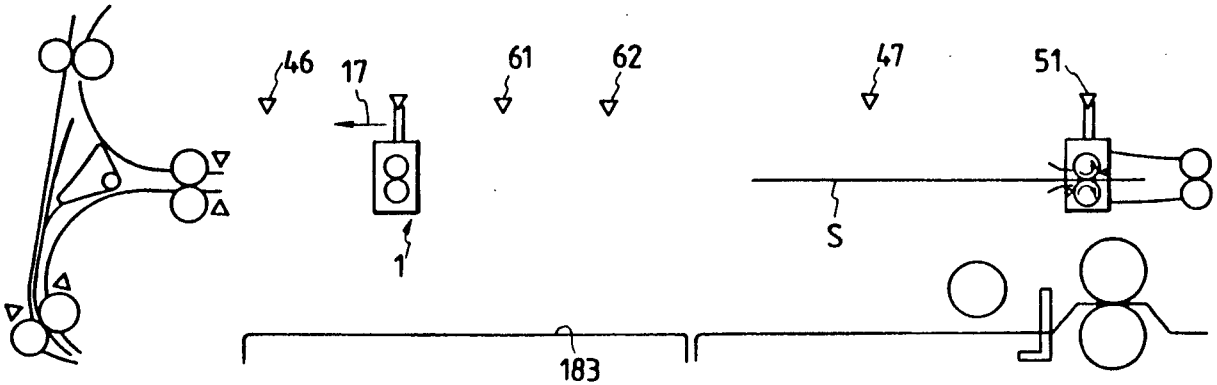
Figure 89:
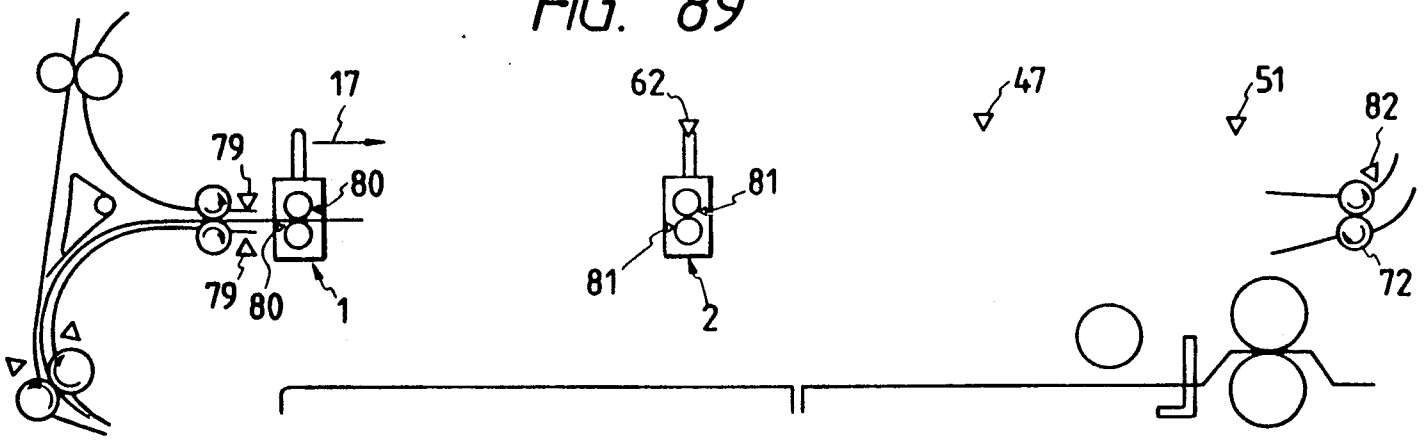
FIG. 89 is a view showing the function of sheet passing in a through-path.

FIGS. 82, 83 and 89 show the functions for a large-sized sheet. In case of a half-sized sheet, the state in FIG. 83 is not present, so that the sheet S is temporarily supported only by the second carriage unit 2, but the hanging of the rear end of the sheet is avoided by the presence of the reinforcing rollers 25 explained before.

In the following there will be explained the operation in case of sheet jamming in the course of sheet feeding by the through-path 71.

Figure 81:
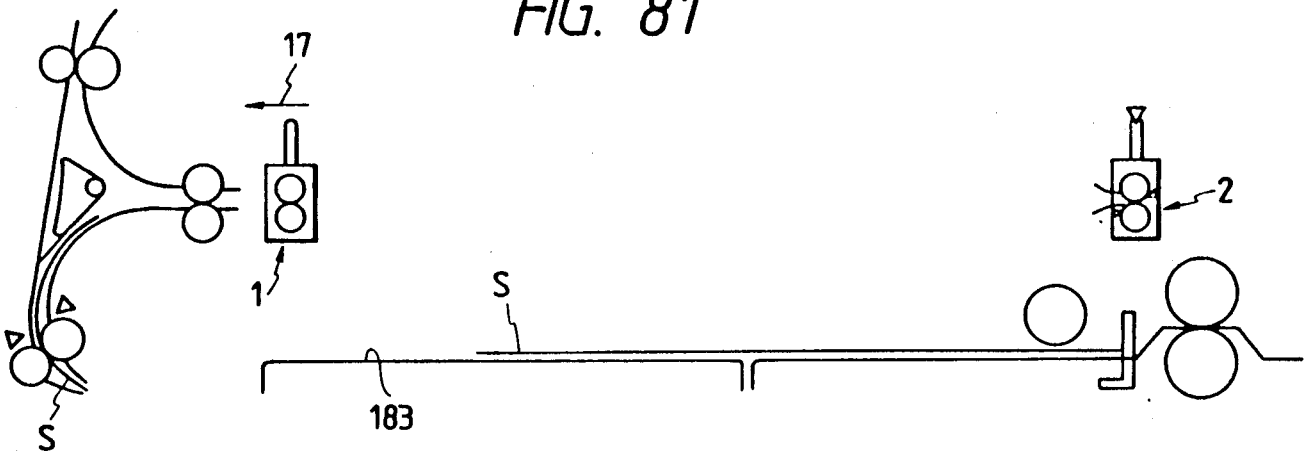

The sheet transfer to the carriage unit 1 shown in FIG. 85 and the sheet transportation by the carriage unit 1 shown in FIG. 81 are same as those in sheet stacking onto the intermediate tray 183. Consequently the removal of jammed sheet is conducted in the same manner.

If the sheet jamming occurs when the carriage units 1, 2 are in a state shown in FIG. 82 (large-sized sheet transportation with sensors 80, 81 being on but sensors 79, 82 being off), the carriage unit 2 is moved to a position actuating the through-path sensor 51 with released roller pressure, while the carriage unit 1 is moved to a position actuating the HP sensor 46 with released roller pressure. FIGS. 87 and 88 summarizes, respectively for large-sized and small-sized sheet, the relation between the location of sheet jamming and the corresponding positions of the carriage units 1, 2.

The foregoing embodiment shows the application of the present invention to the intermediate tray 183 of the main body 151 of a copying machine, but similar advantages can be obtained when it is applied to a recycling document feeder.

What is claimed is:

1. An image forming apparatus provided with a sheet transporting device, comprising:

sheet storage means provided in the middle of a sheet transport path for storing sheets thereon;

a first carriage unit comprising first sheet discharge means for transporting a sheet and capable of reciprocating motion between a home position and a predetermined position;

a second carriage unit comprising second sheet discharge means for transporting a sheet between said predetermined position and a discharge position and capable of reciprocating motion substantially along above said sheet storage means; and control means for causing said first carriage unit to move to the predetermined position while said first sheet discharge means holds said sheet, said first carriage unit returning to the home position after the second sheet discharge means holds the sheet, said second carriage unit moving said sheet to the discharge position so that said second sheet discharge means feeds the sheet to said sheet storage means.

2. An apparatus according to claim 1, wherein the sheet discharge means of each said carriage unit comprises paired carriage rollers for supporting and transporting the sheet.

3. An apparatus according to claim 2, wherein at least one of said paired carriage rollers is capable of rotating about the other.

4. An apparatus according to claim 1, further comprising a control circuit for varying reciprocating distance of said second carriage unit, according to the sheet size.

5. An image forming apparatus provided with a sheet transporting device, comprising:

sheet storage means provided in the middle of a sheet transport path for storing sheets thereon;

a carriage unit comprising sheet discharge means for transporting a sheet to said sheet storage means and capable of reciprocating motion substantially above said sheet storage means;

a first path for guiding the sheet from said sheet storage means to a sheet re-feeding path at a downstream side in the sheet feeding direction of said carriage unit;

a second path for guiding the sheet to said sheet re-feeding path without passing through said sheet storage means; and control means for selecting a mounting mode for controlling said carriage unit to feed out the sheet to said sheet storage means or a passage mode for controlling said carriage unit to feed out the sheet to said second path.

6. An image forming apparatus according to claim 5, wherein said carriage unit has a pair of carriage rollers, and an inlet port of said second path is provided at substantially the same height as a nip of said paired rollers.

7. An image forming apparatus with a sheet transporting device comprising:

sheet storage means provided in the middle of a sheet transport path for storing sheets;

discharge rollers for discharging a sheet, provided at a predetermined position at the upstream side of said sheet storage means; and a carriage unit comprising paired carriage rollers for supporting and transporting the sheet discharged from said discharge rollers and capable of reciprocating motion along said sheet storage means;

wherein the sheet discharge position of said carriage unit is variable according to the size of the sheet transported by said carriage unit.

8. An apparatus according to claim 7, comprising plural carriage units in serial manner.

9. An apparatus according to claim 7, comprising a member for reinforcing the rigidity of the sheet, in the vicinity of the nip of the carriage rollers in said carriage unit.

10. An apparatus according to claim 9, wherein said rigidity reinforcing member is composed of a roller coaxial with at least one of said paired carriage rollers and larger in diameter than said coaxial carriage roller.

11. An apparatus according to claim 8, wherein said plural carriage units are independently movable, and further comprising drive means for independently driving the carriage rollers of each carriage unit.

12. An image forming apparatus according to claim 1, wherein said second carriage unit is capable , while discharging the sheet to said sheet storage means, of moving in a direction opposite to the direction of said sheet discharge.

13. An apparatus according to claim 12, wherein the carriage rollers of said second carriage unit rotate, at said sheet discharge, with a peripheral speed equal to the sum of the sheet discharge speed of said second carriage unit and the moving speed thereof.

14. An image forming apparatus with a sheet transporting device comprising:

sheet storage means for temporarily storing sheets and provided in the middle of a sheet transport path;

discharge rollers for discharging a sheet, provided at a predetermined position at the upstream side of said sheet storage means; and a carriage unit provided with paired carriage rollers for supporting and transporting the sheet discharged from said discharge rollers and capable of reciprocating motion along said sheet storage means;

wherein said carriage unit is moved to and stopped at a predetermined position when detector means detects sheet storage means.

15. An apparatus according to claim 14, wherein the stopping position of said carriage unit is variable according to the location of sheet jamming detected by said detector means.

16. An apparatus according to claim 14, wherein said carriage rollers comprise releasing means for releasing the roller pressure in case the sheet jamming is detected.

* * * * *

UNITED STATES PATENT AND TRADEMARK OFFICE

CERTIFICATE OF CORRECTION

PATENT NO. : 5,110,104

DATED : May 5, 1992

INVENTOR(S) : WAKAO, ET AL.

It is certified that error appears in the above-identified patent and that said Letters Patent is hereby corrected as shown below:

COLUMN 4
Line 46, "partical" should read --partial--.

COLUMN 15
Line 6, "5bof" should read --5b of--.

COLUMN 17
Line 14, "on path" should read --on the sheet S to the entry thereof into the switchback path--.

COLUMN 22
Line 36, "sheet storage" should read --sheet jamming in the course of sheet transportation to said sheet storage--.

Signed and Sealed this

Fifth Day of October, 1993

Bruce Lehman

*Attest:*

BRUCE LEHMAN

*Attesting Officer*

*Commissioner of Patents and Trademarks*